US011788787B2

(12) United States Patent
Choi

(10) Patent No.: US 11,788,787 B2
(45) Date of Patent: Oct. 17, 2023

(54) REFRIGERATOR

(71) Applicant: LG ELECTRONICS INC., Seoul (KR)

(72) Inventor: Taehoon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/070,895

(22) Filed: Nov. 29, 2022

(65) Prior Publication Data

US 2023/0088385 A1 Mar. 23, 2023

Related U.S. Application Data

(63) Continuation of application No. 17/087,964, filed on Nov. 3, 2020, now Pat. No. 11,543,173.

(30) Foreign Application Priority Data

Dec. 16, 2019 (KR) ..... 10-2019-0167438

(51) Int. Cl.
*F25D 23/12* (2006.01)
*B67D 3/00* (2006.01)

(52) U.S. Cl.
CPC ..... *F25D 23/126* (2013.01); *B67D 3/0038* (2013.01)

(58) Field of Classification Search
CPC ..... F25D 23/126; B67D 3/0038
USPC ..... 62/389–391
See application file for complete search history.

(56) References Cited

U.S. PATENT DOCUMENTS 6,152,325 A * 11/2000 Edwards ..... B67D 1/0043 222/1
6,810,682 B1 * 11/2004 Schuchart ..... F25D 23/126 62/98
7,121,108 B2 10/2006 Lee
7,188,487 B2 * 3/2007 Choi ..... B67D 1/0858 62/389
7,194,872 B2 * 3/2007 Kim ..... F25D 23/126 62/338
7,658,212 B2 * 2/2010 Meuleners ..... F25D 23/126 62/391
7,810,345 B2 * 10/2010 Nebbia ..... F25D 23/126 62/338
7,918,368 B2 * 4/2011 Crisp ..... B67D 1/12 222/129

(Continued)

FOREIGN PATENT DOCUMENTS

KR 10-2011-0117115 10/2011
WO WO 2014177258 11/2014
WO WO-2014177358 A1 * 11/2014 ..... E03B 7/075

*Primary Examiner* — Timothy L Maust
(74) *Attorney, Agent, or Firm* — KED & ASSOCIATES, LLP

(57) ABSTRACT

A refrigerator includes an outer case, an inner case configured to define a storage space, an insulation material between the outer case and the inner case, a tank provided inside the storage space to store liquid, a rear guide provided at a rear through which a supply tube configured to supply liquid to the tank passes, a dispenser provided inside of the storage space to dispense liquid from the tank, and a tube guide embedded in the insulation material between the inner case and the outer case to define a passage through which a discharge tube configured to connect the tank to the dispenser passes.

21 Claims, 43 Drawing Sheets

(56) References Cited

U.S. PATENT DOCUMENTS

| | | | | |
|---|---|---|---|---|
| 8,117,865 | B2 * | 2/2012 | Allard | H05K 5/0247 62/449 |
| 8,646,288 | B2 * | 2/2014 | Lim | B67D 1/0857 62/389 |
| 9,528,730 | B2 * | 12/2016 | Boarman | F25B 21/02 |
| 9,664,430 | B2 * | 5/2017 | Mitchell | F25C 5/182 |
| 10,830,520 | B2 * | 11/2020 | Yu | F25D 23/126 |
| 10,976,098 | B2 * | 4/2021 | Temizkan | F25D 23/126 |
| 11,118,832 | B2 * | 9/2021 | Choy | F25D 25/02 |
| 2004/0231353 | A1 * | 11/2004 | Schuchart | F25D 23/126 62/337 |
| 2010/0319388 | A1 * | 12/2010 | Yang | F25D 23/126 62/449 |
| 2011/0283734 | A1 * | 11/2011 | Koo | F25D 23/126 62/389 |
| 2013/0104586 | A1 * | 5/2013 | Krause | F25D 23/12 222/146.2 |
| 2015/0198359 | A1 * | 7/2015 | Boarman | F25D 11/006 62/3.63 |
| 2020/0208904 | A1 * | 7/2020 | Choy | F25D 23/126 |

* cited by examiner

REFRIGERATOR

CROSS-REFERENCE TO RELATED APPLICATION(S)

The present application is a continuation of U.S. patent application Ser. No. 17/087,964, filed Nov. 3, 2020, which claims priority under 35 U.S.C. 119 and 35 U.S.C. 365 to Korean Patent Application No. 10-2019-0167438, filed in Korea on Dec. 16, 2019, which are hereby incorporated by reference in its entirety.

BACKGROUND

1 Field

The present disclosure relates to a refrigerator.

2. Background

Refrigerators are used to store food in a storage space at a low temperature so as to be refrigerated or frozen. The refrigerator may cool an inside of the storage space by using cold air.

Recent refrigerators have been provided with various devices geared toward improving convenience. Refrigerators that dispense purified water through a dispenser provided outside a refrigerator door when the refrigerator door is closed are being developed. Refrigerators having such a structure where the dispenser is provided outside the refrigerator door may complicate an internal structure of the refrigerator door and increase manufacturing costs. In addition, dispensers having a recessed structure in the refrigerator door may result in less efficient heat insulation of the refrigerator door. Furthermore, an outer appearance of the door may be less pleasing due to an arrangement of the dispenser.

Korean Patent No. 10-2011-0117115 discloses a refrigerator including a dispenser and a water tank inside the refrigerator. However, such a refrigerator has a disadvantage in the loss of storage space within the refrigerator due to the arrangement of the dispenser and the water tank.

U.S. Pat. No. 6,810,682 discloses a refrigerator in which water supplied through a filter within the refrigerator is stored in a water reservoir within a refrigerating compartment, and a dispenser that dispenses purified water is provided at one side of one surface of left and right surfaces within the refrigerating compartment. However, the dispenser is difficult to access due to its location and may be blocked by or interfere with food stored in the refrigerator. In addition, the disclosed arrangement of a supply line, solenoid valve, and water reservoir is not efficient in quickly supplying water to the dispenser. In addition, it is difficult to prevent the line connecting the dispenser to the water reservoir from being exposed and to provide a stable connection structure.

The above references are incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
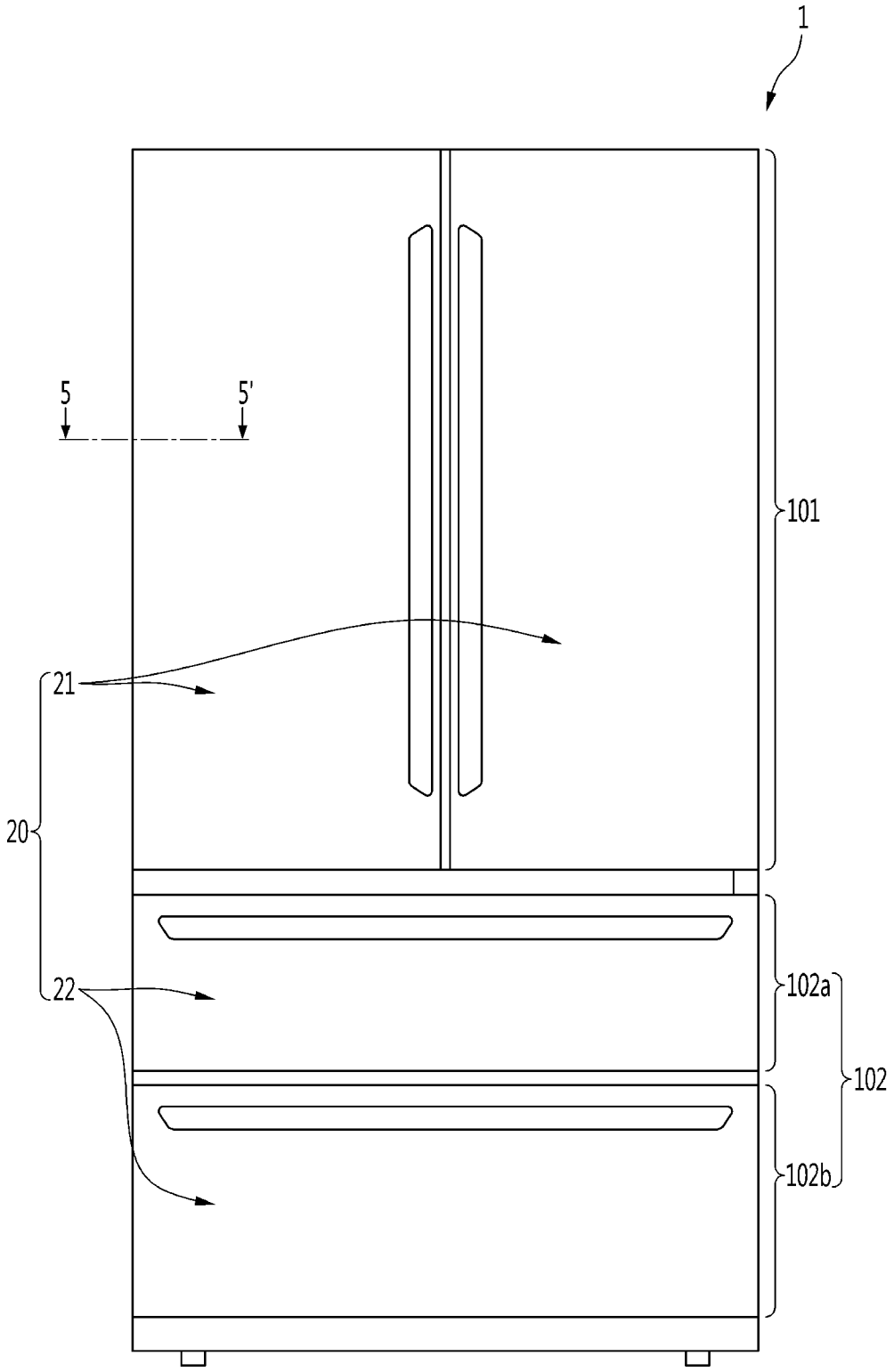
FIG. 1 is a front view of a refrigerator according to an embodiment.
Figure 2:
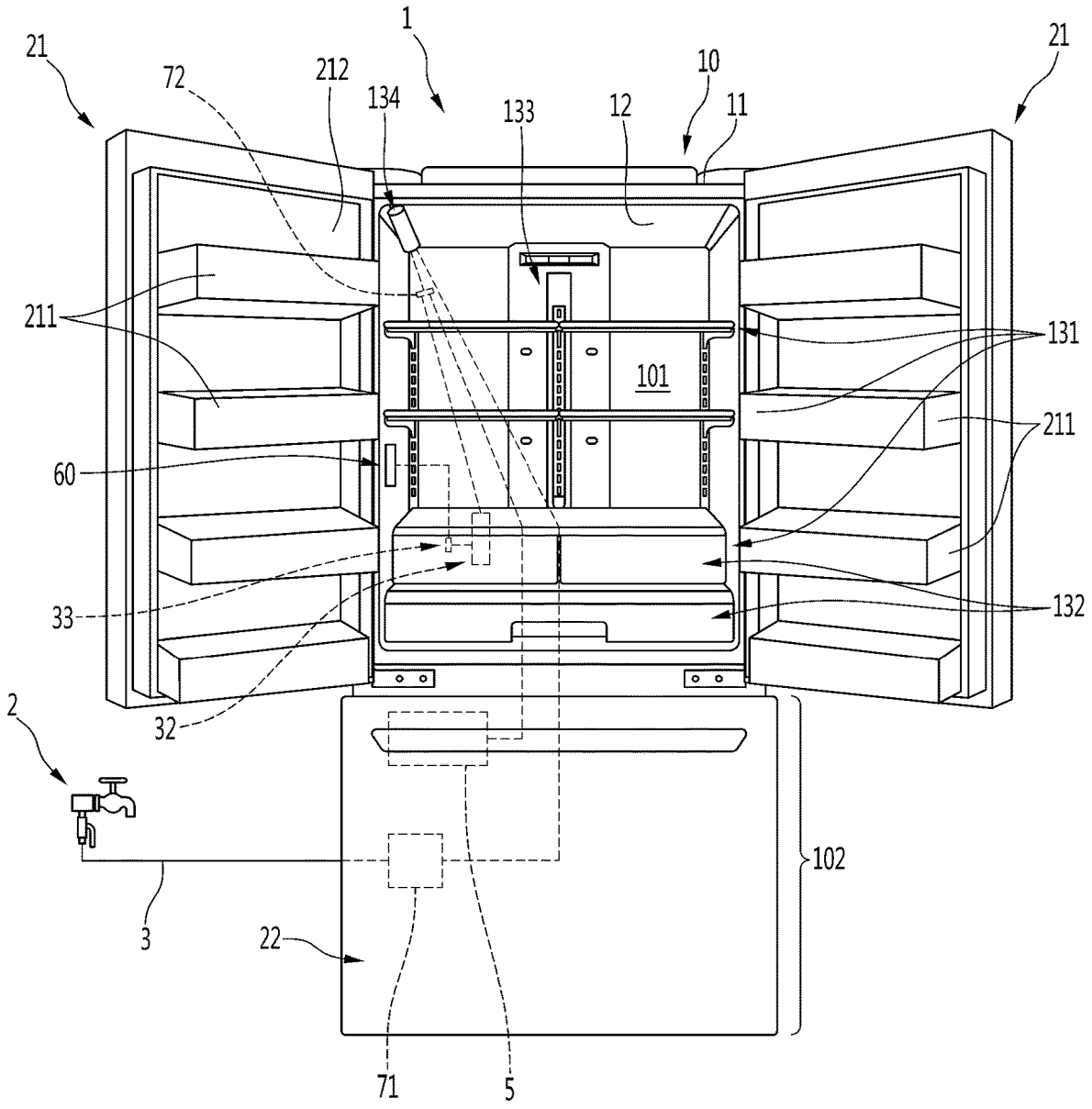
FIG. 2 is a front view illustrating a state in which a door of the refrigerator is opened.

Referring to FIGS. 1-2, a refrigerator 1 according to an embodiment may include a cabinet 10 defining a storage space and a door 20 that opens and/or closes the storage space. The door 20 may define an outer appearance and/or exterior of a front surface of the refrigerator 1 in a state in which the door 20 is closed. The door 20 may be provided in plurality and may be configured to open and/or close a plurality of storage spaces defined in the cabinet 10.

The cabinet 10 may define the storage spaces. The storage spaces of the cabinet 10 may be divided vertically, as shown in the Figures, or alternatively may be divided horizontally. Embodiments disclosed herein may be implemented in various types of refrigerators without being limited in shape and structure, and for convenience of explanation and understanding, a refrigerator 1 in which a freezing compartment 102 is provided below a refrigerating compartment 101 will be described as an example.

The refrigerating compartment 101 may be provided in an upper storage space of the cabinet 10, and the freezing compartment 102 may be provided in a lower storage space of the cabinet 10. The refrigerating compartment 101 may be referred to as the upper storage space or upper compartment, and the freezing compartment 102 may be referred to as the lower storage space or lower compartment.

The refrigerating compartment 101 may be opened and/or closed by at least one refrigerating compartment door 21. As shown in the Figures, the refrigerating compartment door 21 may be implemented in a French door structure having a pair of refrigerating compartment doors 21, which may be hinged to sides of the cabinet 10 to be opened and closed at both left and right sides of the refrigerating compartment 101. Since the refrigerating compartment door 21 may have a structure in which a pair of left and right doors open and close one space, the refrigerating compartment door 21 may alternatively be referred to as a French door. Also, since the refrigerating compartment door 21 may open the refrigerating compartment 101, which may be above the freezing compartment 102, the refrigerating compartment door 21 may be referred to as an upper door.

The freezing compartment 102 may be opened and/or closed by at least one freezing compartment door 22, which may have a drawer structure to be inserted and withdrawn in a front-rear direction. Since the freezing compartment door 22 may open the freezing compartment 102, which may be below the refrigerating compartment 101, the freezing compartment door 22 may be referred to as a lower door.

As shown in FIG. 1, the freezing compartment 102 may be implemented by a plurality of freezing compartment doors 22. The freezing compartment 102 may have a plurality of spaces 102*a* and 102*b* that are partitioned vertically, each opened and closed by one freezing compartment door 22. The plurality of spaces 102*a* and 102*b* may be controlled to have different temperatures. As an alternative, the freezing compartment 102 may be configured as one space or multiple spaces having a same temperature, and the plurality of freezing compartment doors 22 may be configured to partially open and close the one space of the freezing compartment 102. As another alternative, the freezing compartment 102 may be configured to be opened and closed by a single freezing compartment door 22, as illustrated in FIG. 2.

The cabinet 10 may include an outer case 11 defining an outer appearance or exterior thereof and an inner case 12 defining the storage space therein. An insulation material 120 may be filled between the outer case 11 and the inner case 12.

Storage members such as at least one shelf 131, at least one drawer 132, and at least one basket or enclosed shelf 211 may be provided in the storage space of the cabinet 10 to store and/or support items. For example, a plurality of shelves 131 may partition the inside of the refrigerating compartment 101 in a vertical direction, and a plurality of drawers 132 may be provided on a bottom surface of the refrigerating compartment 101 so as to be inserted and withdrawn in the front-rear direction. The drawers 132 may be stacked in the vertical direction (or alternatively in the horizontal direction), and opened top surfaces of the drawers 132 may be covered by drawer tables or lids 132*a* and 132*b*, respectively. Each of the drawer tables 132*a* and 132*b* may have a shelf-like structure and function such that items may be supported on top of the drawer tables 132*a* and 132*b*. A plurality of door baskets 211 may be vertically arranged on a rear surface of the refrigerating compartment door 21.

A refrigerating compartment duct 133 may be provided on a rear wall surface of the refrigerating compartment 101. The refrigerating compartment duct 133 may define at least a portion of the rear wall surface of the refrigerating compartment 101 and may extend upward from a lower end of the refrigerating compartment 101.

A lower end of the refrigerating compartment duct 133 may communicate with a machine room or space provided at or adjacent to the freezing compartment 102 or with an evaporator provided behind the freezing compartment 102. Cold air generated in the evaporator may be supplied to the refrigerating compartment 101 to cool an inside of the refrigerating compartment 101 to a set or predetermined temperature.

A dispenser 60 may be provided at a left or right sidewall surface within the refrigerating compartment 101. The dispenser 60 may be configured to dispense purified water. A position or location of the dispenser 60 may be easily accessible when the refrigerating compartment door 21 is opened.

Fluid or liquid (e.g., water) may be supplied from an external supply source 2 (e.g., a water faucet or water supply line or pipe) and may be purified by passing through a supply valve 71 and a filter 134 before being stored in a tank or container 32 provided in the refrigerating compartment 101. The dispenser 60 may be connected to the tank 32, and liquid may be supplied from the tank 32 to the dispenser 60.

An ice maker 5 configured to make ice may be provided in the freezing compartment 102. The ice maker 5 may be connected to a branch valve 72 connected to an outlet-side of the filter 134, liquid may be supplied to the ice maker 5 after passing through the filter 134.

Figure 3:
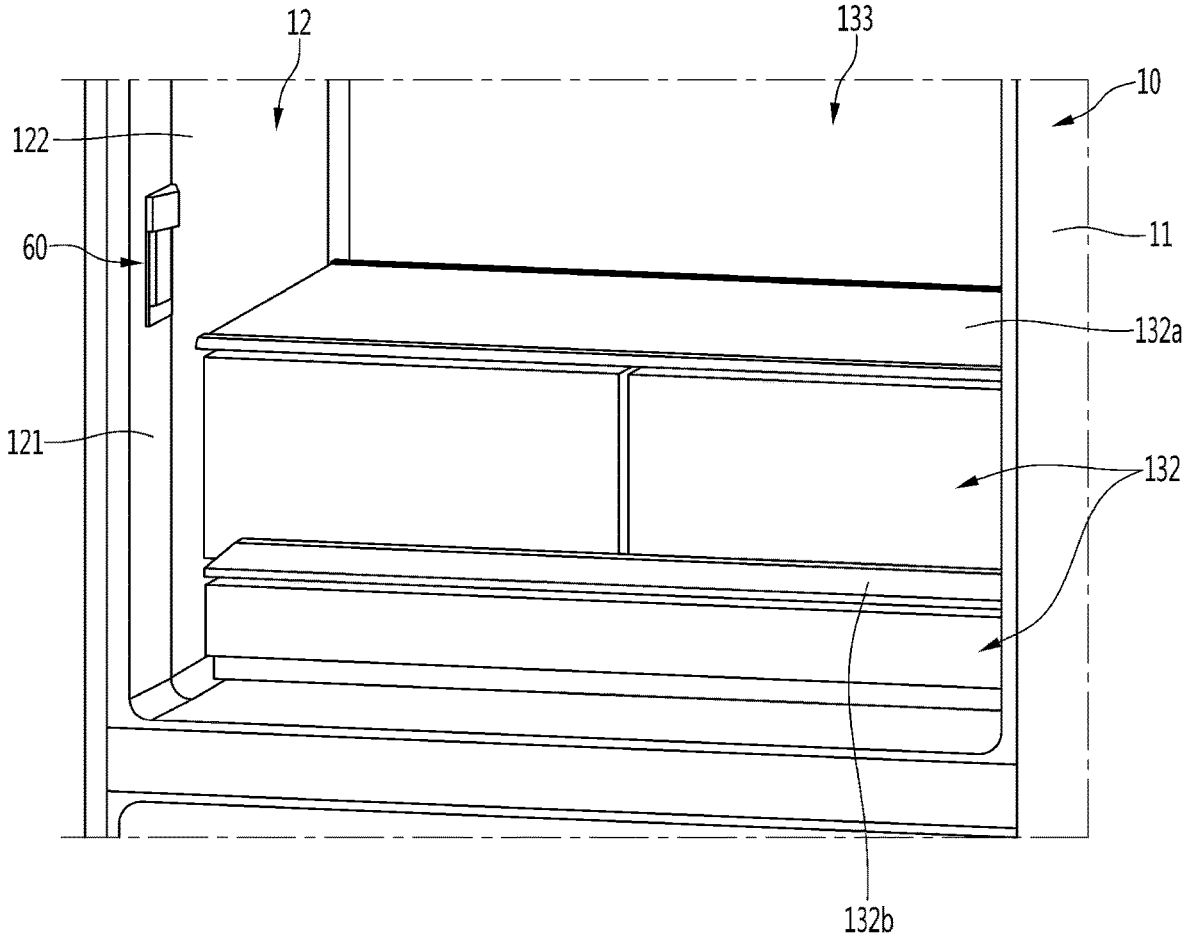
FIG. 3 is a partial perspective view illustrating an inside of a refrigerating compartment according to an embodiment.
Figure 4:
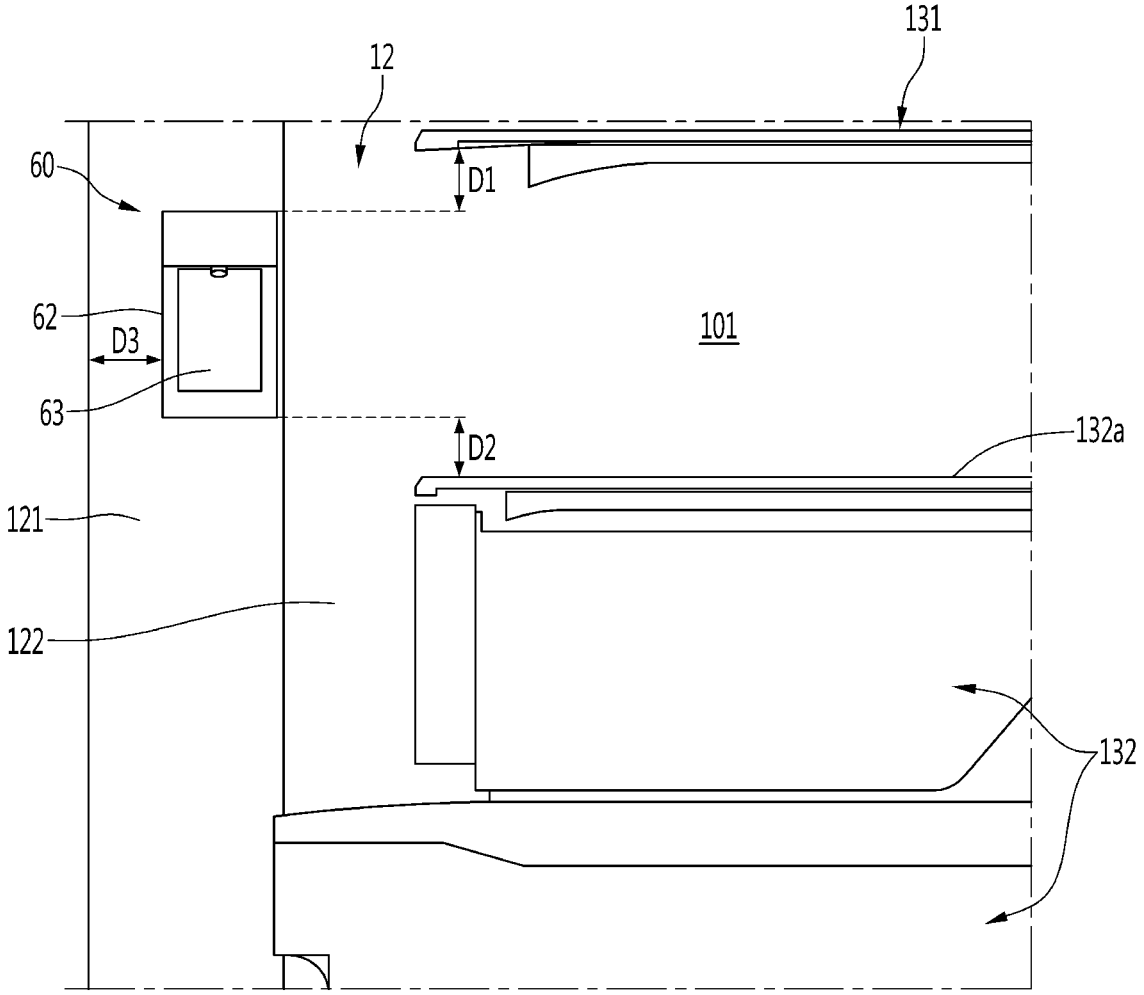
FIG. 4 is a view illustrating an arrangement of a dispenser according to an embodiment.
Figure 5:
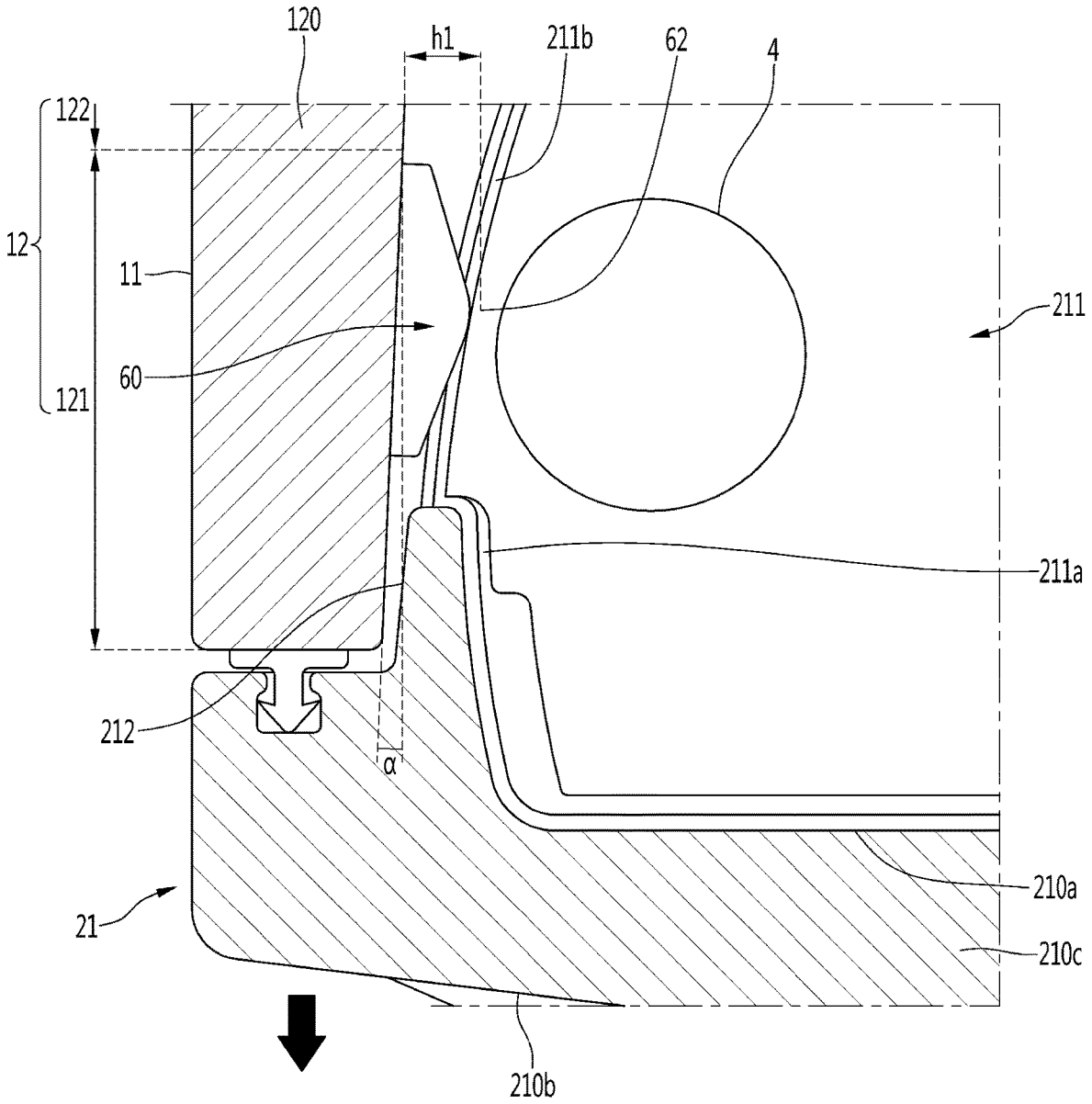
FIG. 5 is a view illustrating an arrangement of the dispenser and a basket in a state in which the door is closed.

Hereinafter, an arrangement of the dispenser 60 will be described in more detail. Referring to FIGS. 3-5, the dispenser 60 may be provided on a wall or sidewall defining a side surface (e.g., a left side surface, as shown in FIG. 3) of the refrigerating compartment 101. The dispenser 60 may be provided at a height corresponding to an approximately intermediate portion or central region of the refrigerating compartment 101. For example, the dispenser 60 may be provided at about 1.2 meters (m) from a ground or floor surface on which the refrigerator 1 is installed. When a user extends his or her hand after opening the refrigerating compartment door 21, the user may naturally access the dispenser 60.

The dispenser 60 may be provided at an inclined portion or surface 121 of a front end or section of the sidewall, improving convenience and access to the dispenser 60 for the user. The inclined surface 121 may be part of an inner or circumferential surface of the inner case 12 defining the inside of the refrigerating compartment 101, and may be provided along an opened front end. The inner surface of the inner case 12 may also include a straight portion or surface 122 extending backward from a rear of the inclined surface 121 in a direction perpendicular to the opened front surface of the refrigerating compartment 101.

The inclined surface 121 may be inclined outward in a front-rear direction to gradually face an outside toward the front, and the straight surface 122 may define a space in the remaining refrigerating compartment 101 behind the inclined surface 121. The straight surface 122 may have facing surfaces that are parallel to each other and may define an area on which the accommodation members such as the shelf 131 and the drawer 132 are provided. The dispenser 60 may be provided on the inclined surface 121 so that the dispenser 60 is provided outside an area on which the accommodation members such as the shelf 131 and the drawer 132 are provided so as not to interfere with food storage.

The dispenser 60 may be mounted on the inclined surface 121 of the inner case 12 and protrude to an inside of the refrigerating compartment 101. The inclined surface 121 may have an inclination to prevent an interference with a door dike 212 (FIG. 5) and a door basket 211 of the refrigerating compartment door 21 when the refrigerating compartment door 21 is opened and closed. The inclined surface 121 may have an inclination that is inclined outward in a front-rear direction. For example, the inclined surface 121 may have a set or predetermined angle $\alpha$ of about 3° to about 7°.

A front side or end of the inclined surface 121 may correspond to a front end of the inner case 12 defining a front opening of the refrigerating compartment 101, and a rear end or side of the inclined surface 121 may be provided behind the door dike 212. As an example, the rear end of the inclined surface 121 may correspond to a rear end or side of the door basket 211, or may alternatively be provided at a front end or side of the door basket 211. The dispenser 60 may be provided on the inclined surface 121 at a position that is more forward than that of the rear end of the door basket 211.

The dispenser 60 may protrude inward from the inclined surface 121 by a set height or thickness h1 to facilitate convenient operation or manipulation of the dispenser 60 to dispense water or liquid from inside the refrigerating compartment 121.

The thickness h1 of the dispenser 60 may be configured so that the dispenser 60 may not block a movement of an outer or circumferential surface 211*b* of the door basket 211. When the refrigerating compartment door 21 is closed, the dispenser 60 may not interfere with an item (e.g., food) 4 provided inside the door basket 211. The door baskets 211 may be provided above and below the dispenser 60 so that dispenser 60 may not interfere with or collide with the door basket 211.

The refrigerating compartment door 21 may include an outer plate or frame 210*b* defining an outer appearance and/or exterior thereof, a door liner 210*a* defining an inner surface thereof, and an insulation material 210*c* between the outer plate 210*b* and the door liner 210*a*. The door dike 212, in which the door basket 211 may be mounted, may be provided at or in the door liner 210*a*. The door dike 212 may protrude backward or rearward from a rear surface of the refrigerating compartment door 21 and may protrude be rounded or curved slightly inward from a side of the refrigerating compartment door 21. The door dike 212 may define a space in which the front end of the door basket 211 may be received. A structure configured to detachably support both side surfaces of the door basket 211 may be formed or braked at left and right sides of an inner surface of the door dike 212.

An outer surface of the door dike 212 may be inclined or curved so as not to interfere with a rotation of the refrigerating compartment door 21. An inclination of the door dike 212 may correspond to that of the inclined surface 121. The outer surface of the door dike 212 may be provided on a same extension line as the outer surface 211*b* of the door basket 211 so as to create a sense of unity. When the refrigerating compartment door 21 is closed, a side surface of the door dike 212 and a side surface of the door basket 211 may face the inclined surface 121.

The dispenser 60 may be provided further backward or rearward than the rear end of the door dike 212 when the refrigerating compartment door 21 is closed. The dispenser 60 may be provided at the rear end of the refrigerating compartment 101 by a set or predetermined distance D3 so as not to interfere with the door dike 212 and may be provided on the inclined surface 121 so as not to interfere with the door basket 211 when the refrigerating compartment door 21 is closed.

The dispenser 60 may be provided at a position corresponding to an area between the plurality of shelves 131 or drawer tables 132*a* and 132*b* provided in the refrigerating compartment 101. Each shelf 131 may be mounted or installed to be inserted into or withdrawn from the refrigerating compartment 101 and may be configured so as not to interfere with the dispenser 60 even during an insertion or withdrawal of the shelf 131. For example, upper and lower ends of the dispenser 60 may be spaced set or predetermined distances D1 and D2 from a bottom surface of the upper shelf 131 and a top surface of the lower shelf 131, respectively. Here, the set distances D1 and D2 may be the same or similar. When the refrigerating compartment door 21 is opened to expose an inside of the refrigerator 1, the dispenser 60 may be provided at a position so as not to overlap or be horizontally aligned with the plurality of shelves 131 to facilitate the insertion and withdrawal of the shelves 131, thereby providing a stable arrangement of the internal components or accommodation members of the refrigerator 1.

The dispenser 60 may have a manipulation member or user interface 63 (e.g., a push-bar or other dispensing button or lever) that is operated by the user to dispense water and a dispenser cover or case 62 to cover internal devices of the dispenser 60. The dispenser 60 may be configured so that exteriors of the manipulation member and the dispenser cover 62 may be exposed to define an outer appearance or exterior of the dispenser 60.

Referring to FIGS. 6-9, a tank or storage assembly 30 to store and supply purified water to the dispenser 60 may be provided in the refrigerating compartment 101. The refrigerating compartment duct 133 may be provided on an inner rear surface of the refrigerating compartment 101. The refrigerating compartment duct 133 may include an upper portion or section 133*a* and a lower portion or section 133*b*.

A reference height at which the upper portion 133*a* and the lower portion 133*b* are divided may correspond to a top surface of the drawer 132. The upper portion 133*a* may be provided above the drawer 132 and may define an exposed rear wall surface of the refrigerating compartment 101. For example, the upper portion 133*a* may define the entire rear wall surface of the refrigerating compartment 101, which is exposed above the drawer 132, and may be called a grill pan. A shelf rail may be provided at a center of the upper portion 133*a* to allow the shelf 131 to be detachably mounted. For example, the shelf rail may include holes or grooves in which protrusions of the shelves 131 may be fitted.

Figure 6:
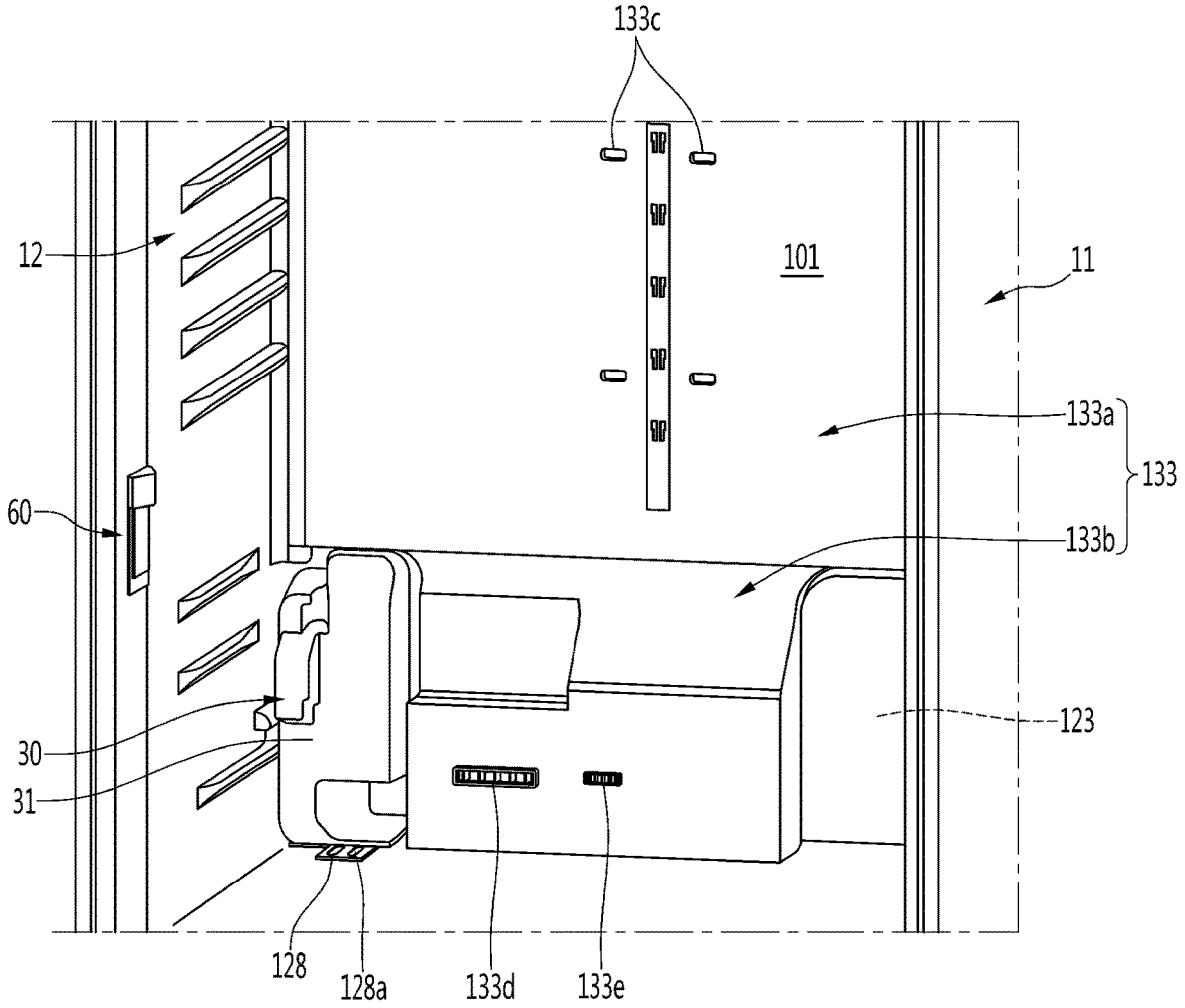
FIG. 6 is a partial perspective view illustrating a structure of a rear wall surface of the refrigerating compartment.
Figure 7:
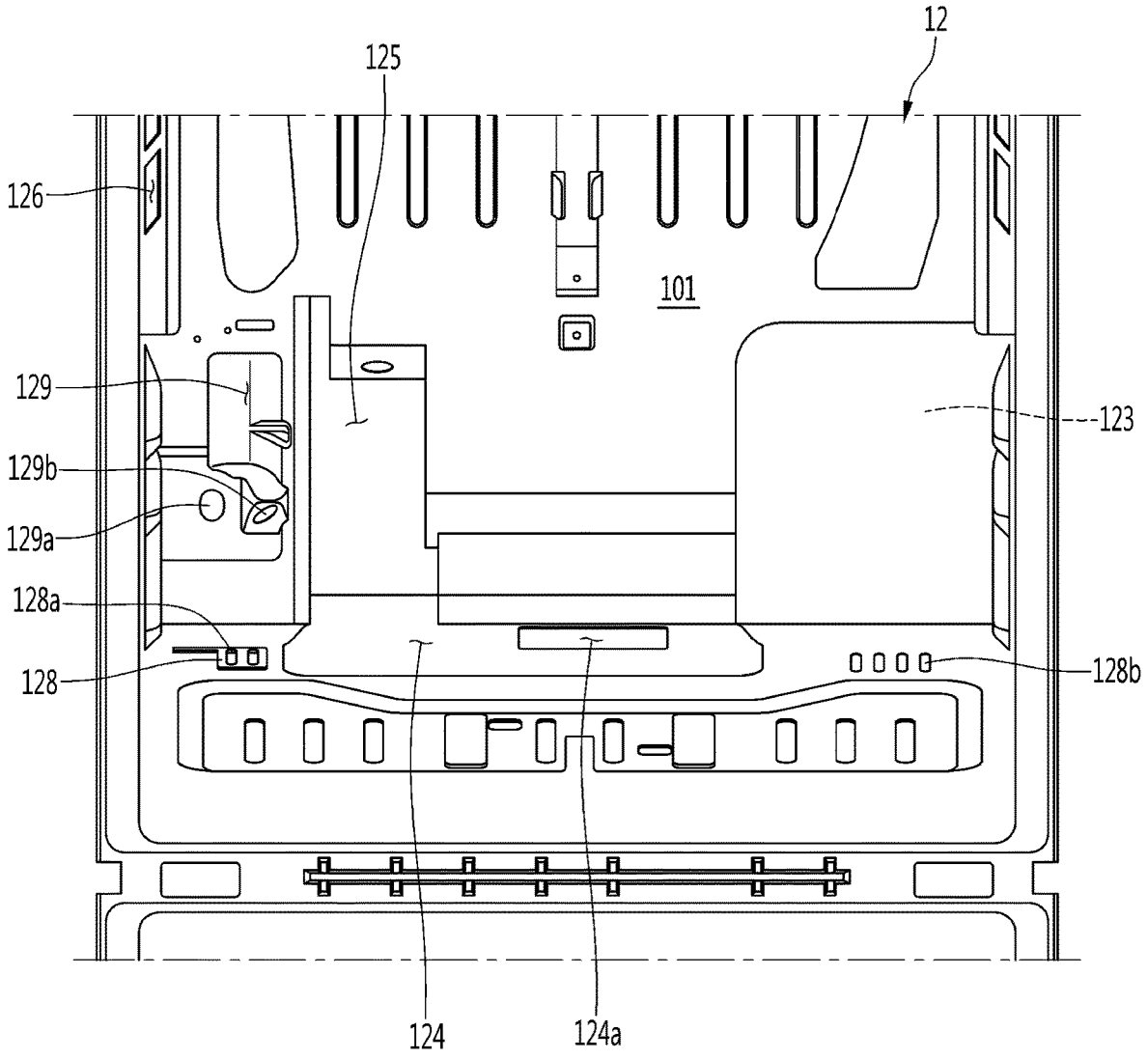
FIG. 7 is a partial perspective view illustrating a portion of an inner case in the refrigerating compartment according to an embodiment.

At least one cold air discharge hole 133*c* through which cold air is discharged may be formed in the upper portion 133*a*. As shown in FIG. 6, there may be at least one pair of cold air discharge holes 133*c* where on cold air discharge hole 133*c* of the pair is provided at a left side of the shelf rail, and the other cold air discharge hole 133*c* of the pair is provided at a right side of the shelf rail.

The lower portion 133*b* may extend downward from a lower end of the upper portion 133*a* and may at least partially define a lower portion of the rear surface of the refrigerating compartment 101. The lower portion 133*b* may be provided behind the drawer 132 and be covered by the drawer 132 so as not to be exposed even when the refrigerating compartment door 21 is opened.

The lower portion 133*b* may communicate with a cold air supply hole 124*a* defined in a center of the bottom surface of the inner case 12. Cold air generated in the evaporator may flow upward to the lower portion 133*b* of the duct 133 through the cold air supply hole 124*a* and then be guided to the cold air discharge hole 133*c* of the upper portion 133*a* of the duct 133 to be discharged into the refrigerating compartment 101.

The lower portion 133*b* may be provided at a left-right center of the refrigerating compartment 101, and the tank assembly 30 and a PCB accommodation portion or recess 123 may be provided at right and left sides, respectively, of the lower portion 133*b* of the duct 133. The lower portion of the refrigerating compartment 101 may be filled by the tank assembly 30, the lower portion 133*b* of the duct 133, and the PB accommodation portion 123, which may all be provided in a space behind the drawer 132 (or alternatively, at a side of the drawer 132).

A duct mounting portion or recess 125 in which the lower portion 133*b* of the duct 133 is received or mounted may be provided on the lower portion of the rear surface of the inner case 12. The duct mounting portion 125 may be recessed in a shape corresponding to that of the rear surface of the lower portion 133*b* of the duct 133 and may be configured to receive wires of electronic or other components of the lower portion 133*b* (e.g., insulation material 120, a temperature sensor 133*d*, and a humidity sensor 133*e*). A dispenser opening 126 at which the dispenser 60 may be mounted may be formed in the inner case 12, and will be described in more detail later.

The PCB accommodation portion 123 may be recessed so that a main printed circuit board (PCB) to control an operation of the refrigerator 1 is provided on an outer surface of the inner case 12. The PCB accommodation portion 124 may protrude forward from the rear surface of the inner case 12 when viewed from an inside of the refrigerating compartment 101. The PCB accommodation portion 123 may be provided between one side (e.g., right side) of the lower portion 133*b* of the duct 133 and the sidewall of the refrigerating compartment 101, and may be provided so as not to protrude farther inward than the lower portion 133*b* of the duct 133 so as to appear recessed when compared to the lower portion 133*b* of the duct 133.

The tank assembly 30 may be provided between the other side (e.g., left side) of the lower portion 133*b* and the sidewall of the refrigerating compartment 101. The tank assembly 30 may be configured so that water or liquid purified through the filter 134 is introduced, stored, and cooled before being supplied to the dispenser 60. The tank assembly 30 may store a predetermined amount of liquid or water or more so that water or liquid is available to be dispensed to the dispenser 60.

The tank assembly 30 may include the tank 32 in which liquid or water passing through the filter 134 is stored, a dispenser valve 33 to control water supply from the tank 32 to the dispenser 60, and a tank cover or case 31 in which the tank 32 and the dispenser valve 33 is provided. The tank cover 31 may be fixed to or mounted on the inner case 12 so that the tank assembly 30 is provided inside the refrigerating compartment 101.

Figure 8:
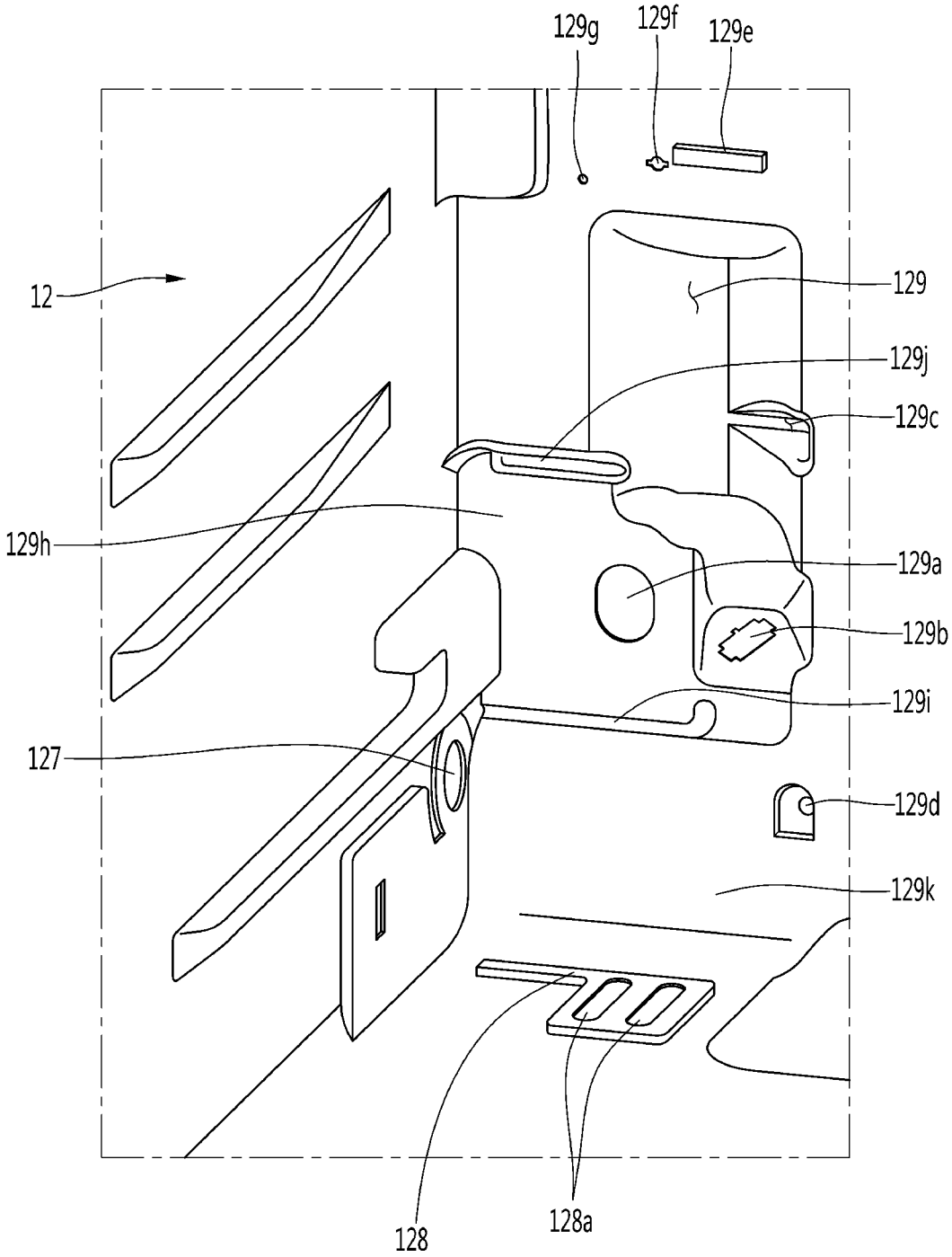
FIG. 8 is a partial perspective view illustrating an edge of the inner case in which a water tank assembly is provided according to an embodiment.
Figure 9:
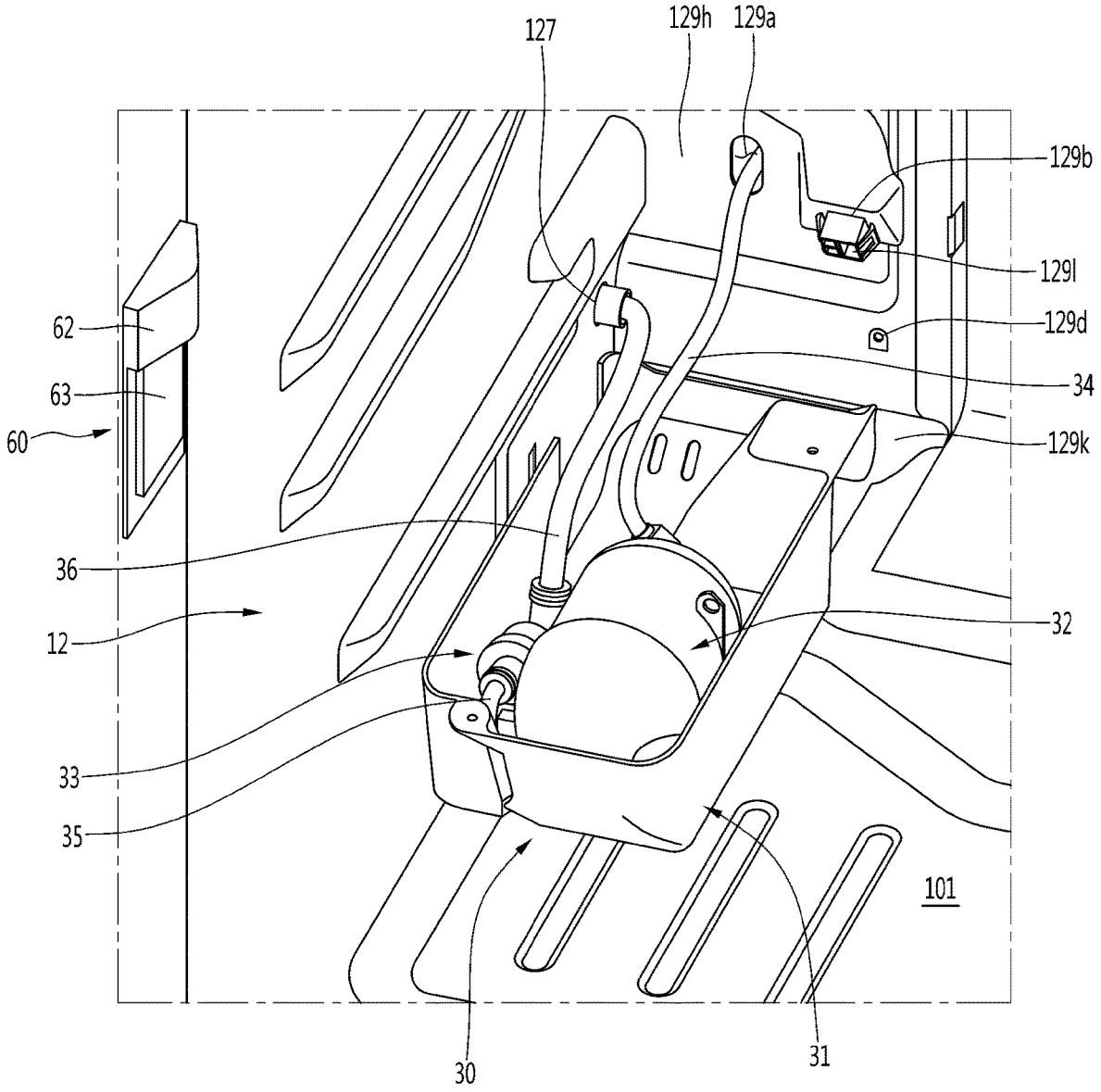
FIG. 9 is a view illustrating a state before the water tank assembly is assembled with the inner case.
Figure 10:
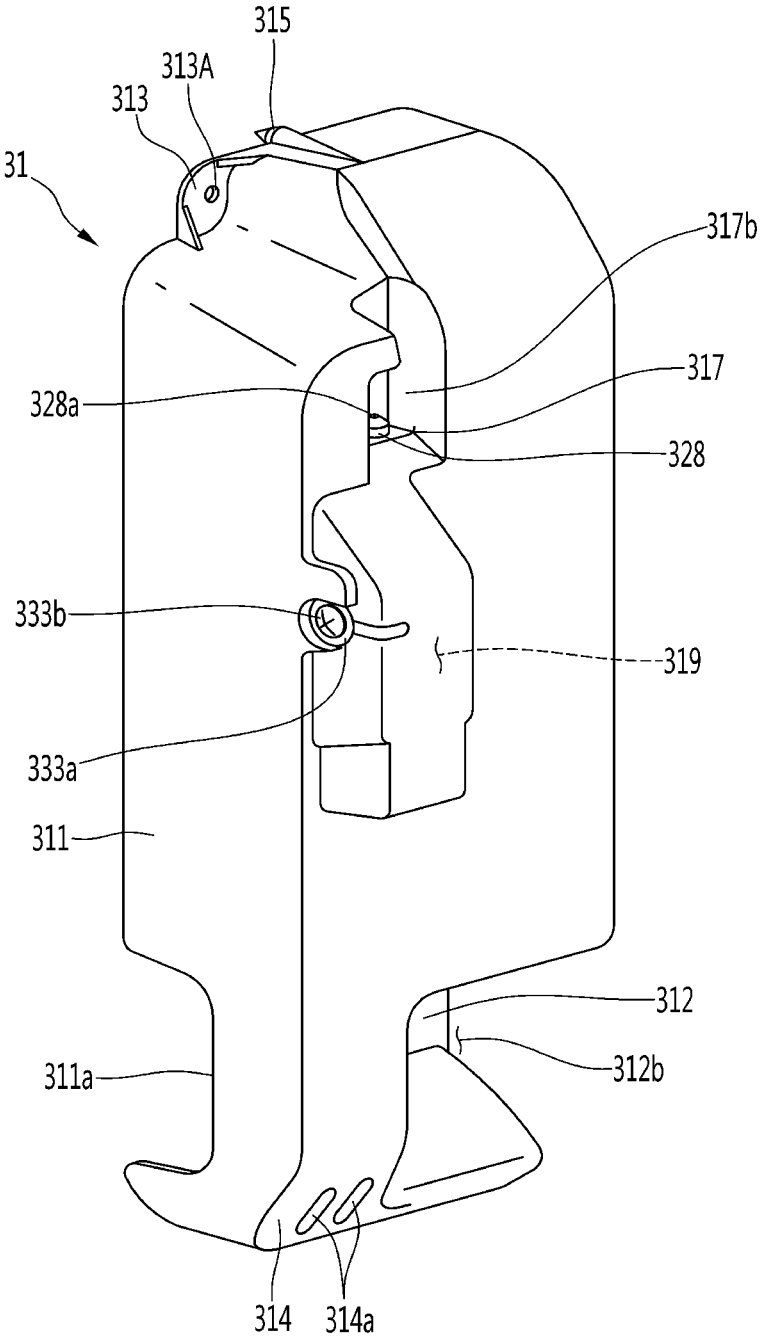
FIG. 10 is a perspective view of the water tank assembly when viewed from a front side.

As illustrated in FIGS. 8 and 9, the tank assembly 30 may be configured so that the tank cover 31 is coupled to or mounted on the inner case 12, and the tank 32 and the dispenser valve 33 are fixed to the tank cover 31.

The tank assembly 30 may be provided at an edge or corner defined by the bottom surface, the rear surface, and one side surface of the refrigerating compartment 101. Holes 127 and 129*a* through which tubes or pipes 34, 35, and 36 described later pass may be defined in surfaces (e.g., the rear surface and the one side surface) of the inner case 12. The holes 127 and 129*a* may be configured to be covered by the tank cover 31.

The tube 34 may be a supply tube or pipe 34 connecting the filter 134 to the tank 32 and may pass through the rear surface of the inner case 12. The hole 129*a* may be a rear opening 129*a* through which the tube 34 is accessible and may be defined in the rear surface of the inner case 12. The tube 34 may be introduced into the refrigerating compartment 101 through the rear opening 129*a* and be connected to the tank 32 inside the tank cover 31.

The tube 36 may be a discharge tube or pipe 36 connecting the dispenser valve 33 to the dispenser 60 and may pass through the side surface (e.g., left side surface) of the inner case 12. The hole 127 may be a side opening 127 through which the discharge tube 36 is accessible and may be defined in the side surface of the inner case 12. The discharge tube 36 may be introduced into the refrigerating compartment 101 through the side opening 127 and be connected to the dispenser valve 33.

The tube 35 may be a connector tube or pipe connecting the dispenser valve 33 to the tank 32 and will be described in more detail later. The connector tube 35 may be provided in the tank cover 31.

Figure 11:
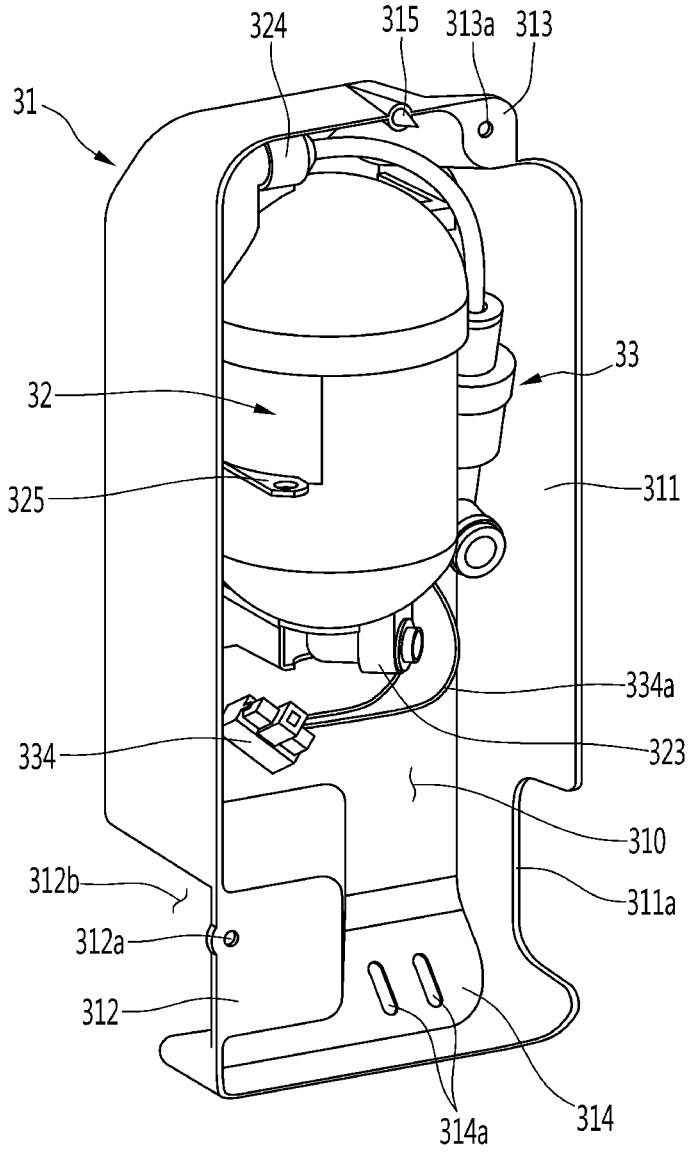
FIG. 11 is a perspective view of the water tank assembly when viewed from a rear side.

A connector mounting portion or recess 129*b* may be provided on the rear surface of the inner case 12. The connector mounting portion 129*b* may be provided on one side of the rear surface of the inner case 12 which is covered by the tank cover 31. A cabinet-side connector 1291 may be provided or mounted at the connector mounting portion 129*b* and be configured to connect to an electric wire inside the cabinet 10. The connector mounting portion 129*b* may protrude forward and may be configured to have a predetermined angle to facilitate coupling with a valve-side connector 334 connected to a wire 334*a* of the dispenser valve 33 (FIG. 11).

Thus, all the tubes 34, 35, 36 and the wire 334*a*, which are connected to the tank assembly 30, may be at least partially provided at an area where the tank cover 31 is mounted and may be easily connected to the tank assembly 30. When the tank assembly 30 is assembled in a modular state and provided on the inner edge of the refrigerating compartment 101, the supply tube 34 may pass through the rear opening 129*a*, and the discharge tube 36 may pass through the side opening 127 so that the cabinet-side connector 1291 and the valve-side connector 334 may be quickly and easily connected to each other. When the tank assembly 30 is mounted, the tubes 34, 35, and 36 and the wire 334*a*, in addition to the rear opening 129*a*, the side opening 127, and the connector mounting portion 129*b*, may be covered.

A tank seating portion or recess 129 may be recessed rearward from the rear surface of the inner case 12. The tank seating portion 129 may be recessed in a shape corresponding so that of a portion of the outer surface or contour of the tank 32. A rib insertion portion or groove 129*c* may be further provided at one side (e.g., right side) of the tank seating portion 129. A first tank support rib or tab 325 protruding from the outer surface of the tank 32 (FIG. 11) may be inserted into the rib insertion portion 129*c* so as to secure the tank 32, which may be cylindrical or rounded, within the tank seating portion 129.

A rear guide mounting portion or recess 129*h* at which a rear guide 41 (FIG. 15) described later is mounted may be provided at a side (e.g., left side) of the inner case 12 corresponding to an inlet portion or inlet 323 of the tank 32. The rear guide mounting portion 129*h* may be provided in a flat shape to provide a surface on which one surface of the rear guide 41 may contact. The rear opening 129*a* may be defined in a center (or alternatively, a right side) of the rear guide mounting portion 129*h*. The rear opening 129*a* may communicate with a guide hole or passage 440 (FIG. 16) defined in the rear guide mounting portion 129*h*, and the supply tube 34 may sequentially passes through the rear opening 129*a* and the guide hole 440 so as to be guided up to an outside of the cabinet 10.

An upper end groove 129*j* and a lower end groove 129*i* may be defined in upper and lower ends of the rear guide mounting portion 129*h* to facilitate placement of upper and lower ends of the rear guide 41 when mounted on the rear guide mounting portion 129*h*. The upper end groove 129*j* and the lower end groove 129*i* may be recessed when viewed from the inside of the inner case 12 and may protrude when viewed from the outside of the inner case 12. The upper end groove 129*j* and the lower end groove 129*i* may restrict the upper and lower ends of the rear guide 41 to maintain a position of the rear guide 41 in the rear guide mounting portion 129*h* and prevent separation. The rear guide 41 may be secured even during a process of filling a foaming solution to mold the insulation material 120 between the inner case 12 and the outer case 11.

An upper restriction portion or protrusion 129*e* may protrude from the rear surface of the inner case 12 at a position corresponding to an upper end of the tank cover 31. The upper restriction portion 129*e* may protrude forward and may contact the upper end of the tank cover 31 when the tank cover 31 is mounted to restrict vertical movement of the tank cover 31.

A bottom surface support portion or projection 129*k* may be provided on the bottom surface of the inner case 12 at a position corresponding to the bottom surface of the tank cover 31. The bottom surface support portion 129*k* may be protrude from the rear surface of the inner case 12 to extend toward a front lower end of the tank cover 31 to contact and support a bottom surface of the tank cover 31.

A lower end restriction portion or bottom protrusion 128 may be provided at a front end of the bottom surface support portion 129*k*. The lower end restriction portion 128 may protrude upward toward the front end of the bottom surface of the tank cover 31 to contact the front end of the tank cover 31 when the tank cover 31 is mounted, thereby restricting forward and backward movement of the tank cover 31.

A cold air collection hole 128*a* through which internal air of the refrigerating compartment 101 returns to the evaporator may be formed in a protruding top surface of the lower end restriction portion 128. As the cold air collection hole 128*a* is raised, water or liquid may not flow into the cold air collection hole 128*a* toward the evaporator even the tank 32 leaks. There may be a pair of cold air collection holes 128*b* formed in the lower end restriction portion 128. Another cold air collection hole 128*b* or set thereof may be further defined in another side of the bottom surface of the inner case 12 opposite to the formation position of the cold air collection hole 128*a*.

A temporary fixing hole 129*f* may be defined at one side (e.g., left side) of the upper end restriction portion 129*e*. A temporary fixing protrusion 315 (FIG. 11) protruding backward from the upper end of the tank cover 31 may be inserted in the temporary fixing hole 129*f*. The temporary fixing hole 129*f* may have a size configured such that the temporary fixing protrusion 315 may be press-fitted within the temporary fixing hole 129*f*, and the tank 32 may be maintained in a fixed and/or secured state when the temporary fixing protrusion 315 is inserted into the temporary fixing hole 129*f*.

Figure 12:
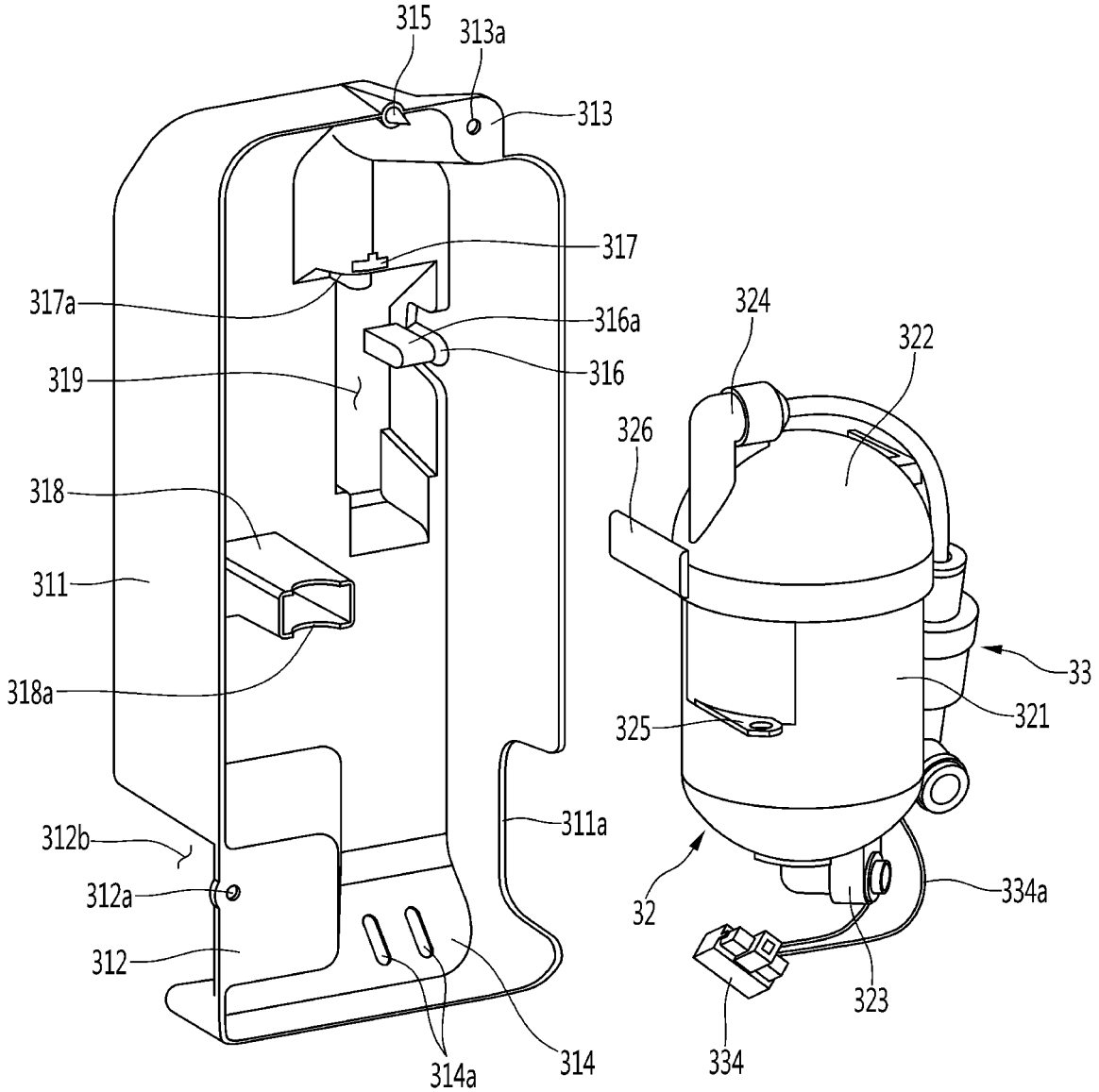
FIG. 12 is an exploded perspective view illustrating a state in which the water tank assembly is disassembled when viewed from one side.
Figure 13:
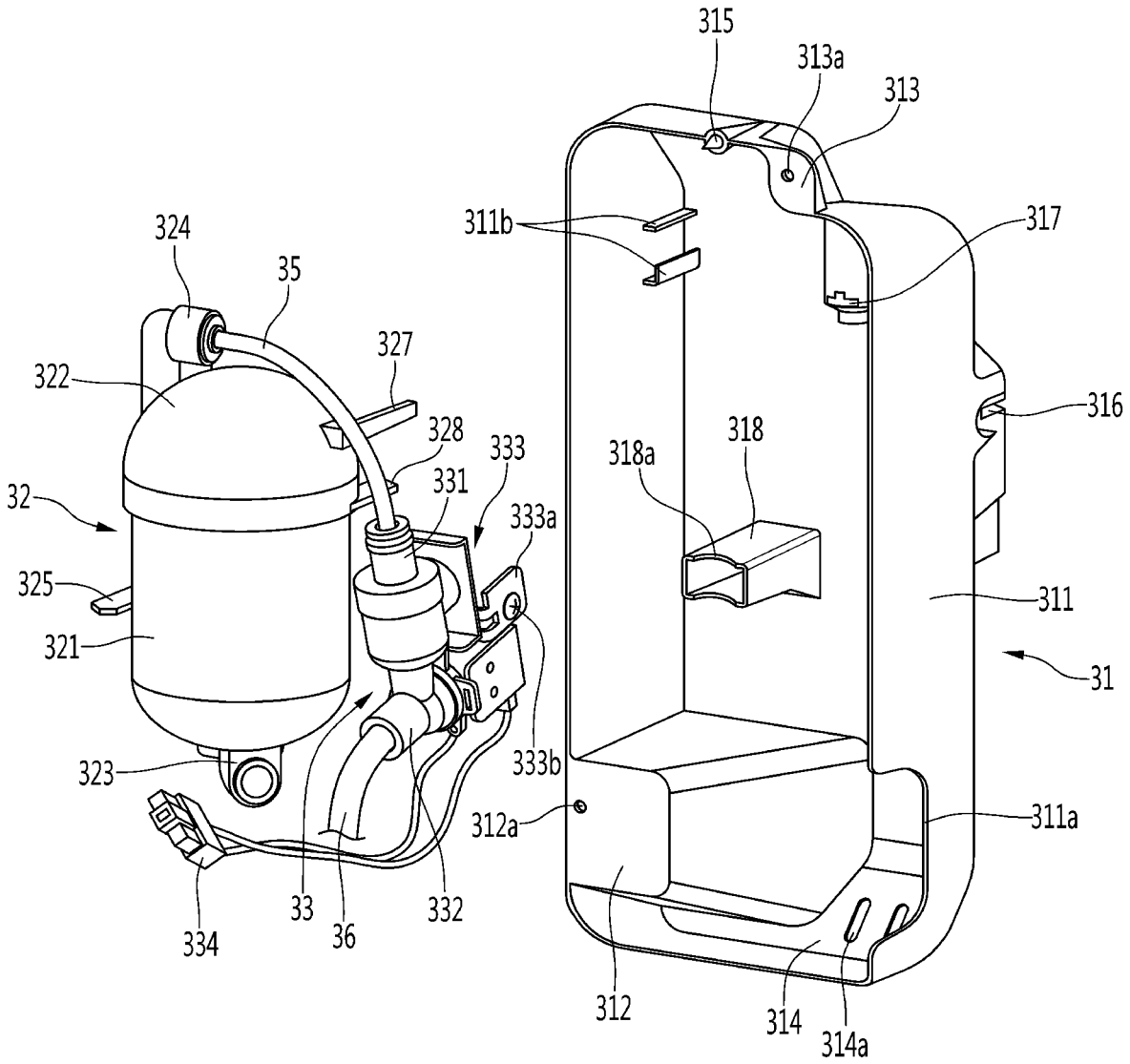
FIG. 13 is an exploded perspective view illustrating a state in which the water tank assembly is disassembled when viewed from the other side.
Figure 14:
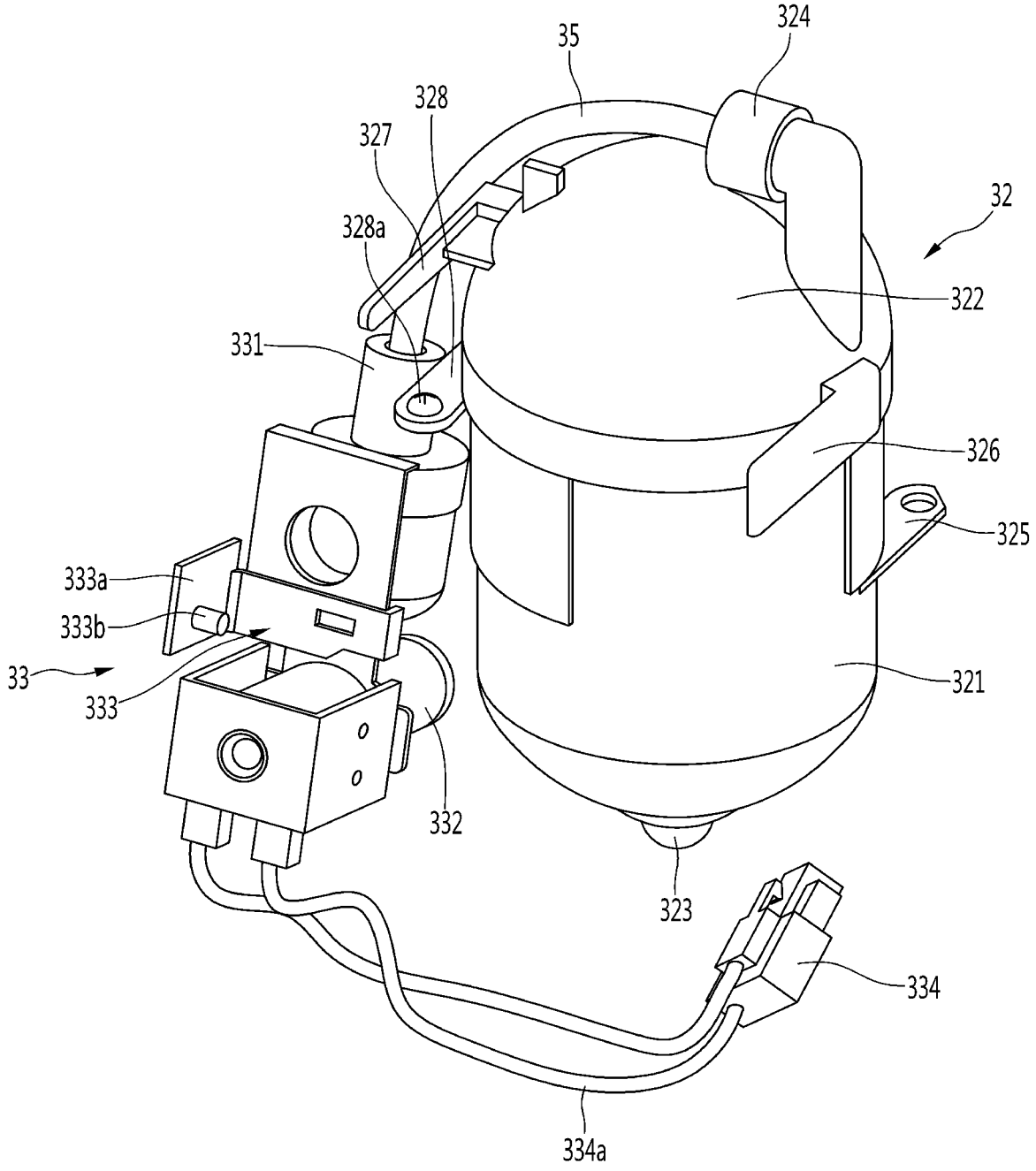
FIG. 14 is a perspective view illustrating a state in which a water tank that is one component of the water tank assembly is connected to a dispenser valve.

A first coupling hole 129*g* and a second coupling hole 129*d* may be provided in the rear surface of the inner case 12 to completely fix the tank cover 31 to the inner case 12 via a screw, bolt, pin, etc. A screw may pass through a first screw hole 313*a* (FIG. 111) and the first coupling hole 129*g*, and a screw may pass through a second screw hole 312*a* (FIG. 12) of the tank cover 31 and the second coupling hole 129*d* to fix the tank cover 31 to the inner case 21.

To assemble the tank assembly 30, the tank 32 and the dispenser valve 33 may be mounted on the tank cover 31. When a connection of the supply tube 34 and the discharge tube 36 to the tank 32 and the dispenser valve 33, respectively, is completed, the tank cover 31 may be maintained at a predetermined or preset position by the upper end restriction portion 129*e* and the lower end restriction portion 128. In a temporarily fixed state in which the temporary fixing protrusion 315 is inserted into the temporary fixing hole 129*f*, a screw may be inserted through the first coupling hole 129*g* and a screw may be inserted through the second coupling hole 129*d* to complete the assembly of the water tank 30.

Referring to FIGS. 10-14, the tank assembly 30 may be configured so that the tank 32 and the dispenser valve 33 are provided in the tank cover 31 and connected to each of other. The tank cover 31 may be configured to be fixed to and mounted on the inner case 12 in a state in which the tank 32 and the dispenser valve 33 are mounted, and the supply tube 34 and the discharge tube 36 may be connected to each other. The tank cover 31 may be injection-molded using a plastic material, and a rear surface of the tank cover 31 may be opened or have a rear opening to allow access to an accommodation space 310 in which the tank 32 and the dispenser valve 33 are received.

The temporary fixing protrusion 315 may be provided on an upper end of an upper sidewall of the tank cover 31 to protrude above the rear opening of the tank cover 31. The temporary fixing protrusion 315 may extend backward and be provided to be narrower in diameter in a backward direction so that the temporary fixing protrusion 315 may be press-fitted into the temporary fixing hole 129*f* to temporarily fix the tank cover 31. The temporary fixing protrusion 315 may have, for example, a cone shape.

An upper end fixing portion or protrusion 313 protruding outward may be provided on an upper end of the tank cover 31 above the rear opening. The first screw hole 313*a* may be defined in the upper fixing portion 313. A cover recess portion or cavity 312*b* recessed backward may be defined in the lower front surface of the tank cover 31, and a lower fixing portion or section 312 may be provided at a bottom of the cover recess portion 312*b*. The lower fixing portion 312 may be provided at a rear surface of the tank cover 31 adjacent to a bottom of the rear opening, and the second screw hole 312*a* may be defined in the lower fixing portion 312.

A tube groove 311*a* may be defined at a side of a cover circumferential or outer surface 311. The tube groove 311*a* may be configured to prevent an interference or collision of the discharge tube 36 and the cover outer surface 311 when the discharge tube 26 is passing through the side opening 127 of the inner case 12 and when the tank cover 31 is mounted on the inner case 12. The tube groove 311*a* may be provided at a lower side surface of the tank cover 31. The tube groove 311*a* may be recessed inward from an end of the cover outer surface 311.

The lower fixing portion 312 and the cover recess portion 312*b* may be provided on the cover outer surface 311 facing the tube groove 311*a*. The bottom surface of the tank cover 31 may be provided below the tube groove 311*a* and the lower fixing portion 312, and the bottom surface support portion 129*k* may protrude forward.

A lower inclined surface 314 may be provided between the bottom surface and the front surface of the tank cover 31. At least one inclined opening or slot 314*a* may be defined in the lower inclined surface 314. Cold air may be introduced into and discharged from the tank cover 31 via the inclined opening 314*a*, and when liquid or water droplets are formed on or flow along the inner surface of the tank cover 31, the water droplets may be discharged to the outside of the tank cover 31 through the inclined opening 314*a*. There may be two inclined openings 314*a* formed in the lower inclined surface 314.

A tank supporter 318 may be provided inside the tank cover 31. The tank supporter 318 may protrude backward from an inner front surface of the tank cover 31 and may support the inlet portion 323 provided on a lower end of the tank cover 31. A inlet portion support groove 318*a* may be defined in an end of the tank supporter 318 so that an end of the inlet portion 323 may be provided at an angle at which the supply tube 34 is easily connected. Front and rear surfaces of the tank support 318 that define the inlet portion support groove 318*a* may have inclined or rounded portions. When the tank 32 is mounted, the inlet portion 323 may be naturally guided toward a specific or predetermined direction.

A pair of rib guides 311*b* may be provided at one side of an inner surface of the tank cover 32. The rib guides 311*b* may be provided in a pair that are spaced apart from each other so that a second tank support rib or tab 326 extending from the tank 32 may be inserted between the rib guides 311*b*.

A valve accommodation space 319 in which the dispenser valve 33 is received may be defined inside the tank cover 31. The valve accommodation space 319 may be defined to be further recessed from the tank accommodation space 310. At least a portion of the dispenser valve 33 may be provided inside the valve accommodation space 319.

A valve mounting protrusion 316*a* may be provided inside the valve accommodation space 319. The valve mounting protrusion 316*a* may be spaced apart from the cover outer surface 311, and a portion of a valve bracket 333 to mount the dispenser valve 33 may be inserted between the valve mounting protrusion 316*a* and the cover outer surface 311. A distance between the valve mounting protrusion 316*a* and the cover outer surface 311 may correspond to a thickness of the valve bracket 333.

A valve bracket coupling hole 316 may be defined in the cover outer surface 311 to face the valve mounting protrusion 316*a*. When a screw 333*b* is coupled through the valve bracket coupling hole 316 when the valve bracket 333 is inserted between the valve mounting protrusion 316*a* and the cover outer surface 311, the screw 333*b* may pass through the valve bracket coupling hole 316 and the valve bracket 333 to be coupled to the valve mounting protrusion 316*a*, allowing the valve bracket 333 to be fixed to the tank cover 31. The bracket coupling hole 316 may be exposed to the side surface of the tank cover 31 to facilitate insertion and coupling of the screw 333*b*.

A tank coupling space 317*b* may be defined in an upper end of the valve accommodation space 319. The tank coupling space 317*b* may be recessed from the front surface of the tank cover 31. A bottom surface of the tank coupling space 317*b* may be called a tank fixing portion or space or a top surface or space of the valve accommodation space 319. A tank bracket coupling hole 317 to which a screw 328*a* is coupled may be defined in a bottom surface of the tank coupling space 317*b*. The tank coupling space 317*b* may be opened forward and upward to secure a space for the coupling of the screw 328*a*.

A tank mounting protrusion 317*a* may be provided at an upper portion of the valve accommodation space 319, and the tank mounting protrusion 317*a* may be spaced a thickness of the tank bracket 328 from the bottom surface of the tank coupling space 317*b*. The tank bracket 328 may be inserted between the tank mounting protrusion 317*a* and the tank fixing portion, i.e., the bottom of the tank coupling space 317*b*, and the screw 328*a* may be inserted into the tank bracket coupling hole 317 so that the tank bracket 328 is fixed to the tank cover 31.

The tank 32 and the dispenser valve 33 may be fixed to the tank cover 31 through the screws 328*a* and 333*b* coupled from the outside. The tank 32 may have an approximately cylindrical or bullet shape having top and bottom surfaces, each of which has a hemispherical shape. The tank 32 may be provided by coupling an upper part or section 322 defining an upper portion thereof and a lower part or section 321 defining a lower portion thereof. The upper part 322 may be provided in a hemispherical or cap shape with an opened bottom surface, and the lower part 321 may extend vertically downward along a circumference of the upper part 322. A bottom surface of the lower part 321 may be provided or rounded in a hemispherical shape. An outer appearance of the tank 32 may be provided by coupling a lower end of the upper part 322 to an upper end of the lower part 321. The tank 32 may have a volume configured to hold or store a first predetermined or preset amount of liquid or water such that a second predetermined or preset amount of water may be dispensed through the dispenser 60 at least several times before the tank 32 needs to be refilled.

The inlet portion 323 may be provided at a bottom center, which may protrude, of the lower part 321. The inlet portion 323 may be bent laterally after protruding downward and be configured to be seated on the tank supporter 318. The inlet portion 323 may be aligned with the tank supporter 318 to face the rear opening 129*a* so that the supply tube 34 may be easily connected. An end portion of the inlet portion 323 may be provided in a fitting structure so that the supply tube 34 is inserted.

The first tank support rib 325 may extend backward from one side of an circumferential surface of the lower part 321. The first tank support rib 325 may contact the rear surface of the inner case 12 when the tank assembly 30 is mounted on the inner case 12 to stably support the tank 32.

The second tank support rib 326 and a third tank support rib or tab 327, which may extend forward, may be provided at left and right sides, respectively, of a circumferential surface of the upper part 322. The second tank support rib 326 and the third tank support rib 327 may extend to contact the inner front surface of the tank cover 31. When the tank 32 is mounted on the tank cover 31, the tank 32 may be stably supported and be maintained at a fixed or predetermined position, and slipping due to a round shape of the tank 32 may be reduced or prevented.

The second tank support rib 326 may be inserted into the rib guide 311*b* provided at a corresponding position of the tank cover 31. The tank 32 may be provided at the fixed position inside the tank cover 31, and a screw coupling to secure the tank 32 may be easily performed.

The tank bracket 328 may be provided on a side (e.g., right side in FIG. 13) of a circumferential surface of the upper part 322 so that the tank 32 may be fixed to the tank cover 31. The tank bracket 328 may be integrated with the upper part 322 and may be provided in a plate shape to extend toward the tank cover 31. Alternatively, the tank bracket 328 may be provided separately and then later coupled to the upper part 322. The tank bracket 328 may be inserted between the tank mounting protrusion 317*a* and the bottom of the tank coupling space 317*b* and then be coupled to the tank cover 31 by the coupling of the screw 328*a*.

The tank 32 may be stably supported by the tank cover 31 by the second tank support rib 326 and the third tank support rib 327. The tank 32 may be coupled to the tank cover 31 by using one screw 328*a* to allow the tank 32 to be stably mounted inside the tank cover 31.

An outlet portion or outlet 324 may be provided in the upper part 322. The outlet portion 324 may extend upward from a side (e.g., left side) of the upper part 322 of the tank cover 31 and be bent in a direction toward the dispenser valve 33 over a portion of the top surface of the upper part 322. The outlet portion 324 may be configured to have a fitting structure, and the connection tube 35 connecting the tank 32 to the dispenser valve 33 may be inserted into and fixed to the outlet portion 324.

The dispenser valve 33 may be configured to selectively supply the water or liquid stored in the tank 32 to the dispenser 60 and may be provided as an electronic valve such as a solenoid valve. When the user manipulates or operates the manipulation member 63, the dispenser valve 33 may be turned on and/or off to provide a signal to determine the supply of water to the dispenser 60. The dispenser valve 33 may be connected to a pump or may be integrally provided.

The dispenser valve 33 may include a valve inlet 331 connected to the connection tube 35 and a valve outlet 332 connected to the discharge tube 36 connected to the dispenser 60. The valve inlet 331 and the valve outlet 332 may have fitting structures and may be configured to insertably couple with the connection tube 35 and the discharge tube 36.

A valve-side connector 334 may be provided at an end of the wire 334*a*. The valve-side connector 334 may enable power supply and signal transmission for an operation of the dispenser valve 33 through a simple connection operation with the cabinet-side connector 1291.

The valve bracket 333 may be provided at a side of the dispenser valve 33. The valve bracket 333 may be provided in a metal plate shape and may have a first side coupled to the dispenser valve 33 and a second side opposite to the first side bent and extending toward the tank cover 31 to provide a bracket coupling portion 333*a*. The bracket coupling portion 333*a* may be inserted between the valve mounting protrusion 316*a* and the cover outer surface 311, and the dispenser valve 33 may be fixed to and mounted on the tank cover 31 through a coupling of the screw 333*b*.

Figure 15:
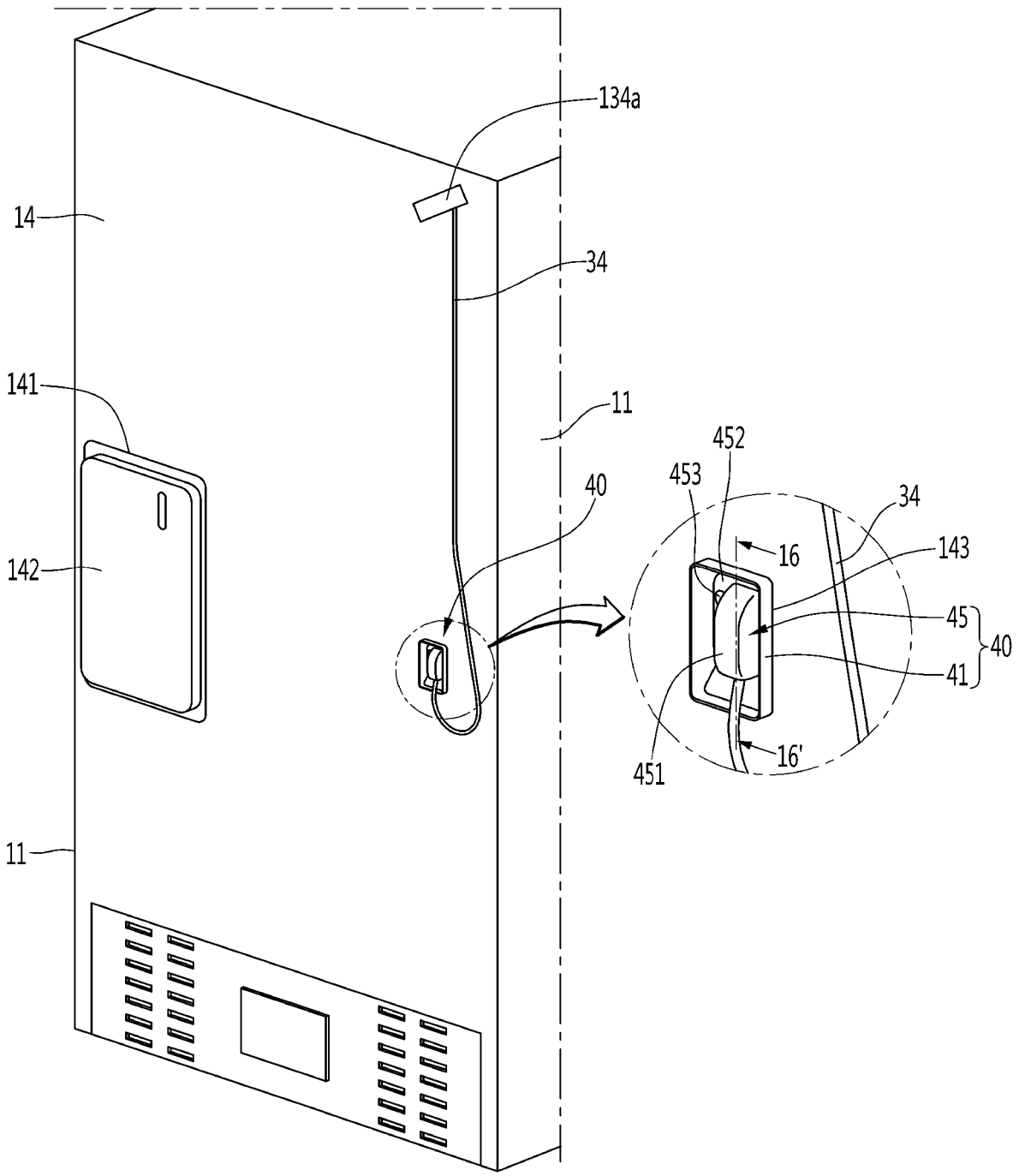
FIG. 15 is a partial perspective view illustrating a rear surface of the refrigerator.
Figure 16:
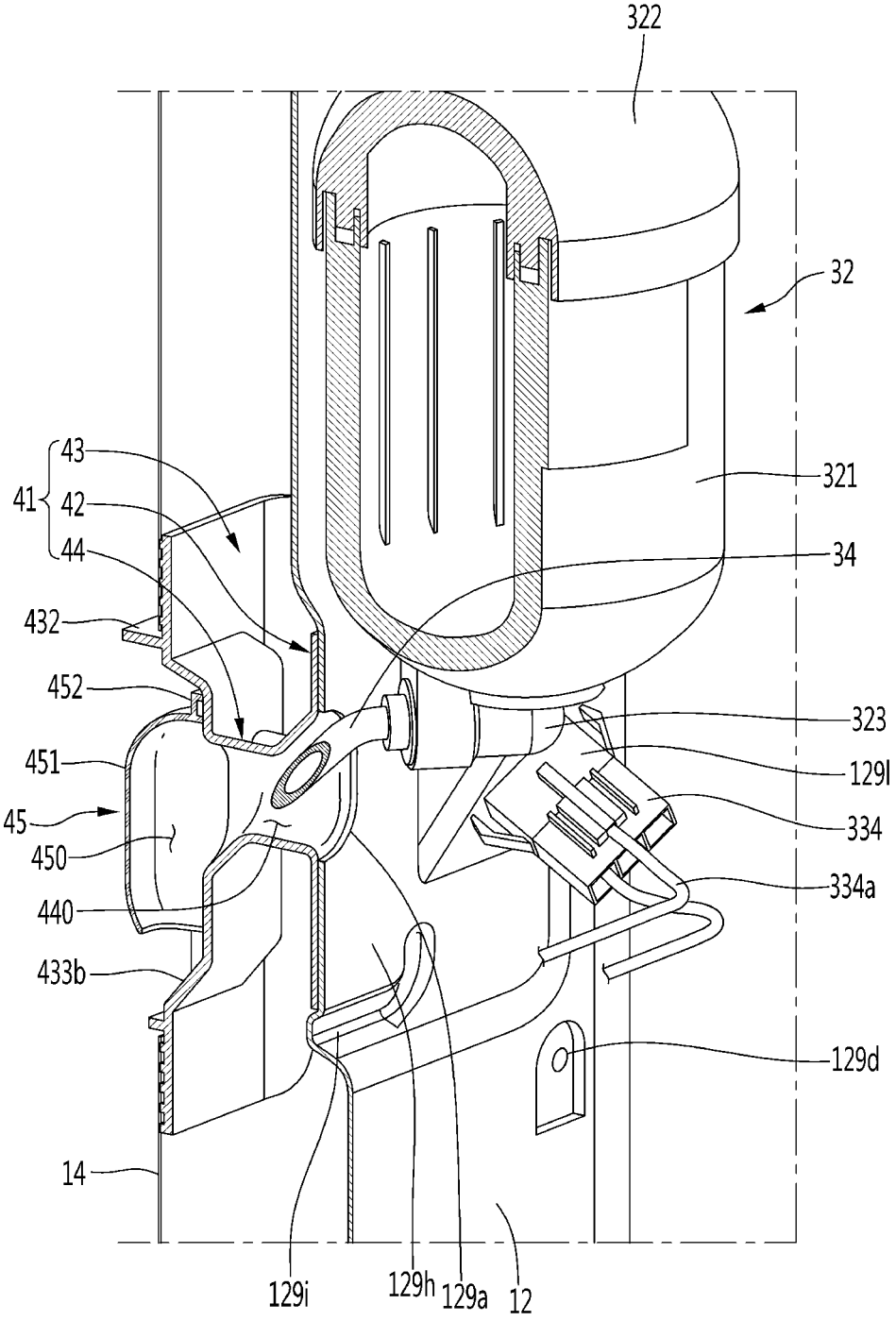
FIG. 16 is a perspective view taken along line 16-16' of FIG. 15.
Figure 17:
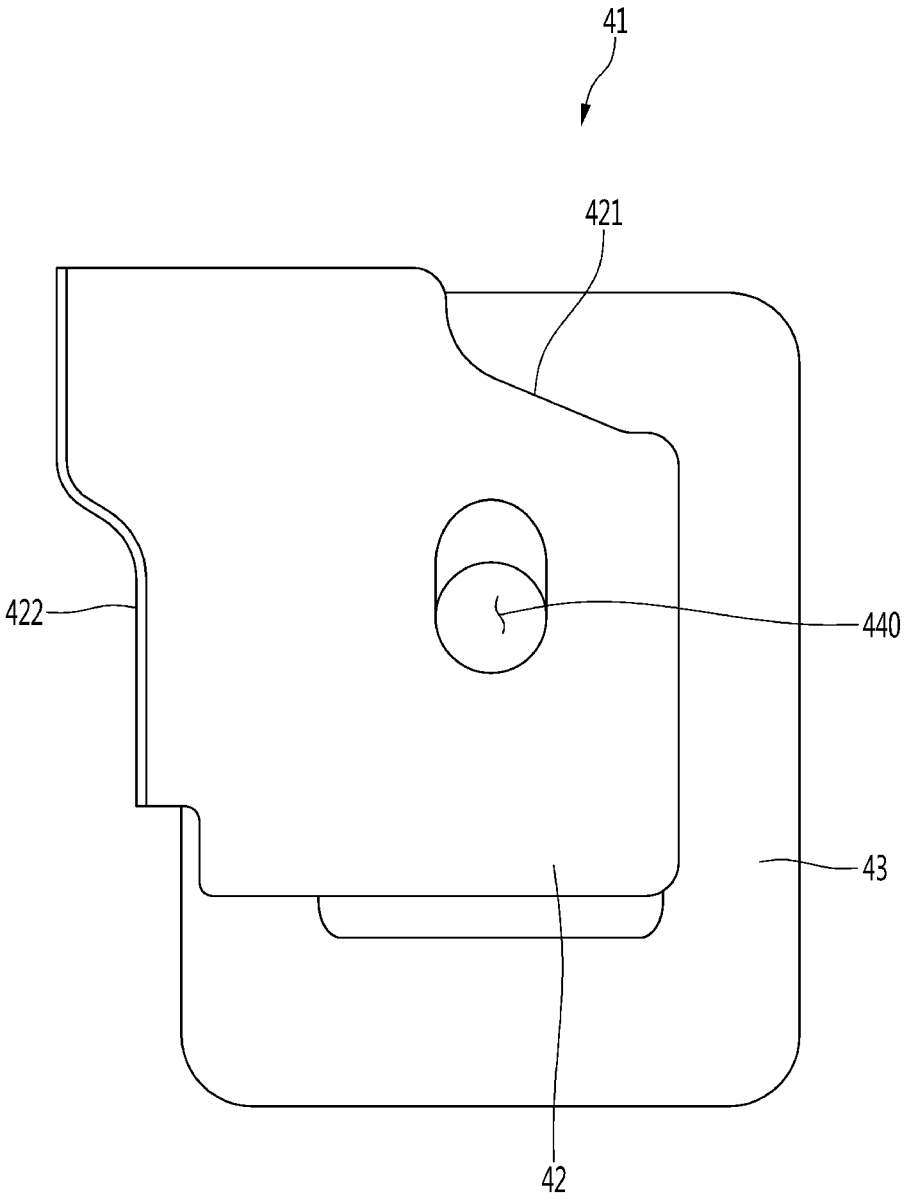
FIG. 17 is a front view of a rear guide according to an embodiment.

Referring to FIGS. 15-16, a back surface of the cabinet 10 may be provided by a back cover or plate 14. The back cover 14 may be provided in a metal plate shape and may be connected to a rear end of the outer case 11. The back cover 14 may be spaced apart from a rear surface of the inner case 12, and the insulation material 120 may be provided in a space defined by the back cover 14, the outer case 11, and the inner case 12 to insulate the refrigerating compartment 101 from the freezing compartment 102.

A PCB cover 142 may be provided at a side (e.g., left side in FIG. 15) of the back cover 14. The PCB cover 142 may be configured to cover a PCB arrangement space 141 in which a main printed circuit board (PCB) controlling an operation of the refrigerator 1 is provided. The PCB arrangement space 141 may have a position corresponding to that of the PCB accommodation portion 123 of the inner case 12, and the main PCB may be provided inside the PCB arrangement space 141. When the PCB cover 142 is removed, the main PCB may be exposed to the outside, facilitating maintenance and repair.

A filter connection portion or opening 134*a* connected to a rear end of the filter 134 may be provided on an upper portion of the back cover 14. The supply tube 34 may pass through the cabinet 10 to extend downward through the filter connection portion 134*a*. The supply tube 34 may be connected to the tank 32 inside the refrigerating compartment 101 through a guide assembly 40.

The supply tube 34 may be divided into two portions or sections which may be respectively connected to the filter 134 and the tank 32. An end of each of the two portions may be connected to each other outside the cabinet 10 by a connection connector separately provided. A pipe, tube, or hose extending from the supply source 2 (FIG. 2) may be configured to be connected to the filter 134 through the water filter connection portion 134*a*.

A guide assembly 40 may be provided on an outer surface of the inner case 12 at a position corresponding to a position at which the tank 32 is mounted. The guide assembly 40 may include a rear guide or frame 41 provided on a rear surface of the cabinet 10 and a guide cap 45 mounted at the rear guide 41.

The rear guide 41 may be fixed and mounted between the inner case 12 and the back cover 14 defining the rear surface of the cabinet 10. The rear guide 41 may guide the supply tube 34 between the refrigerating compartment 101 an the outside of the cabinet 10.

The rear guide 41 may include a front part or plate 42 contacting the inner case 12, a rear part or plate 43 contacting the back cover 14, and a passage part or frame 44 connecting the front part 42 to the rear part 43. The guide hole 440*a* may penetrate the passage part 44. A portion of the back cover 14 corresponding to a mounted position of the rear guide 41 may be cut or penetrated to define a back cover opening 143. The rear guide 41 may be mounted at the back cover opening 143 so that a portion of the rear surface of the rear guide 41 is exposed to or provided at the rear side of the back cover 14 through the back cover opening 143.

The guide hole 440 may pass through the rear guide 41 to communicate with the rear opening 129*a*. The supply tube 34 may pass through the rear opening 129*a* and the guide hole 440 and then be guided to the outside of the cabinet 10. The passage part 44 may have an inclination so that the guide hole 440 is inclined downward in a direction from a front toward a rear.

The rear guide 41 may support the inner case 12 and the back cover 14 so that the inner case 12 and the back cover 14 are maintained a predetermined distance apart in a mounted state. Even if the insulation material 120 is filled between the inner case 12 and the back cover 14, the fixed and mounted positions of the inner case 12 and back cover 14 may be maintained during a filling process.

A guide edge portion or flange 432 of the rear guide 41 may pass through the back cover opening 143. The guide edge portion 432 may define a cap mounting space 433 in which the guide cap 45 is mounted, and the guide hole 440 may be defined at a center of the cap mounting space 433.

The guide edge portion 432 may be provided in a shape corresponding to the back cover opening 143 and may extend backward along a perimeter or edge of the back cover opening 143. The rear guide 41 may be maintained in the back cover opening 143 and mounted to the back cover 14 by the guide edge portion 432.

The guide cap 45 may be mounted inside the guide edge portion 432. The guide cap 45 may cover at least a portion of the cap mounting space 433 and may cover the guide hole 440 so that the guide hole 440 is not exposed to the outside. The guide cap 45 may be made of an elastic material such as rubber or silicone, and may include a cap cover portion or cover 451 recessed backward to form a space 450 through which the supply tube 34 may pass. The guide gap 45 may further include a cap mounting portion or frame 452 extending laterally from an opened front surface of the cap cover portion 451 along a circumference or edge of the cap cover portion 451.

The cap cover portion 451 may have front and bottom surfaces that are opened to guide the supply tube 34 through the guide hole 440 and downward. A space (i.e., the guide hole 440 and the space 450) through which the supply tube 34 passes may be covered and prevented from being exposed to an outside by the cap cover portion 451. The cap cover portion 451 may be configured to prevent foreign substances from being introduced or be prevented from being damaged by external impacts. There may be an optional seal or gasket surrounding the flange 432 and/or the cap cover portion 451 to further prevent substances from entering and to facilitate insulation.

Figure 18:
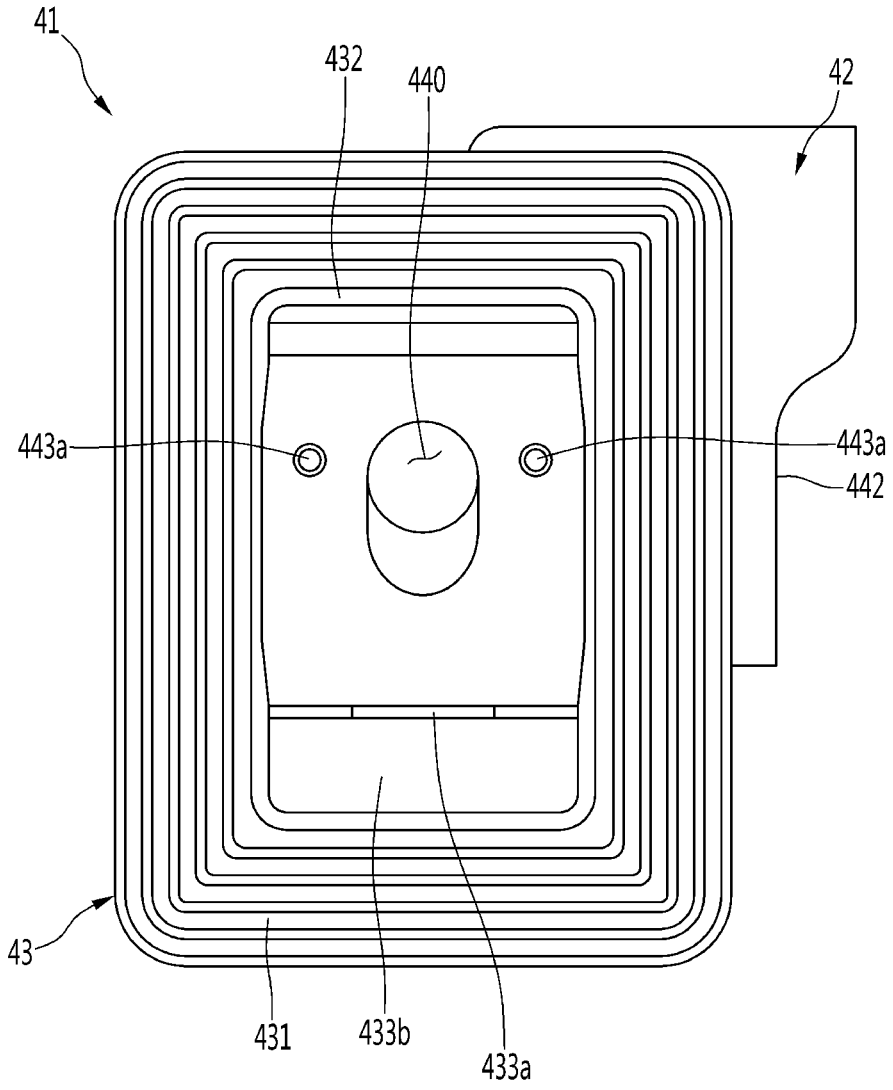
FIG. 18 is a rear view of the rear guide.
Figure 19:
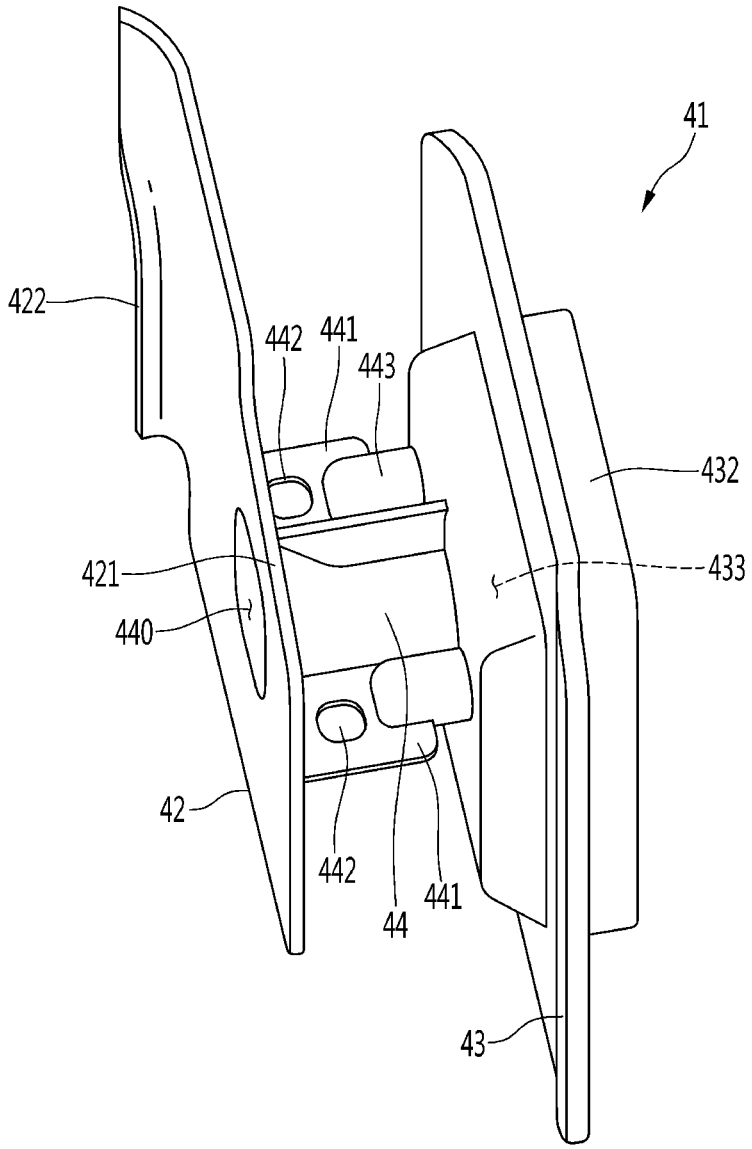
FIG. 19 is a perspective view of the rear guide.
Figure 20:
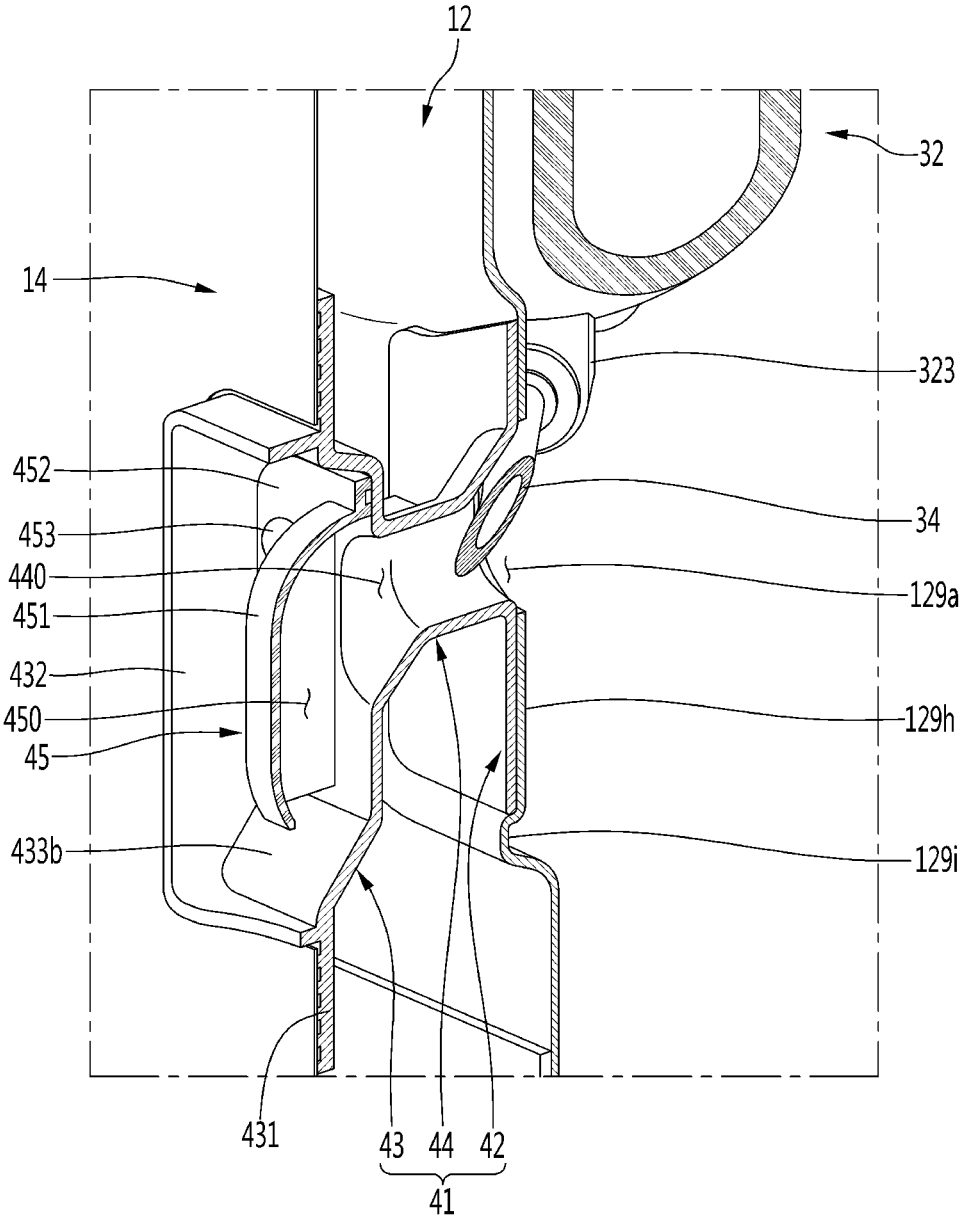
FIG. 20 is a perspective view taken along line 16-16' of FIG. 15 when viewed from the rear side.
Figure 21:
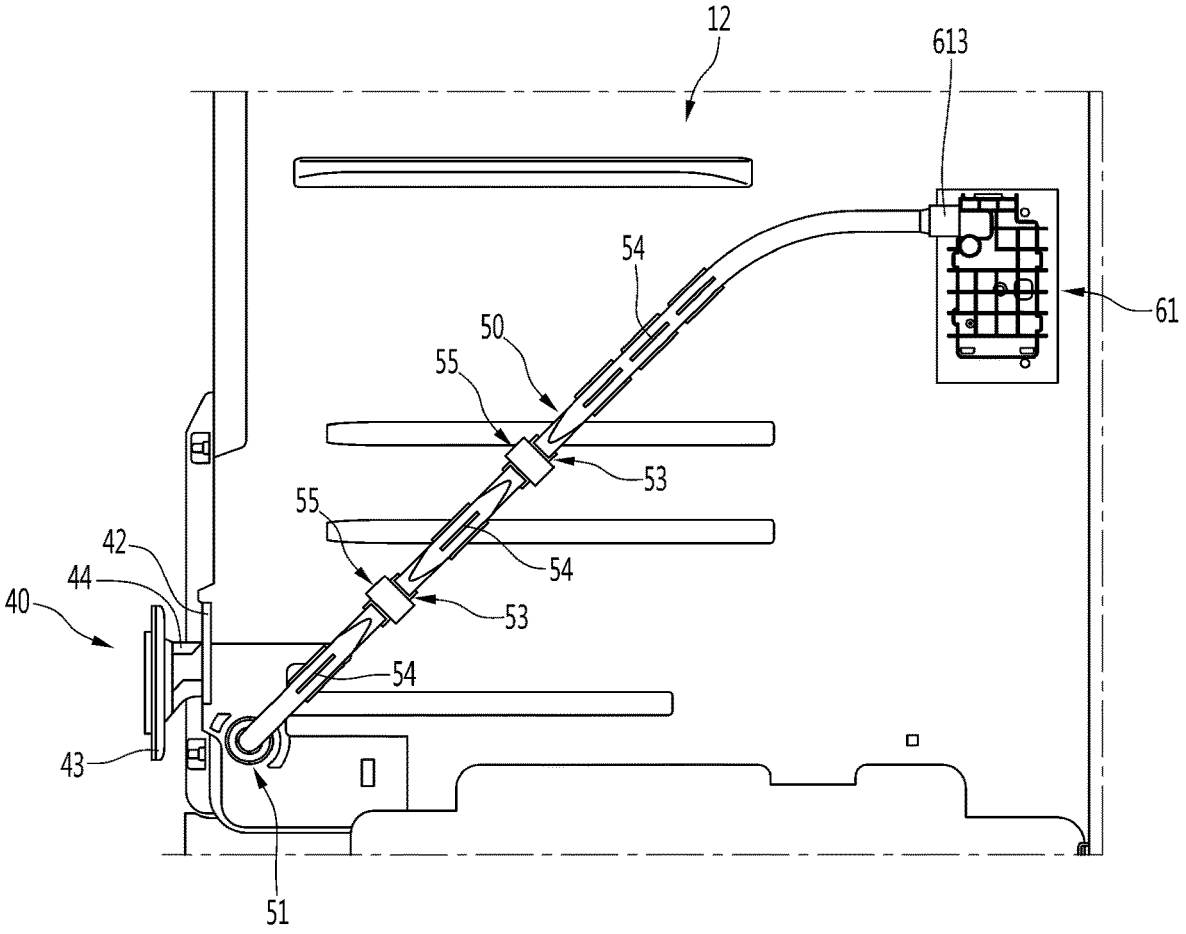
FIG. 21 is a side view illustrating a state in which a tube guide is mounted on the inner case when viewed from the outside according to an embodiment.
Figure 22:
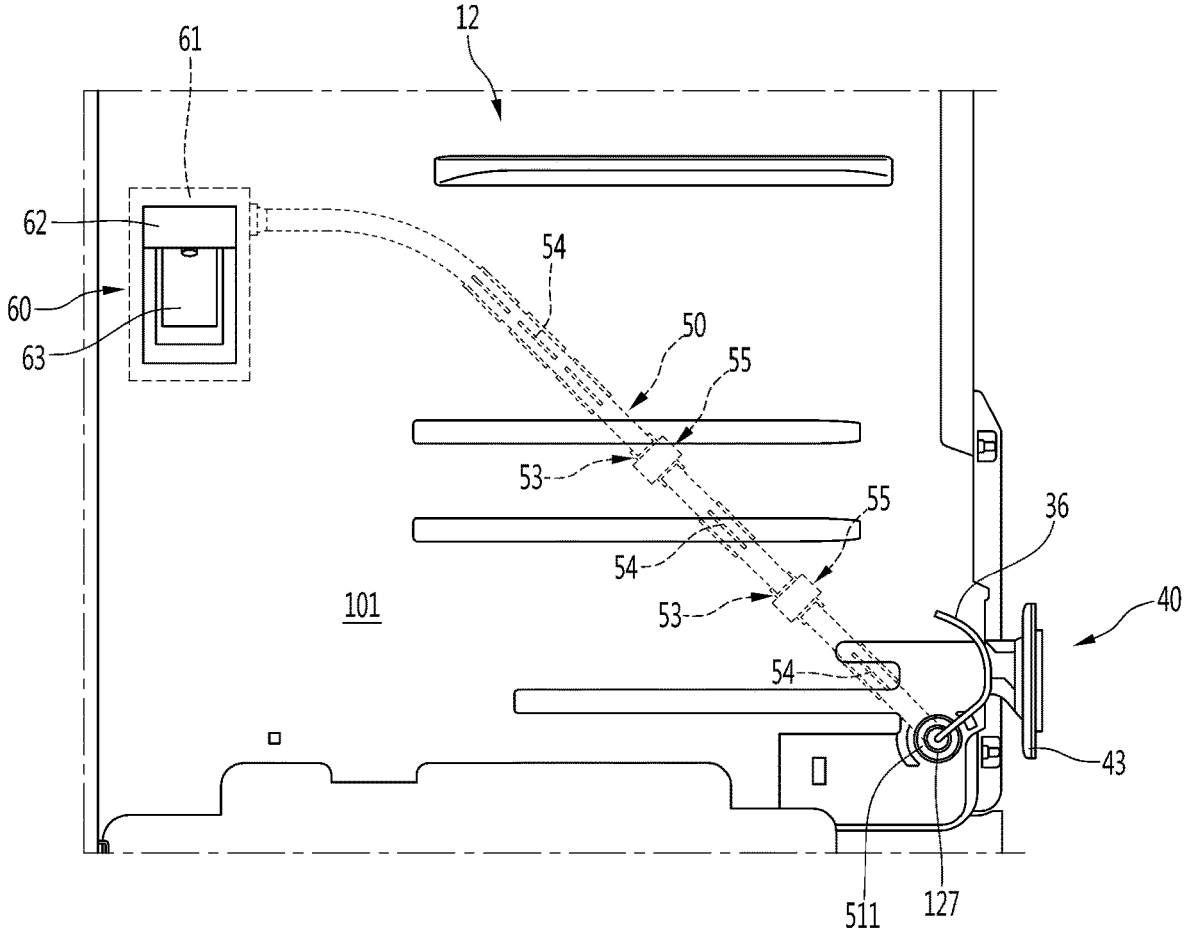
FIG. 22 is a side view illustrating a state in which the tube guide is mounted when viewed from the inside of the inner case.
Figure 23:
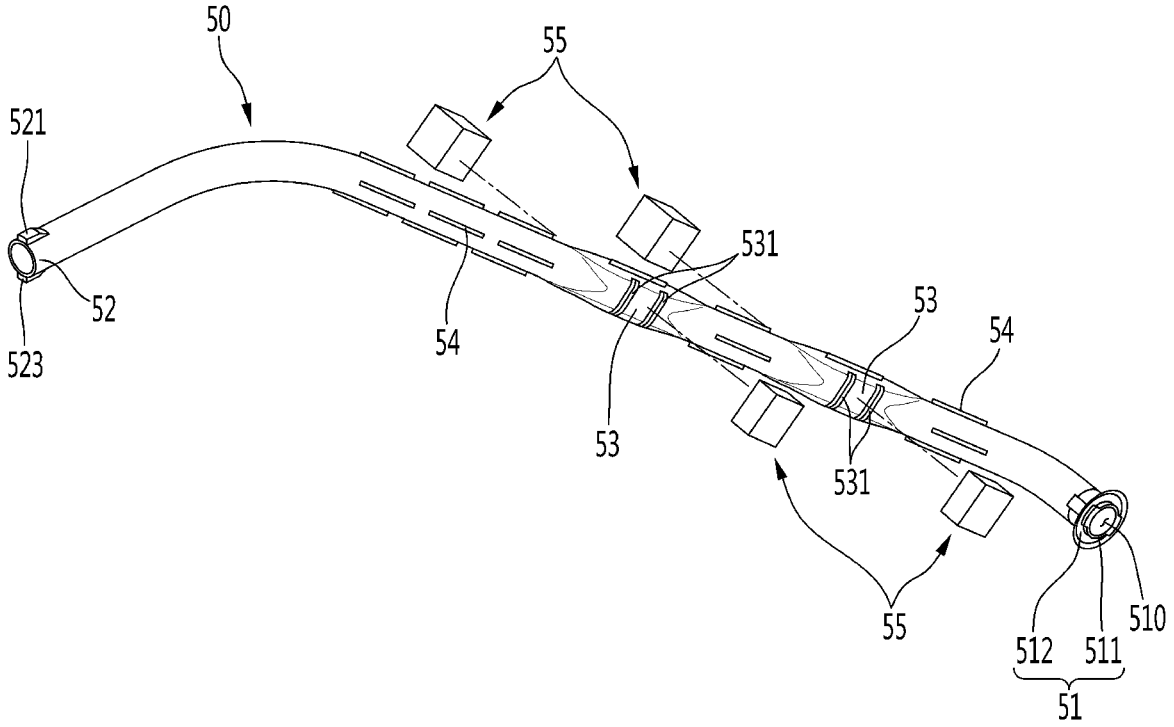
FIG. 23 is a perspective view of the tube guide.
Figure 24:
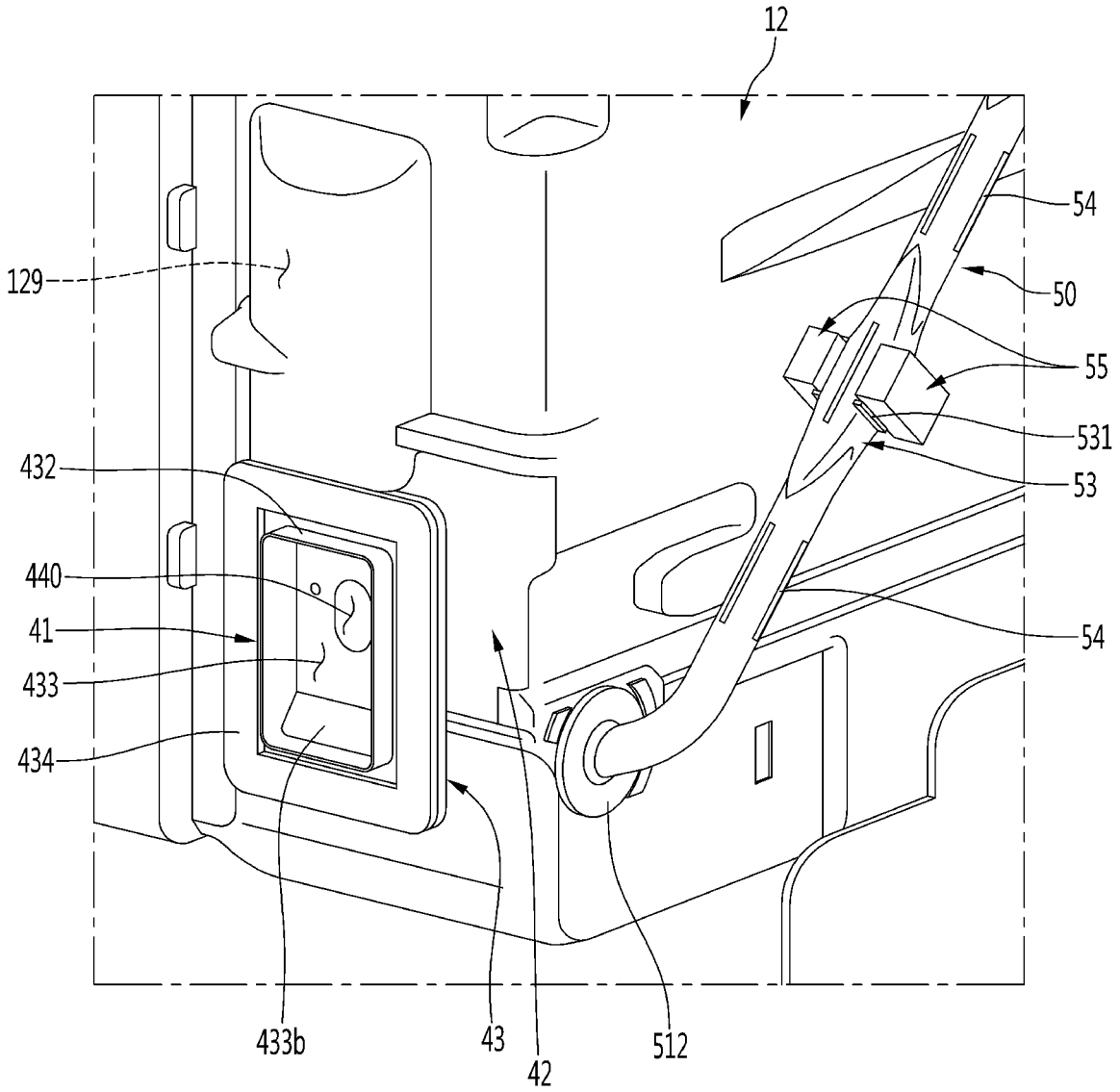
FIG. 24 is a partial perspective view illustrating a state in which a front end of the tube guide is mounted.
Figure 25:
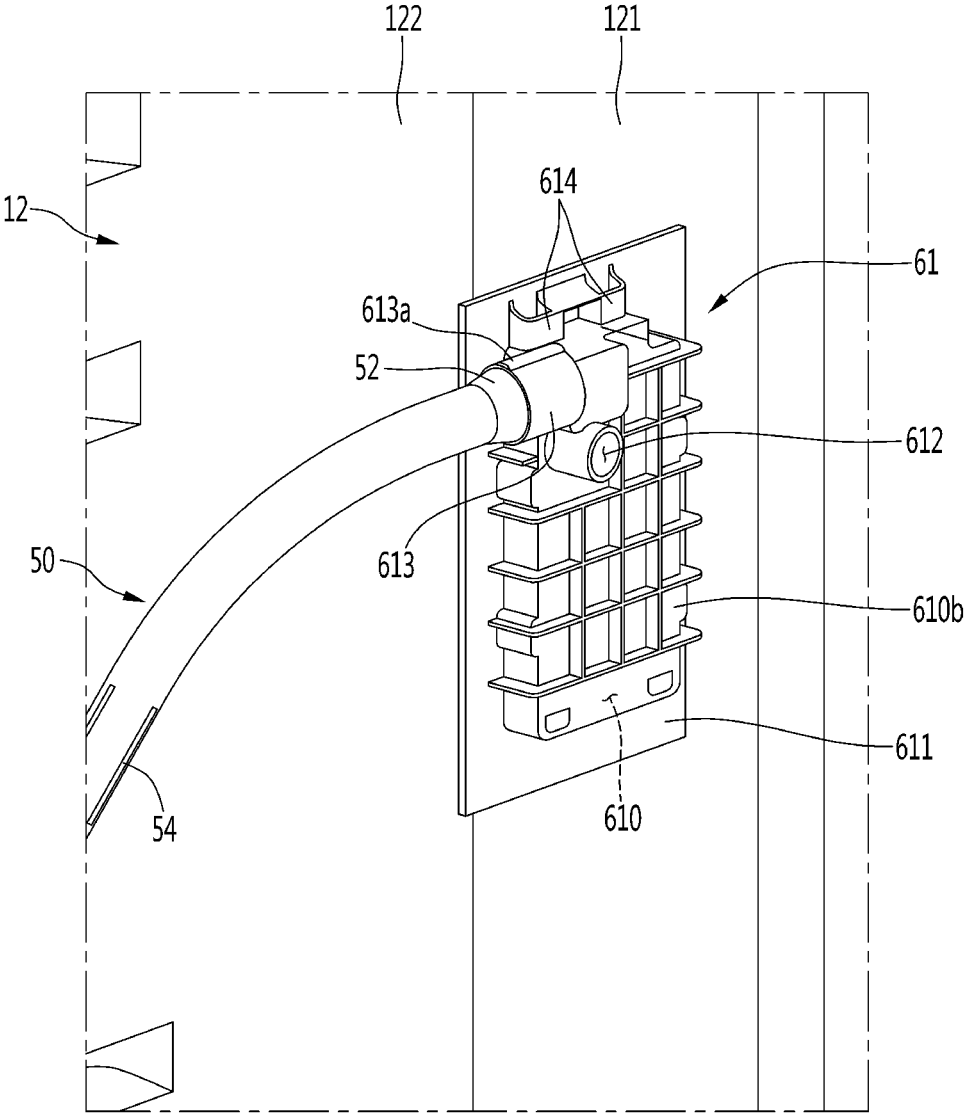
FIG. 25 is a partial perspective view illustrating a state in which a rear end of the tube guide is mounted.

The cap mounting portion 452 may have a size corresponding to the cap mounting space 433 and may be configured to be exposed to the cap mounting space 433. A screw 453 may pass through the cap mounting portion 452 and be inserted through a mounting or screw hole 433*a* (FIG. 18) defined in the rear guide 41 so that the guide cap 45 may be fixed and mounted to the rear guide 41.

A portion of the rear part 43 of the rear guide 41 (or alternatively, a portion of the passage part 44) may have a guide inclined portion 433*b* provided below the guide hole 440 in a lower portion of the cap mounting space 433 so that the supply tube 34 may be guided to the outside of the rear guide 41. A supply tube guide hole or slit 433*c* (FIG. 18) may be defined in an upper end of the guide inclined portion 433*b*. The supply tube guide hole 433*a* may be provided at a position corresponding to an opened bottom surface of the cap cover portion 451, and the supply tube 34 may pass through the supply tube guide hole 433*a* and then be provided along the guide inclined portion 433*b*.

Referring to FIGS. 17-20, the rear guide 41 may be injection-molded using a plastic material and provided in a space between the inner case 12 and the back cover 14 to provide a passage through which the supply tube 34 passes. The rear guide 41 may be include the front part 42, the rear part 43, and the passage part 44.

The front part 42 may support the rear surface of the inner case 12 and may be configured to define a surface corresponding to the rear guide mounting portion 129*h* provided on the inner case 12. The front part 42 may be provided in a plate shape and may contact a rear of the inner case 12.

A center of a front surface of the front part 42 may be opened to define a front end of the guide hole 440. A first forming portion 421 and a second forming portion 422 corresponding to a shape (e.g., a protruding shape) of the inner case 12 may be provided on an outer surface or edge of the front part 42. Each of the first forming portion 421 and the second forming portion 422 may contact a curved shape of the inner case 12 when the front part 42 contacts the inner case 12. The second forming portion 422 may have a lip that protrudes forward. Shapes of the first and second forming portions 421 and 422 may depend on a shape or curvature of the inner case 12.

Upper and lower ends of the front part 42 may contact the upper end groove 129*j* and the lower end groove 129*i*, respectively, defined in the inner case 12 (FIG. 8). The front part 42 may be secured to the inner case 12.

The rear part 43 may be spaced backward from the front part 42 and lie along a plane parallel to the front part 42. The guide edge portion 432 may be provided on the rear part 43. The cap mounting space 433 may be defined at a center of the rear part 43.

A plate portion of the rear part 43 may surround the guide edge portion 432 and surround the back cover opening 143. An adhesion groove 431 may be defined in the rear part 43 along an edge of the guide edge portion 432. There may be a plurality of adhesion grooves 431 spaced apart from each other by regular intervals in an outward direction of the guide edge portion 432 such that the adhesion grooves 431 may be concentric. The rear surface of the rear part 43 may have an uneven shape or texture, and an adhesive or an adhesive sheet may be attached to the rear part 32 at the adhesion grooves 432 to further secure the rear part 43 and the back cover 14.

The front part 42 and the rear part 43 may be connected by the passage part 44, and the guide hole 440 may be defined inside the passage part 44. The guide hole 440 may have a narrow center, and an inner diameter of the guide hole may increase from the center toward the front part 42 and toward the rear part 43 to facilitate an insertion of the supply tube 34.

Passage ribs or tabs 441 may be provided at side surfaces (e.g., left and right side surfaces) of the passage part 44. The passage rib 441 may reinforce the passage part 44 connecting the front part 42 to the rear part 43. Each passage rib 441 may include a rib hole 442 passing therethrough. When injecting a foaming solution to form the insulation material 120 between the inner case 12 and the back cover 14, the foaming solution may flow through the rib hole 442. The insulation material 120 may contact an outer surface of the passage part 44 to more firmly embed the passage part 44 within the insulation material 120 and between the inner case 12 and the back cover 14. A hole boss 443 in which a screw 453 inserted through the mounting hole 443*a* is fixed may be further defined in the front surface of the rear part 43 at a position corresponding to that of the mounting hole 443*a*.

Referring to FIGS. 21-25, a tube guide or pipe 50 may be provided at a surface of the inner case 12 on which the dispenser 60 is provided (or alternatively may be provided at both left and right surfaces of the inner case 12). The tube guide 50 may be provided between the inner case 12 and the outer case 11. The tube guide 50 may have a hollow tube or pipe shape to provide a passage 500 in which the discharge tube 36 may pass and be guided. The discharge tube 36 may be protected from the insulation material 120 that is foamed and filled between the inner case 12 and the outer case 11.

The tube guide 50 may connect the side opening 127 of the inner case 12 to the dispenser case 61, and the inner spaces of the inner case 12 and the dispenser case 61 may communicate with each other through the tube guide 50. The discharge tube 36 may be guided to be inserted into the tube guide 50 and then be withdrawn from the dispenser 60, and the discharge tube 36 may be provided inside the cabinet 10 where the insulation material 120 is provided.

The outer surface of the tube guide 50 may be mostly provided in a cylindrical shape. A plurality of tube protrusions 54 may be provided along an outer circumference or surface of the tube guide 50. The tube protrusions 54 may be configured to prevent the tube guide 50 from being deformed by reinforcing outer surface strength of the tube guide 50. As the tube guide 50 may have a relatively long length and small diameter, the tube protrusions 54 may prevent or reduce a possibility of the tube guide 50 from being deformed by a pressure during a molding or foaming of the insulation material 120. As the tube protrusions 54 may prevent or reduce blocking of the passage 500 of the tube guide 50, a possibility of interference or blockage in the discharge tube 36 that might restrict or interfere with a flow inside of the discharge tube 36 may also be reduced or prevented.

The tube protrusions 54 may extend along an extending direction of the tube guide 50 and may be provided at regular intervals along the circumference of the tube protrusion 54. Also, the tube protrusions 54 may be provided at regular intervals along the extending direction of the tube guide 50.

At least one pair of support member mounting portions or flat sections 53 may be provided at sides (e.g., left and right sides) of the tube guide 50 that face the inner and outer cases 12 and 11 so that a support member or block 55 supporting the tube guide 50 may be mounted at sides of the tube guide 50 that face the inner and outer cases 12 and 11. Each of the support member mounting portions 53 may be provided on the outer surface of the tube guide 50 to provide a surface on which the support member 55 may be seated. A portion of the outer surface of the tube guide 50 having the cylindrical shape may gradually approach a flat shape to provide the support member mounting portion 53. The support member mounting portion 53 may contact at least one surface of the support member 55 to stably support the support member 55.

A mounting portion rib 531 may be provided at ends (e.g., front and rear ends) of the support member mounting portion 53 to restrict ends of the support member 55 and prevent the support member 55 from being separated. A plurality of pairs of support member mounting portions 53 may be provided at regular intervals along a length or extension direction of the tube guide 50.

The support member 55 may be made of a material having elasticity such as rubber or Styrofoam and may be provided in a block shape such as a hexahedral shape. A support member 55 may be mounted to each of the support member mounting portions 53 provided at both sides of the tube guide 50. One side (e.g., an inner side or right or left) of the support member 55 may contact the support member mounting portion 53, and the other side (e.g., an outer side or left or right side) of the support member 55 may contact the inner case 12 or the outer case 11. The tube guide 50 may be maintained at a constant or predetermined distance from the inner case 12 and the outer case 11 between the inner case 12 and the outer case 11 via the support members 55.

Both surfaces of the support member 55 may be bonded or adhered to the support member mounting portion 53 and the inner case 12 or the outer case 11 by an adhesive. The tube guide 50 may be further fixed inside the cabinet 10, and a mounting position thereof may be maintained.

An inner case-side coupling portion or connector 51 coupled to an outer surface of the inner case 12 may be provided at a lower end of the tube guide 50 facing the side opening 127. A lower portion or section of the tube guide 50 may be curved or bent toward the inner case 12, and the inner case-side coupling portion 51 may be provided at the bent end of the tube guide 50 to face the side opening 127. A remaining portion of the tube guide 50 may be spaced apart from the outer surface of the inner case 12 when the inner case-side coupling portion 51 is coupled to the inner case 12, and the remaining portion of the tube guide 50 may be maintained at a certain or predetermined distance away from the outer surface of the inner case 12 by the support member 55.

The inner case-side coupling portion 51 may include an opening insertion portion or inner rim 511 inserted into the side opening 127 and an opening support portion or outer rim 512 extending outward along a circumference of the opening insertion portion 511 to contact an outer surface of the side opening 127.

The opening insertion portion 511 may be provided in a tube or pipe shape passing through the side opening 127 from the outside and may have an outer diameter corresponding to an inner diameter of the side opening 127. The opening insertion portion 511 may extend by a predetermined length, and when the inner case-side coupling portion 51 is coupled to the inner case 12, the opening insertion portion 511 may protrude by a predetermined length inside the refrigerating compartment 101. When the tank cover 31 is mounted, the tube guide 50 may be at least partially exposed inside the tank cover 31, and the discharge tube 36 may be inserted to pass through the passage 500 of the tube guide 50.

The opening support portion 512 may be provided in a disc shape and may extend outward along a circumference spaced from an end of the opening insertion portion 511. The opening support part 512 may contact the outer surface of the inner case 12 and may be configured to adhere by an adhesion member, adhesive, etc.

The tube guide 50 may extend upward obliquely from the inner case-side coupling portion 51, and an upper portion or section of the tube guide 50 may be bent or curved to face the dispenser 60. A dispenser-side coupling portion or connector 52 coupled to the dispenser case 61 may be provided on an upper end of the tube guide 50.

The dispenser-side coupling portion 52 may have a shape configured to be inserted inside a guide insertion portion or tube 613 provided at the dispenser case 61. Upper and lower coupling protrusions 521 and 523 protruding in the vertical direction may be provided on an outer surface of the dispenser-side coupling portion 52 at upper and lower sides of the tube guide 50. A coupling groove 613*a* corresponding to each of the coupling protrusions 521 and 523 may be formed or defined inside the guide insertion portion 613. When the dispenser-side coupling portion 52 is inserted into the guide insertion portion 613, each of the coupling protrusions 521 and 523 may be inserted into the coupling groove 613*a* so that the passage 500 of the tube guide 50 and an inside of the dispenser case 61 may communicate with each other.

The guide insertion portion 613 may protrude from the outer surface of the dispenser case 61 and may extend toward the tube guide 50 from a position spaced apart from the inner case 12. When the tube guide 50 is mounted, a portion of the tube guide 50 not including the bent or curved upper and lower sections of the tube guide 50 may be maintained to be spaced apart from the outer surface of the inner case 12.

The dispenser case 61 may be injection-molded using a plastic material and may include a case recess portion or recess 610*b* defining an accommodation space 610 in which the devices (e.g., tank 32) provided inside the dispenser case 61 are accommodated. A case edge 611 may extend outward around an outer edge of the case recess portion 610*b* and be attached to the outer surface of the inner case 12.

A wire hole 612 through which a wire connected to a switch connector 662 (FIG. 27) extending from a switch 66 (FIG. 27) may be formed through a side of the case recess 610*b*. A top surface restriction portion or frame 614 may be provided at an upper end of the case recess portion 610*b* and will be described in more detail later.

Referring to FIGS. 26-29, the dispenser 60 may further include a rotation lever 65 and the switch 66, which may be provided inside of the dispenser case 61. The dispenser case 61 may be mounted at a dispenser opening 126 (FIG. 7) defined in the inner case 12 at the outer surface of the inner case 12. The dispenser opening 126 may be formed to communicate with the accommodation space 610. The devices provided in the dispenser case 61 (e.g., tank 32) may be exposed through the dispenser opening 126.

An opened front surface of the case recess portion 610*b* may be provided at a position corresponding to the dispenser opening 126, and the case edge 611 may adhere to an edge of the dispenser opening 126. An adhesion member 69 such as a double-sided tape or glue may be provided between the case edge 611 and the inner case 12 at the edge of the dispenser opening 126. Alternatively, the adhesive may be applied to the case edge 611 to adhere to the outer surface of the inner case 12.

A case fixing protrusion 121*a* may be provided at a side of the inner case 12 that is away from the dispenser opening 126 and may be provided in a boss shape protruding from the outer surface of the inner case 12. A portion at which the case fixing protrusion 121*a* is provided may be recessed in the inner surface of the inner case 12. The case fixing protrusion 121*a* may be provided at a position configured to be covered by the dispenser cover 62.

A case fixing hole 611*a* into which the case fixing protrusion 121*a* is inserted may be defined in the case edge 611 at a position corresponding to that of the case fixing protrusion 121*a*. The case fixing protrusion 121*a* may have a length by which the case fixing protrusion 121*a* passes through the case fixing hole 611*a* to further protrude through the case fixing hole 611*a*. When the dispenser case 61 is mounted, the case fixing protrusion 121*a* may be inserted to pass through the case fixing hole 611*a*. The dispenser case 61 may be guided to an accurate mounting position on the outer surface of the inner case 12 via the case fixing protrusion 121*a* and case fixing hole 611*a*, which serve as a temporary (or more secure) fixing portion. There may be two or more case fixing protrusions 121*a* and two or more case fixing holes 611*a* provided at multiple positions (e.g., upper and lower sides of the case 62) to further maintain a position of the dispenser case 61.

The dispenser case 61 and the inner case 12 may be fixedly mounted on the inner case 12 without using a coupling member such as a separate screw via the case fixing protrusions 121, which may provide a clean outer appearance of the dispenser 60, as a coupling member may not be exposed.

In an internal configuration of the case recess portion 610*b*, the guide insertion portion 613 may communicate with edges of an upper end and a side end (e.g., right side end of FIG. 27) of the case recess portion 610*b*. The discharge tube 36 guided through the tube guide 50 may be guided to an inner upper portion of the case recess portion 610*b*.

The top surface restriction portion 614 may restrict an upper end of a discharge tube guide 67 described later may be provided at the inner top surface of the case recess portion 610*b*. The top surface restriction portion 614 may be provided in a groove shape that is opened upward, and a guide hook 672 of the discharge tube guide 67 may be inserted and coupled to the top surface restriction portion 614.

A side surface restriction portion or recess 616 by which right and left sides of the dispenser cover 62 are restricted may be provided on each of the inner left and right sides of the case recess portion 610*b*. The side surface restriction portion 616 may be provided in a recessed groove shape, and side hooks 623*a* protruding from left and right sides of the dispenser cover 62 may be inserted and coupled to the side surface restriction portion 616.

A bottom surface restriction portion or recess 615 by which a lower portion or bottom of the dispenser cover 62 is restricted may be provided on an inner bottom surface of the case recess portion 610*b*. The bottom surface restriction portion 615 may be provided in a recessed groove shape, and a lower hook 623*b* protruding from a lower portion of the dispenser cover 62 may be inserted and coupled to the bottom surface restriction portion 615.

A rotation coupling portion or hinge bracket 617 to which a manipulation member rotation portion or shaft 635 at left and right sides of the manipulation member 63 is axially coupled may be provided at lower left and right sides of the inner surface of the case recess portion 610*b*. The left and right sides of the manipulation member 63 may be rotatably supported by the rotation coupling portion 617 and be mounted to the dispenser case 61. The structure of the rotation coupling portion 617 will be described in more detail later.

A rotation boss 618*b* at which the rotation lever 65 is rotatably mounted may protrude from a center of the inner surface of the case recess portion 610*b*. A screw 657 may rotatably couple the rotation lever 65 to a center of the rotation boss 618*b*.

A stopper or rib 610*a* may protrude from an inner surface of the dispenser case 61 at position configured to stop a rotation of the rotation lever 65 to allow the rotation lever 65 to remain in a stationary state at an initial or first position without further rotating. The stopper 610*a* may be provided to contact a stopping part or stopper 656 provided on the rotation lever 65.

A switch fixing portion or protrusion 618*c* may be provided at a side of the case recess portion 610*b*. The switch fixing portion 618*c* may be a shaft or pin which may extend through one side of the switch 66.

An elastic member 68 may elastically support the manipulation member 63. An elastic member accommodation portion 619 (e.g., hole or recess) may be provided at a side of the case recess portion 610*b* above the stopper 610*a*. The elastic member or spring 68 may be a coil-shaped compression spring, and a first end of the elastic member 68 may be provided in the elastic member accommodation portion 619, which may support the elastic member 68. A second end of the elastic member 618 may contact an upper portion of the manipulation member 63 to elastically support the upper portion of the manipulation member 63. As the manipulation member rotation portion 635 is provided at a bottom portion of the manipulation member 63, the upper portion of the manipulation member 63 may move toward and away from the dispenser case 61 via a rotation of the manipulation member rotation portion 635.

A manipulation protrusion or rib 634 may extend from a rear of the manipulation member 63. A protrusion accommodation groove 618 may be defined in a side of the case recess portion 610*b*, and an end of the manipulation protrusion 634 may be provided in the protrusion accommodation groove 618. The protrusion accommodation groove 618 may be provided at a position facing the manipulation protrusion 634 and may be further recessed from the case recess portion 610*b*. Even when the manipulation member 63 is completely pressed, the protrusion accommodation groove 618 may not interfere with a movement of the end of the manipulation protrusion 634.

The wire hole 612 may be defined in the case recess portion 610*b*. The wire hole 612 may be opened so that a wire connected to the switch connector 662 extending from the switch 66 may pass therethrough. The wire 661 may connect the switch connector 662 to the switch 66, and the switch connector 662 may be connected to the wire via a connector, which may be exposed through the wire hole 612 with the wire 661.

The switch 66 may be fixed to the case recess portion 610*b*. A switching part or arm 661 of the switch 66 may maintain contact with the rotation lever 65, and the switching part 661, which may be a spring (e.g., plate spring, tension spring, or leaf spring) or have an elasticity or give, may be pressed according to a rotation of the rotation lever 65 so that a signal is input.

The manipulation member 63 may be coupled in a state where both lower sides or corners are rotatable via a hinge structure provided by the rotation coupling portion 617 and the manipulation member rotation portion 635. The stopper 610*a* may be provided at an upper end of the manipulation member 63 to prevent the manipulation member 63 from being separated from the dispenser cover 62 to further protrude inward. An elastic member mounting portion 636 on which the elastic member 68 is mounted may further protrude backward from a rear surface of the manipulation member 63. A detailed shape and structure of the manipulation member 63 will be described in more detail later.

The discharge tube 36 may be guided to the dispenser 60 through the tube guide 50. The discharge tube 36 may pass through the tube guide 50 and may be introduced into the dispenser case 61 through the guide insertion portion 613.

The discharge tube 36 may have a predetermined length, and an end of the discharge tube 36 may be exposed to the outside through the dispenser 60. A sleeve 64 may be provided at an end of the discharge tube 36. The sleeve 64 may be made of a metal material and allow the discharge tube 36 to be fixed to an inside of the tube guide 50. The sleeve 64 may guide the end of the discharge tube 36 to a predetermined position and protect the end of the discharge tube 36 from being damaged or deformed.

The end of the discharge tube 36 may further protrude by passing through an end of the sleeve 64 to provide a dispensing portion or outlet 361 through which liquid (e.g., water) is dispensed through the dispenser 60. The sleeve 64 may be inserted into a discharge guide portion or passage 622*a* provided in the dispenser cover 62. An end of the sleeve 64 may be exposed through an end of the discharge guide portion 622*a*. The dispensing portion 361 may protrude more than the end of the sleeve 64. Since water discharged through the dispensing portion 361 may not contact the sleeve 64 or the discharge guide portion 622*a*, the water may be prevented from being contaminated by being introduced into a gap of the sleeve 64 or the discharge guide portion 622*a*.

The dispenser cover 62 may define the outer surface of the dispenser 60 that is exposed to the inside of the refrigerating compartment 101. The dispenser cover 62 may be provided along the dispenser opening 126 (FIG. 7) defined in the inner case 12. A cover opening 621 may be provided in an inner region of the dispenser opening 126, and the manipulation member 63 may be provided inside or exposed through the cover opening 621. The inside of the dispenser case 61 may be covered by the dispenser cover 62 and the manipulation member 63, and an outer appearance or exterior of the dispenser 60 may be exposed to the inside of the refrigerating compartment 101.

The dispenser cover 62 may extend further outward along the edge of the dispenser opening 126. An area at which the case fixing protrusion 121*a* is provided may be covered by mounting the dispenser cover 62.

A cover upper portion or section 622 may be provided above the cover opening 621. The discharge tube guide 67 to which the discharge tube 36 is fixed may be mounted inside the cover upper portion 622. A protruding bottom surface of the cover top portion 622 may protrude downward from the discharge guide portion 622*a* where the end of the discharge tube 36 is provided. The discharge guide portion 622*a* may have an inclination away from a sidewall surface of the inner case 12 in a downward direction.

The discharge tube guide 67 may have the guide hooks 62 and also a rear surface 671, a through hole 673, and a through portion 674 described in more detail later. The discharge cover 62 may include a guide accommodation space 622*b*, a bottom surface restriction portion or stopper 622*c*, hooks 623 (which include the side hook 623*a* and the lower hook 623*b*), and an edge groove 621*b* described later. The rotation leer 65 may include a lever center 651, a push arm 652, and a pushing end or part 653 described later.

Referring to FIGS. 30-33, the dispenser cover 62 may have the cover opening 621 in a lower portion or section thereof. The cover upper portion 622 on which the discharge tube guide 67 is mounted may be provided above the cover opening 621.

The cover opening 621 may be provided in a shape corresponding to the front surface of the manipulation member 63, and the manipulation member 63 may be rotatably mounted inside the cover opening 621. The manipulation member 63 may be provided to protrude forward somewhat from the cover opening 621 to facilitate a rotation operation.

An opening edge or flange 621*a* may be provided along an edge of the cover opening 621 and extend to the inside of the dispenser case 61. The opening edge 621*a* may be provided on at least both right and left sides and the bottom surface of the cover opening 621. The opening edge 621*a* may extend by a predetermined length, and when the manipulation member 63 rotates, the manipulation member 63 may be guided to move without being disengaged via the opening edge 621*a*.

A plurality of hooks 623 to dix the dispenser cover 62 to the dispenser case 61 may be provided at the opening edge 621*a*. The hooks 623 may include a side hook 623*a* protruding from left and right sides of the opening edge 621*a* and a lower hook 623*b* protruding from a bottom of the opening edge 621*a*. The side hook 623*a* and the lower hook 623*b* may be respectively provided at positions corresponding to the side restriction portion 616 and the bottom restriction portion 615 inside the dispenser case 61.

The side hook 623*a* may extend to be inserted into the side restriction portion 616 and the lower hook 623*b* may extent to be inserted into the bottom surface restriction portion 615. Each of the side hooks 623*a* and the lower hooks 623*b* may be provided in a plurality to firmly secure and fix dispenser case 61, which may contact the inner case 12.

An edge groove 621*b* in which a portion of the manipulation member rotation portion 635 is provided may be further defined in lower left and right side surfaces of the opening edge 621*a*. The edge groove 621*b* may be defined at a position corresponding to that of the manipulation member rotation portion 635, and may be recessed or curved in a shape corresponding to a portion of a circumference or outer surface of the manipulation member rotation portion 635. When the dispenser cover 62 and the manipulation member rotation portion 635 is seated at the rotation coupling portion 617, the edge groove 621*b* may accommodate a remaining portion of the manipulation member rotation portion 635 seated on the rotation coupling portion 617. The manipulation member rotation portion 635 may be rotatably mounted between the rotating coupling portion 617 and the edge groove 621*b*.

The discharge tube guide 67 may be mounted on the cover upper portion 622, and the guide hook 672 provided on the discharge tube guide 67 may be coupled to the top surface restriction portion 614 inside the dispenser case 61. When the discharge tube guide 67 is coupled to the dispenser 60, the guide hook 672 may be coupled to the top surface restriction portion 614 to restrict the upper portion of the dispenser cover 62.

A rear surface of the cover upper portion 622 may define a guide accommodation space 622*b* recessed inward, and the discharge tube guide 67 may be provided inside the guide accommodation space 622*b*. The guide accommodating space 622*b* may be provided so that a central portion thereof protrudes to correspond to a shape of the cover upper portion 622. The guide accommodation space 622*b* may have a front-rear thickness that gradually decreases from the central portion toward left and right sides.

The bottom surface restriction protrusion 622*c* may protrude upward from a bottom surface of the guide accommodation space 622*b*, and a top surface restriction protrusion 622*d* may be provided on a top surface of the guide accommodation space 622*b*. Each of the bottom surface restriction protrusion 622*c* and the top surface restriction protrusion 622*d* may be provided in plurality to face each other.

A bottom surface restriction groove 676 and a top surface restriction groove 675 (FIG. 29) in which the bottom surface restriction protrusion 622*c* and the top surface restriction protrusion 622*d* are respectively inserted may be defined in the top surface of the discharge tube guide 67. When the discharge tube guide 67 is completely inserted into the guide accommodation space 622*b*, the bottom surface restriction protrusion 622*c* may be inserted into the bottom surface restriction groove 676, and the top surface restriction protrusion 622*d* may be inserted into the top surface restriction groove 675 so that the discharge tube guide 67 may be fixed inside the guide accommodation space 622*b*.

The discharge guide portion 622*a* may be provided on the bottom surface of the cover upper portion 622 in a bottom of the guide accommodation space 622*b*. The discharge guide portion 622*a* may pass through a bottom of the guide accommodation space 622*b* and the cover upper portion 622 to extend downward.

The discharge guide portion 622*a* may be provided to be inclined at a predetermined or set angle β with respect to a wall surface of the inner case 12. For example, the set angle β may be about 15° to about 25° from the wall surface of the inner case 12. The discharge guide portion 622*a* may become further away from the wall surface of the inner case 12 in a downward direction. When the user presses the manipulation member 63, the discharge guide portion 622*a* may dispense liquid or water to a point or position that is close to a center of a cup 6 (FIG. 43) configured to hold the dispensed water.

Figure 43:
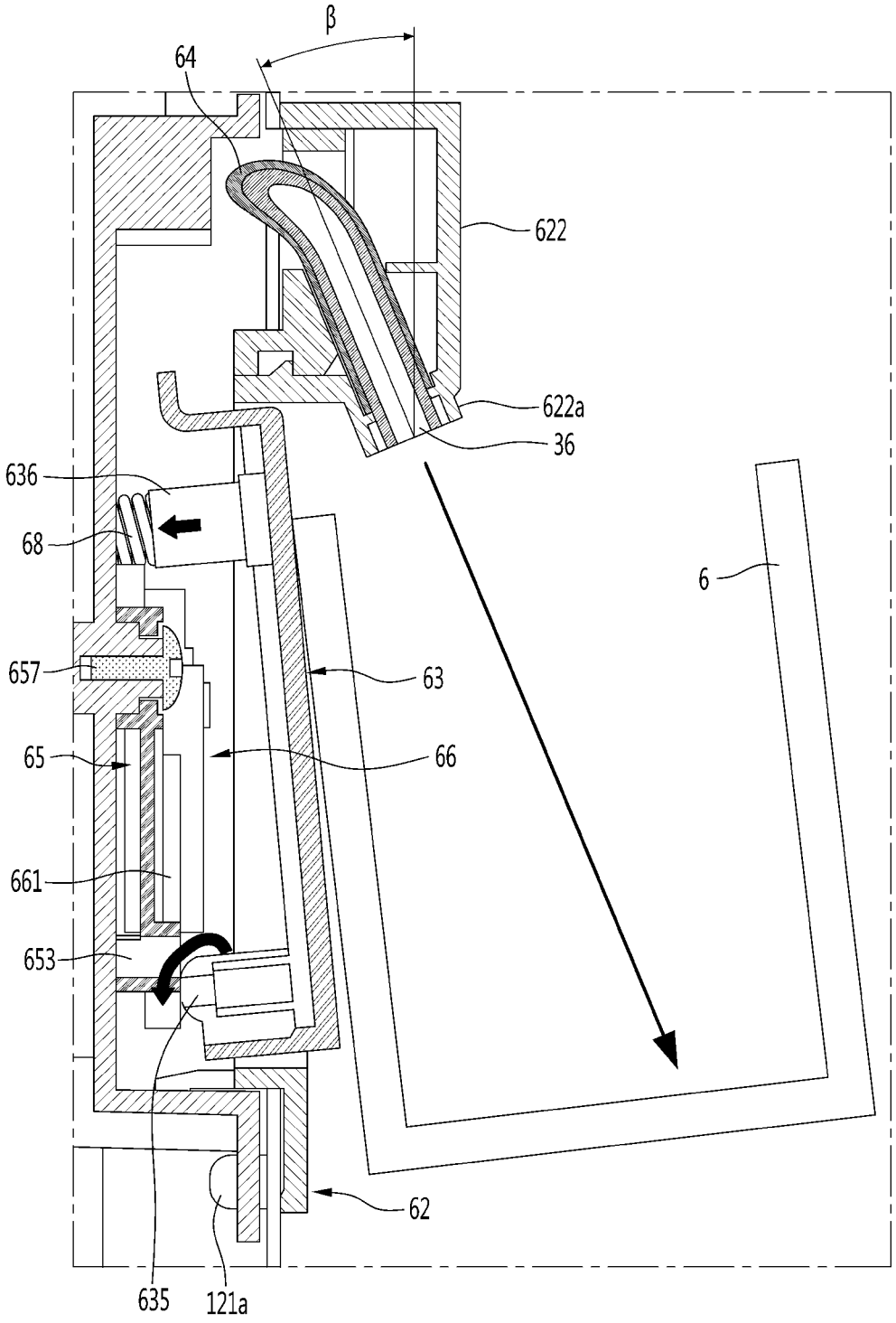
FIG. 43 is a cross-sectional view illustrating a state of the manipulation member of the dispenser.

Referring quickly to FIG. 43, the manipulation member 63 may have a structure in which a rotation shaft or pin (i.e., the manipulation member rotation portion 635) is provided at a lower end thereof, and a point or position adjacent to the discharge guide portion 622*a* may be supported by the elastic member 68. The user may press an upper portion of the manipulation member 63 with an upper end of the cup 6 moves, which may be tilted or inclined to facilitate a pressing. Water discharged due to an inclined arrangement of the discharge guide portion 622*a* may further flow toward a center of the cup 6.

The dispenser 60 may dispense the water to a central portion of the cup 6 while minimizing a protruding distance from the inner case 12, facilitating a dispensing operation. For example, the protruding distance of the dispenser 60, i.e., the thickness h1 (FIG. 5) from the inner case 12 to a protruding end of the cover upper portion 622, may be about 15 mm to about 22 mm.

The protruding thickness h1 may be a distance to the most protruding central portion of the cover upper portion 622 and may be decreased due to the cover upper portion 622 being inclined or rounded toward left and right sides with respect to the center of the cover upper portion 622. When the refrigerating compartment door 21 rotates, an interference from the door basket 211 or food stored in the door basket 211 may be reduced or prevented.

Referring to FIGS. 30-33 and 43, an inner diameter of the discharge guide portion 622*a* may be the same as or similar to an outer diameter of the sleeve 64, and the sleeve 64 may be inserted into the discharge guide portion 622*a*. The discharge tube 36 may also be inclined at the same angle as the set angle β of the discharge guide portion 622*a*.

Figure 26:
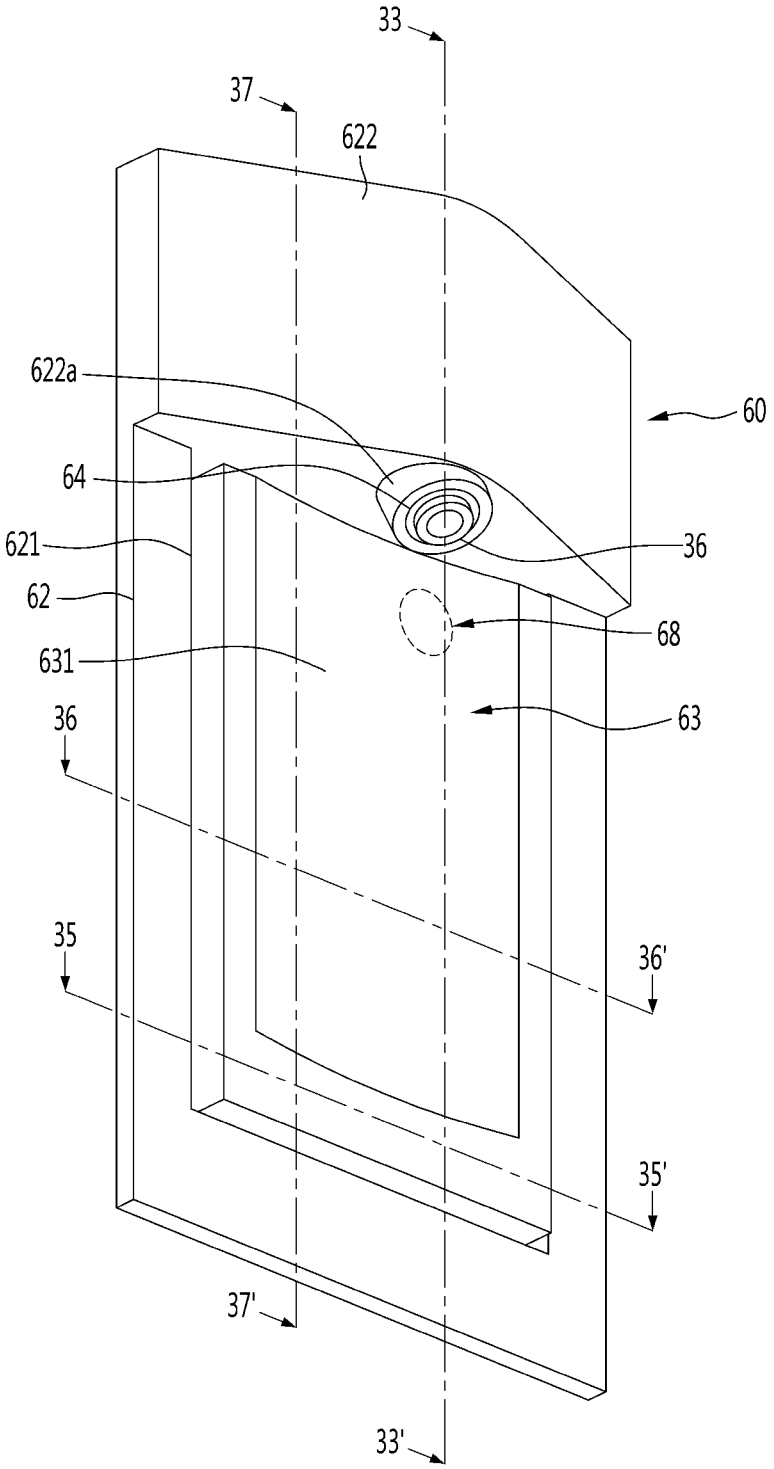
FIG. 26 is a perspective view of a dispenser according to an embodiment.

Also, a restriction structure such as a groove and a protrusion may be provided inside the discharge guide portion 622*a* and outside the sleeve 64 to insert the sleeve 64 into the discharge guide portion 622*a* by a predetermined or set depth and maintain an accurate mounting position. As illustrated in FIG. 26, the sleeve 64 may be fixedly mounted on the discharge guide portion 622*a*, and the dispensing portion 361 at the end of the discharge tube 36 may be maintained a predetermined or set distance away from the discharge guide portion 622*a*.

The discharge tube guide 67 may have a shape corresponding to that of an inner shape or contour of the guide accommodation space 622*b* and be coupled by being inserted into the cover upper portion 622. The discharge tube guide 67 may be provided inside the guide accommodation space 622*b* when coupled to the cover upper portion 622, and the rear surface 671 of the discharge tube guide 67 may be exposed to the rear surface of the dispenser cover 62. A through-portion or opening 674 through which the dispensing tube 36 is guided to the discharge guide portion 622*a* may be defined inside the discharge tube guide 67.

The through-portion 674 may extend from the rear surface 671 to the bottom surface of the discharge tube guide 67, and a bottom surface of the through-portion 674 may have an inclination corresponding to that of the discharge guide portion 622*a*. A through-hole 673 through which the discharge tube 36 and the sleeve 64 pass may be defined inside the through-portion 674, and the through-hole 673 may be opened at a rear surface 671 and a bottom surface of the discharge tube guide 67.

When the discharge tube guide 67 is coupled to the cover upper portion 622, the through-hole 673 and the discharge guide portion 622*a* may communicate with each other. The discharge tube 36 and the sleeve 64 may be inserted into the discharge tube guide 67, and the dispensing portion 361 of the discharge tube 36 may be inserted until the dispensing portion 361 protrudes to an outside of the discharge guide portion 622*a*.

A guide hook 672 protruding upward may be provided on the rear surface 671 of the discharge tube guide 67. The guide hook 672 may be provided in a pair on left and right sides of the through-portion 674 and may have a shape that protrudes inside the dispenser case 61 and then bends to extend upward.

Figure 32:
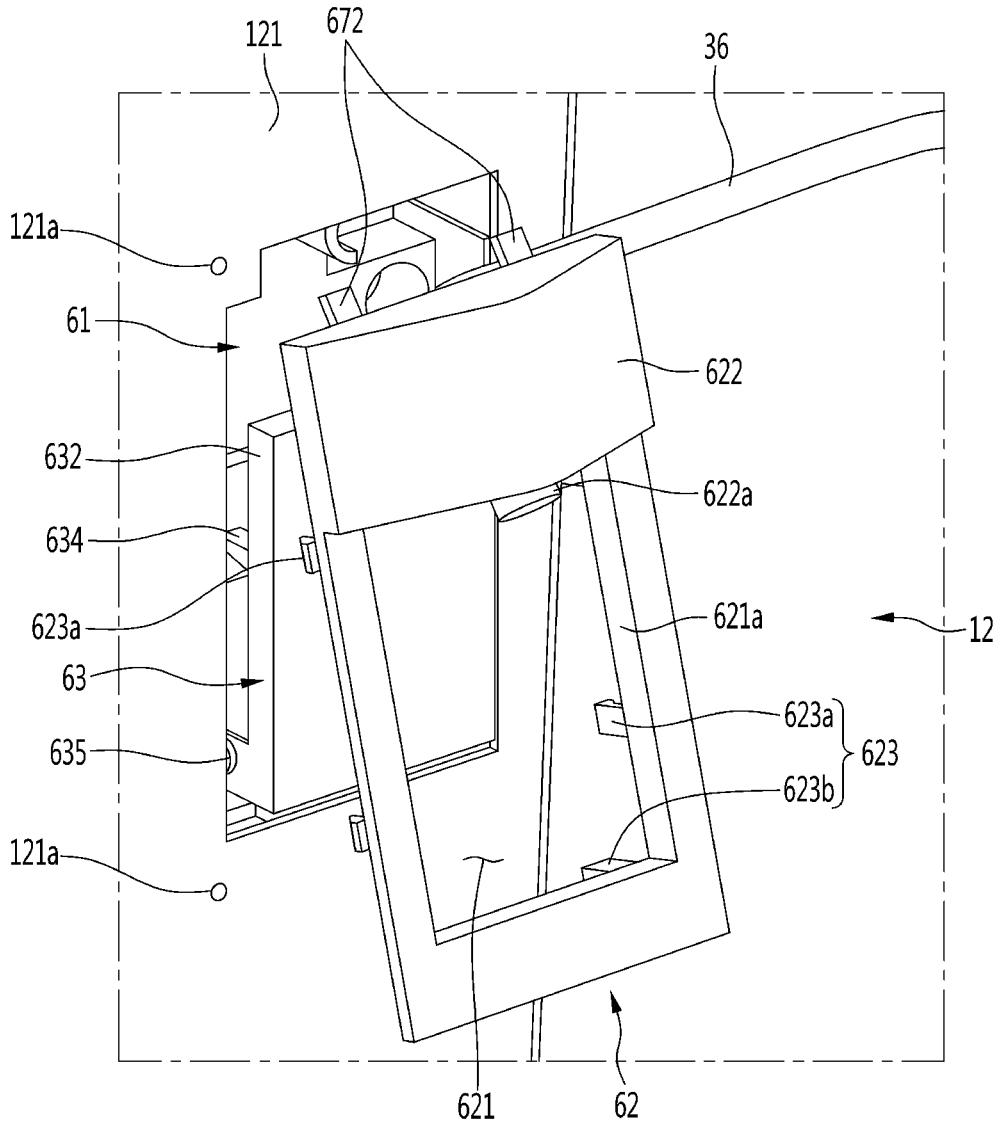
FIG. 32 is a partial perspective view illustrating a state in which the dispenser cover is coupled or separated.
Figure 33:
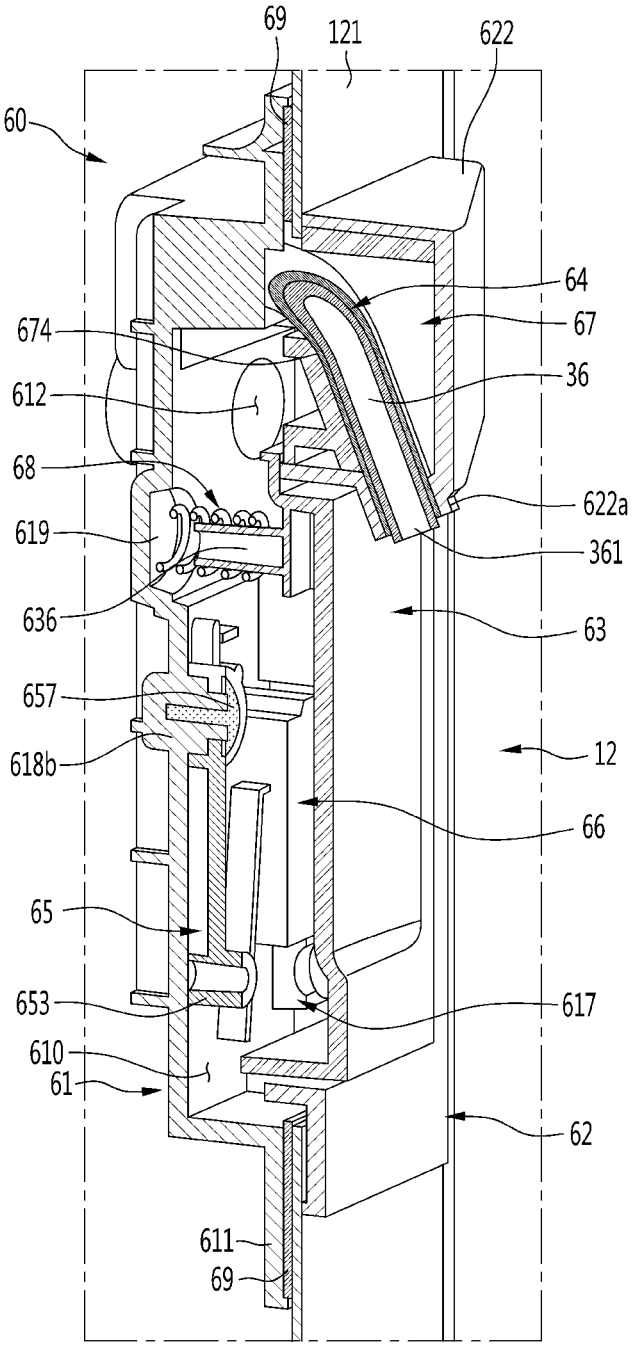
FIG. 33 is a cutaway perspective view taken along line 33-33' of FIG. 26.
Figure 34:
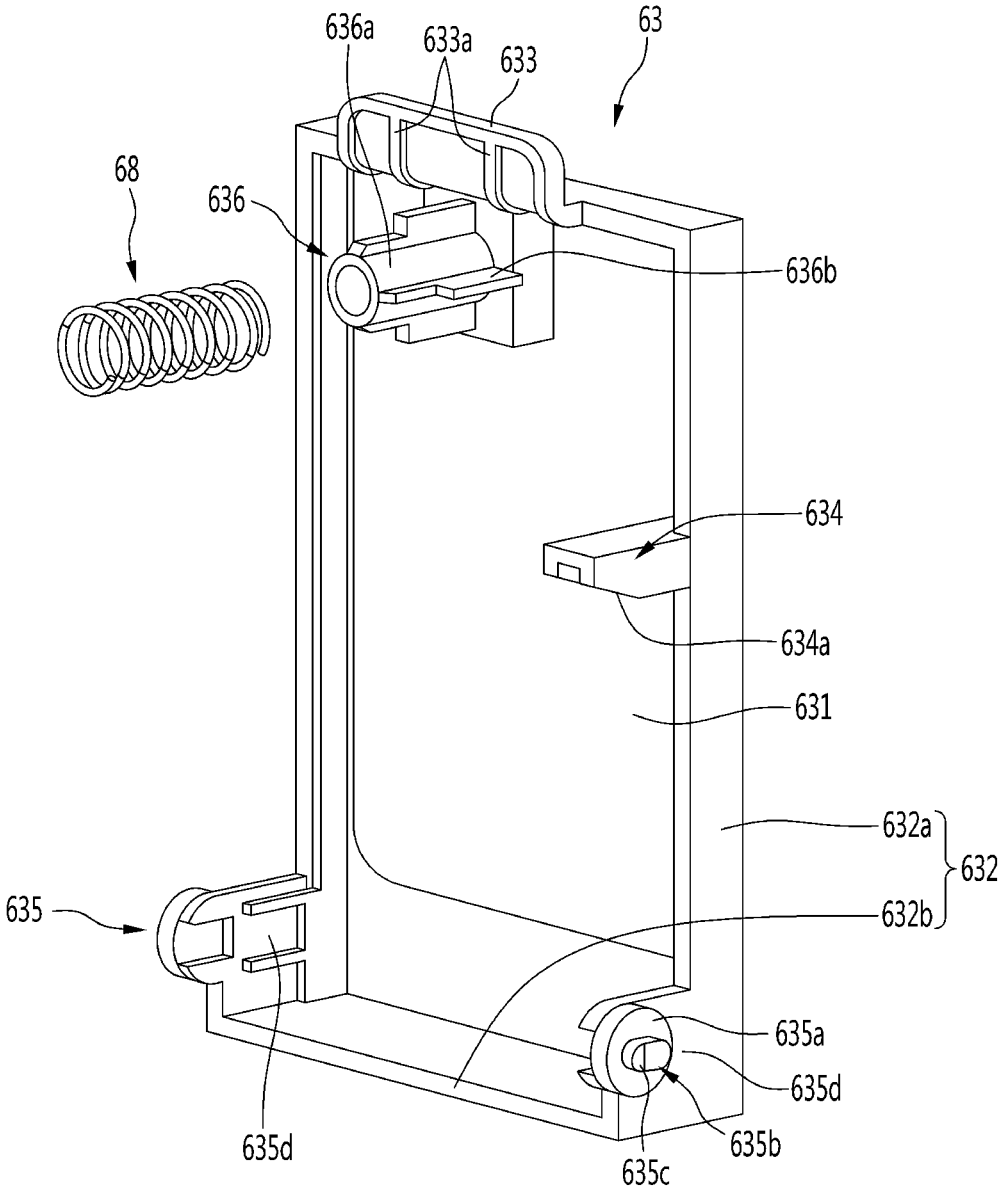
FIG. 34 is a perspective view of a manipulation member that is one component of the dispenser.

The guide hook 672 may be provided at a position corresponding to that of the top surface restriction portion 614 provided on the inner top surface of the dispenser case 61. The guide hook 672 may be hooked with the top surface restriction portion 614 by being inserted upward from a lower side. To mount the dispenser cover 62 as illustrated in FIG. 32, first, the guide hook 672 and the top surface restriction portion 614 may be coupled to each other in a state in which the guide hook 672 is inclined to be inserted into the top surface restriction portion 614. A lower portion of the dispenser cover 62 may be pushed toward the dispenser case 61 to couple the side hook 623*a* and the lower hook 623*b* to the side surface restriction portion 616 and the bottom surface restriction portion 615. The entire edge of the dispenser cover 62 may be coupled to the dispenser case 61 by the guide hook 672, the side hook 623*a* and the lower hook 623*b*, and thus, the dispenser cover 62 may be maintained to be in contact with the inner surface of the inner case 12.

Referring to FIGS. 34-37, the manipulation member 63 may be provided in a rectangular shape corresponding to the cover opening 621 and be configured to cover the cover opening 621 when mounted on the dispenser case 61. A central portion of the manipulation member 63 may be curved and recessed to define a manipulation recess portion or recess 631 in which the cup 6 (FIG. 43) or another container may be provided to press the manipulation member 63. A manipulation member edge or wall 632 that is bent toward the dispenser case 61 may be provided at an edge of the manipulation member 63.

The manipulation member 63 may be provided to protrude more than the cover opening 621 when mounted on the dispenser case 61 so that an interference with the dispenser cover 62 when the manipulation member 63 is pressed may be prevented and so that the manipulation member 63 may rotate smoothly. The manipulation member edge 632 may cover a space between the manipulation member 63 and the cover opening 621 to prevent n inside of the dispenser case 61 from being exposed.

The manipulation member edge 632 may include an edge upper portion or upper edge 632*a* defining a top surface and also left and right sides of the manipulation member 63, and an edge lower portion or lower edge 632*b* defining a bottom surface of the manipulation member 63. The edge lower portion 632*b* may extend more toward the dispenser case 61 than the edge upper portion 632*a*.

The manipulation member rotation part 635 may be provided on a manipulation member extension portion or wall 635*d* provided at a lower end of the edge upper portion 632*a* and a rear end of the edge lower portion 632*b*. The manipulation member rotation part 635 may be provided at a position that is spaced a predetermined or set distance from the outer surface of the manipulation member 63 contacting the cup 6 to facilitate a pressing of the upper portion of the manipulation member 63 and to secure a rotation distance of the upper portion of the manipulation member 63, improving convenience.

The manipulation member extension portion 635*d* may be provided at a lower end of left and right sides of the manipulation member 63, and the manipulation member rotation portion 635 may have a structure that protrudes toward right and left sides. The manipulation member rotation portion 635 may include a circular shaft or axis base 635*a* protruding outward from the manipulation member extension portion 635*d* and a rotation protrusion or hinge pin 635*b* further protruding outward from a center of the shaft base 635*a*.

The rotation protrusion 635*b* may have a diameter less than that of the shaft base 635*a*, and the shaft base 635*a* and the rotation protrusion 635*b* may have a stepped structure. Due to this stepped structure, the manipulation member rotation portion 635 may be stably and rotatably mounted at the rotation coupling portion 617 inside the dispenser case 61.

A protrusion inclined surface 635*c* may be provided on an extended end of the rotation protrusion 635*b*. The protrusion inclined surface 635*c* may have an inclined end or portion that is inserted into the rotation coupling portion 617 when the manipulation member 63 is mounted on the dispenser case 61 to press fit the manipulation member rotation portion 635 to the dispenser case 61.

Figure 27:
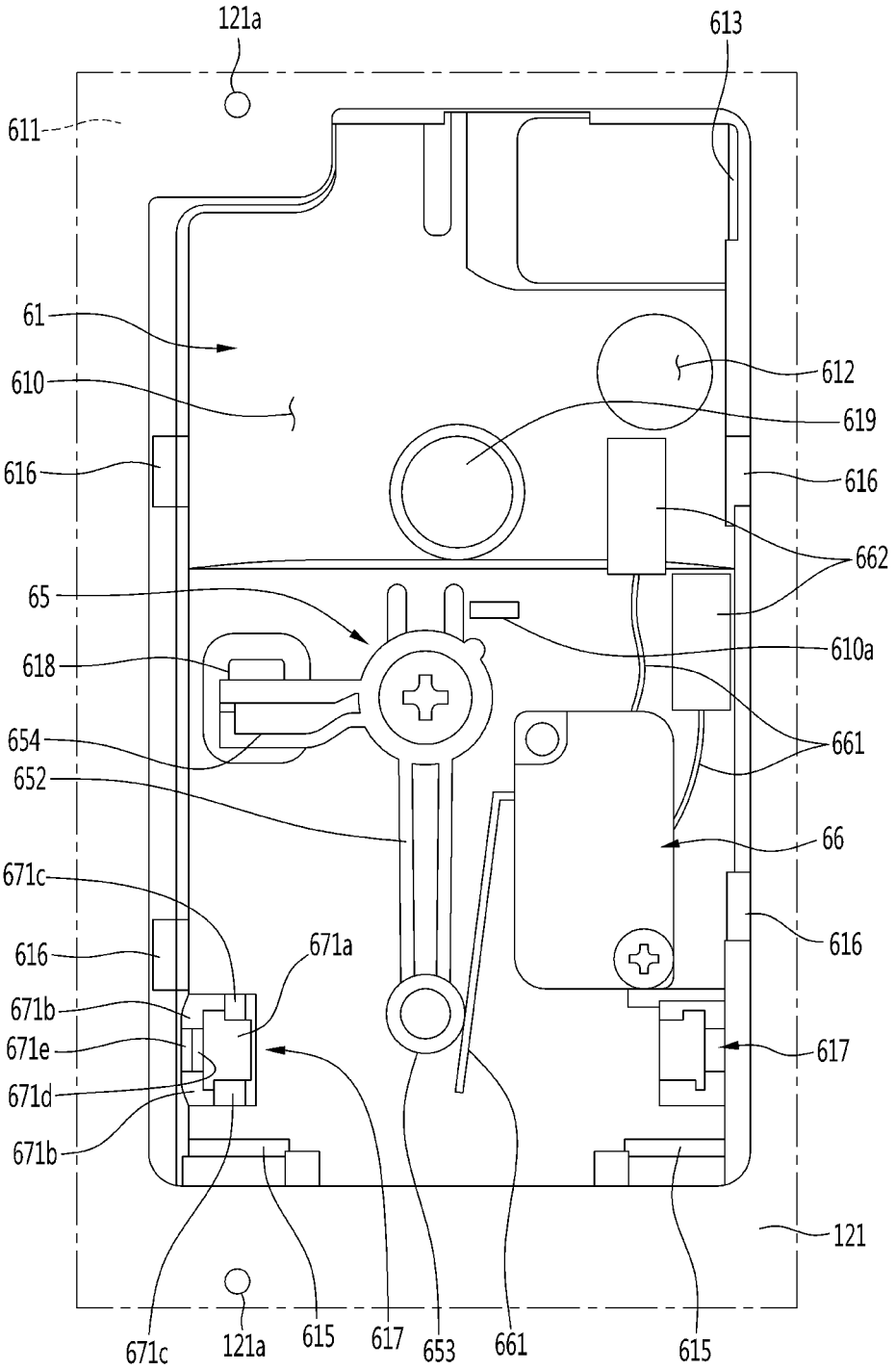
FIG. 27 is a front view illustrating a state in which the dispenser cover is removed in FIG. 26.
Figure 28:
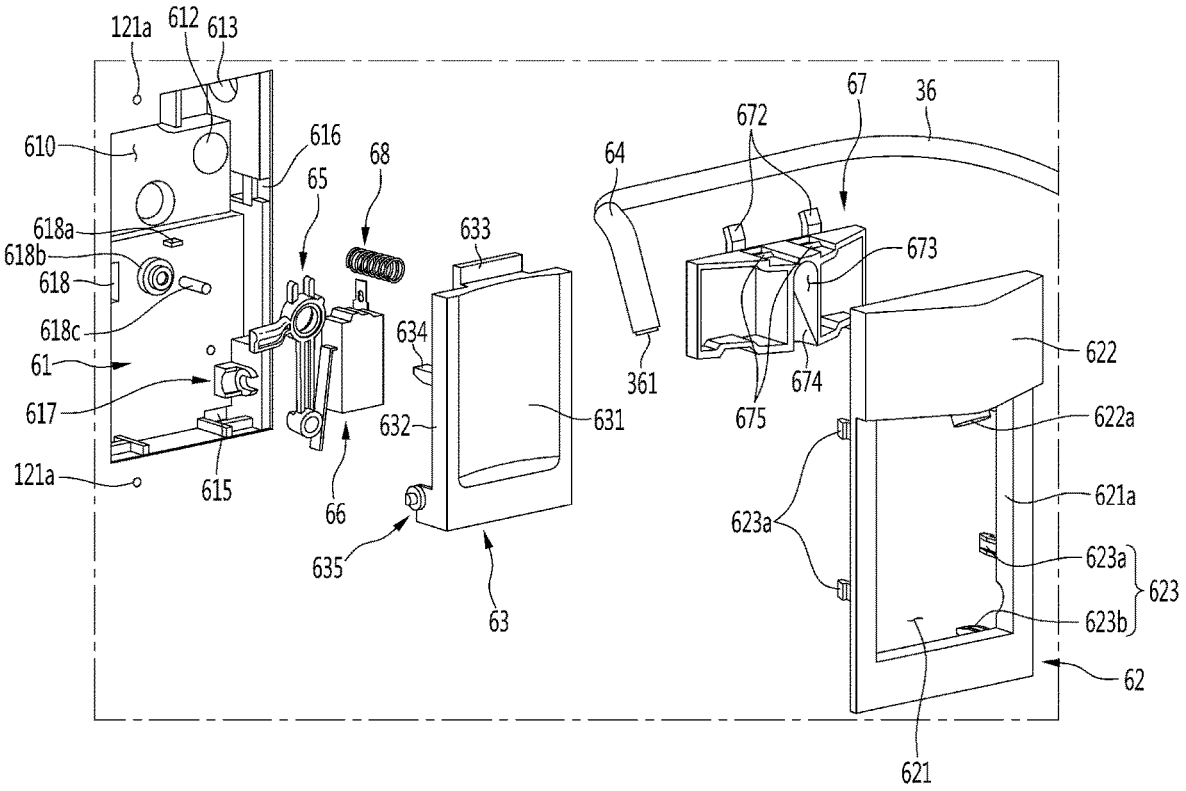
FIG. 28 is an exploded perspective view illustrating a state in which the dispenser is disassembled when viewed from one side.
Figure 29:
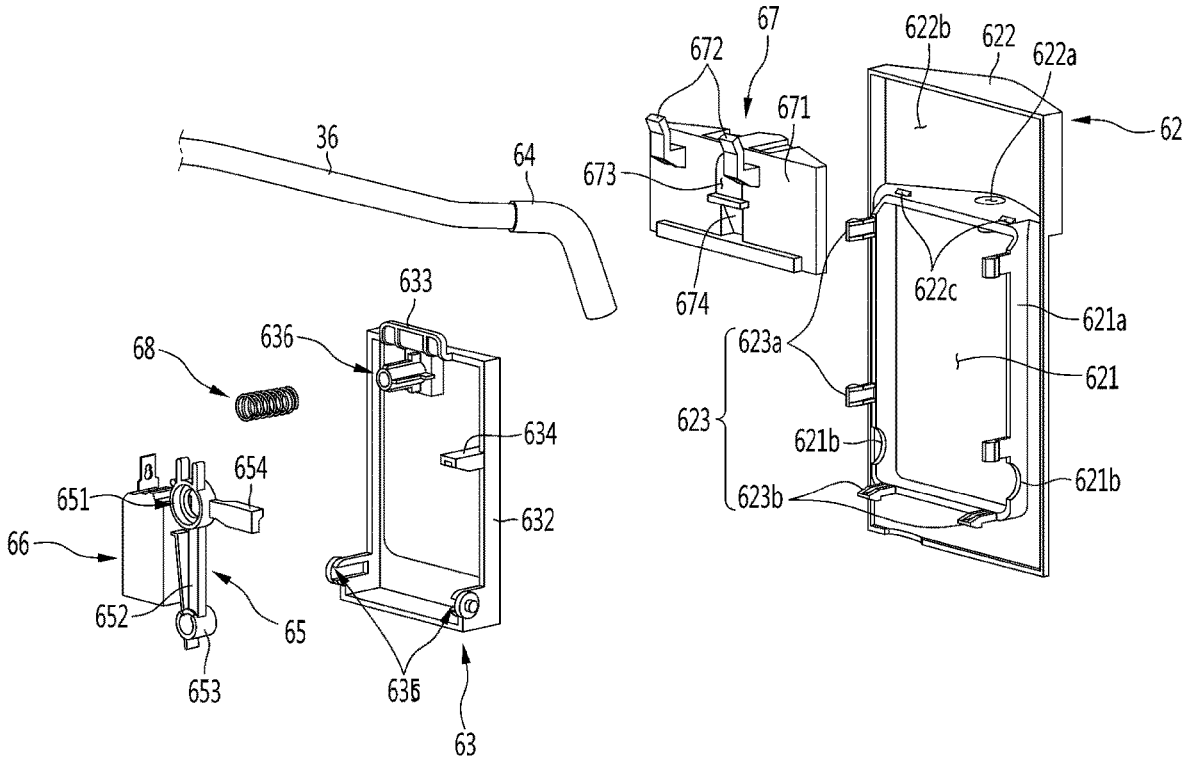
FIG. 29 is an exploded perspective view illustrating a state in which the dispenser is disassembled when viewed from the other side.
Figure 30:
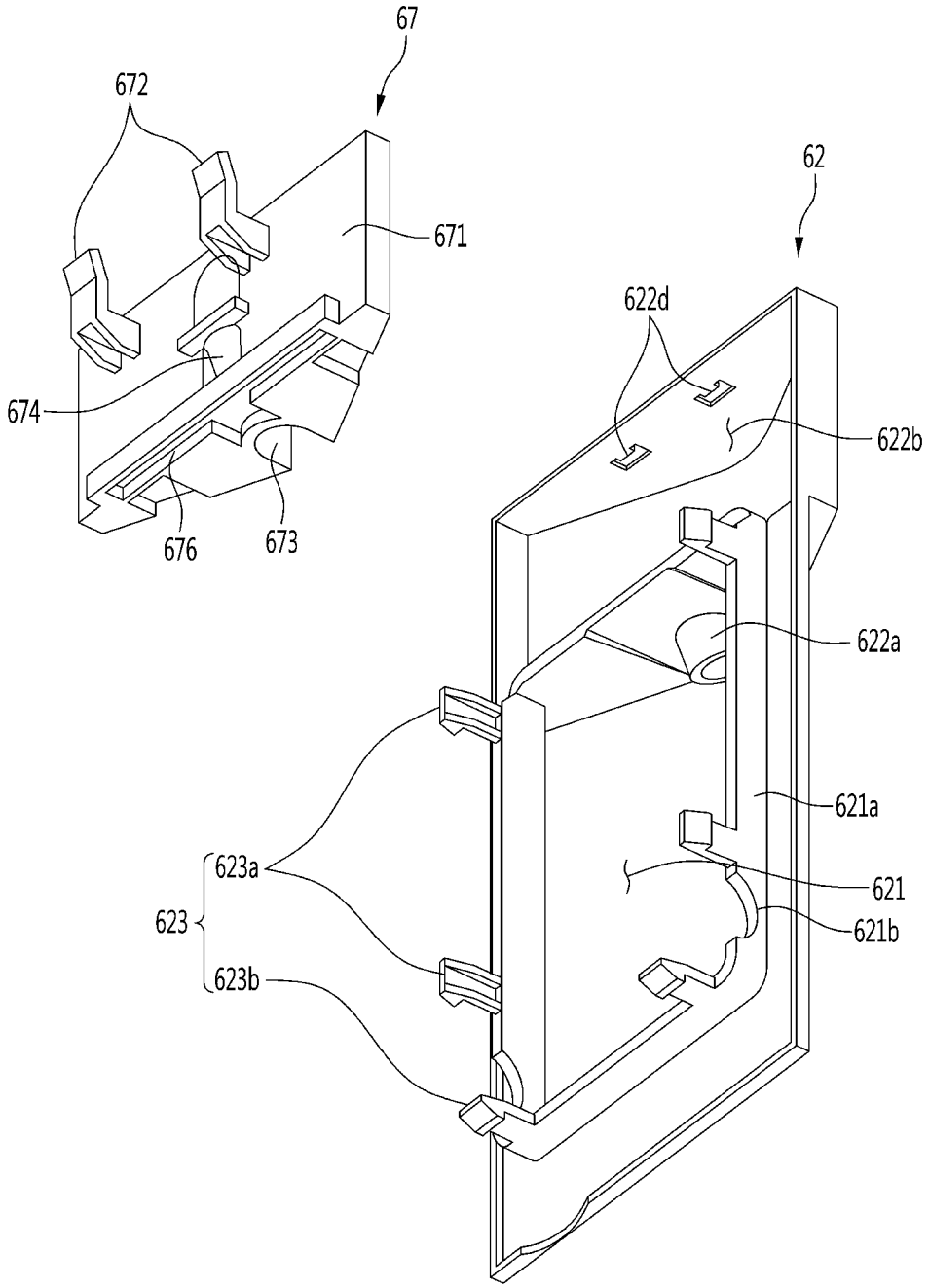
FIG. 30 is an exploded perspective view illustrating a dispenser cover that is one component of the dispenser and a water discharge tube guide.
Figure 31:
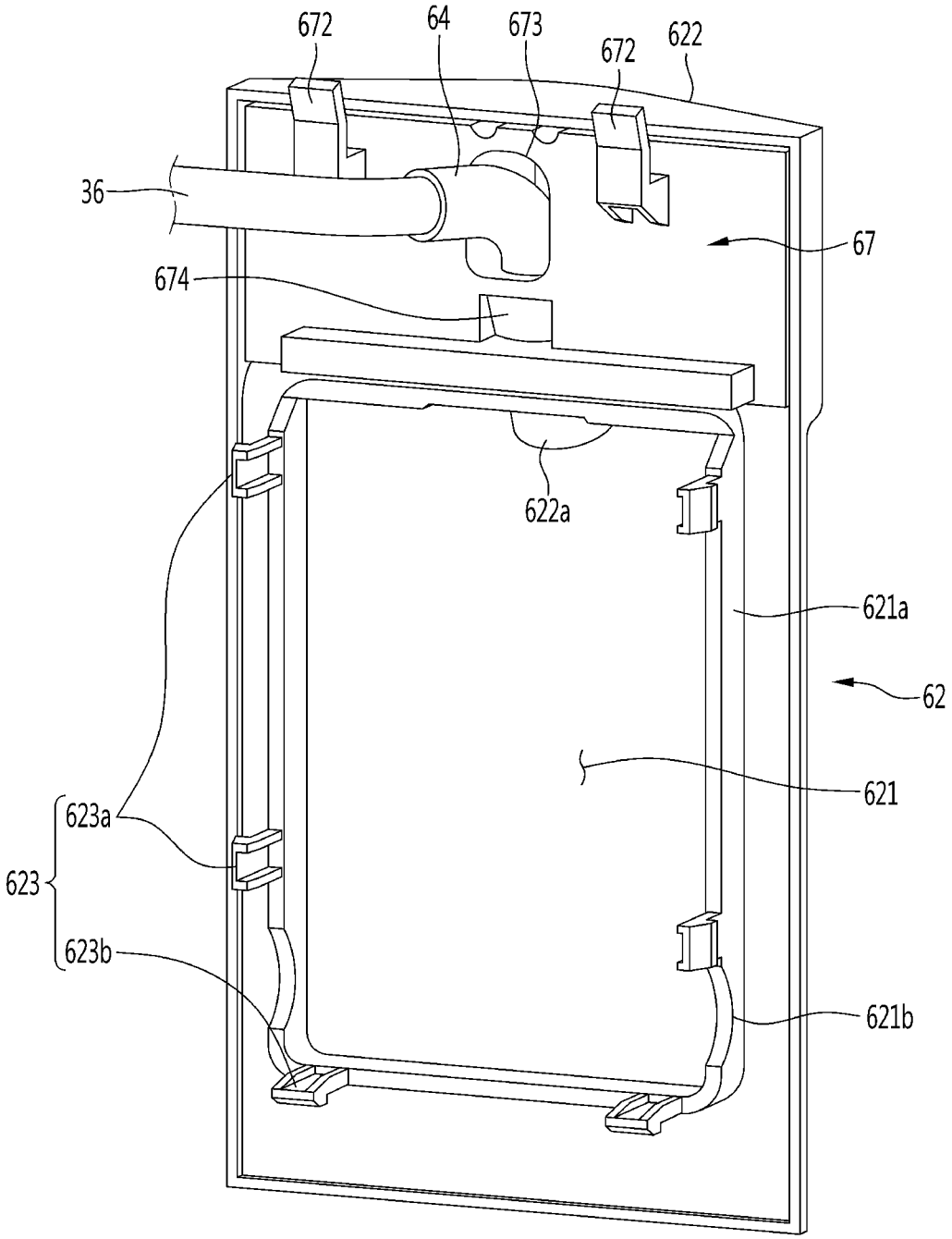
FIG. 31 is a perspective view illustrating a state in which the dispenser cover and the water discharge tube guide are coupled to each other.

With reference to FIG. 27, the rotation coupling portion 617 may be provided inside the dispenser case 61 to protrude inward from a lower end of left and right surfaces. At least a portion of the rotation coupling portion 617 may be opened toward an inside of the refrigerator 1. When the manipulation member 63 is mounted on the dispenser case 61, the manipulation member rotation portion 635 may be press-fitted into the opened side of the rotation coupling portion 617. When the manipulation member rotation portion 635 is inserted into the rotation coupling portion 617, the manipulation member rotation portion 635 may be maintained in a restricted state, and the manipulation member 63 may rotate or pivot with respect to a an axis at the manipulation member rotation portion 635.

Figure 35:
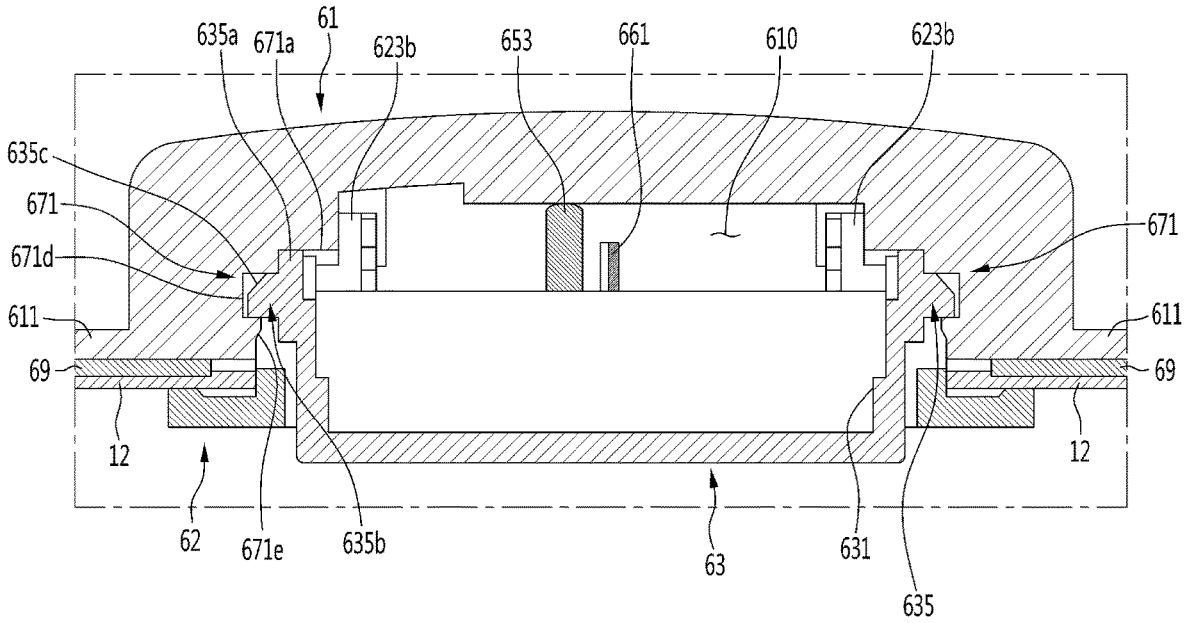
FIG. 35 is a cross-sectional view taken along line 35-35' of FIG. 26.
Figure 36:
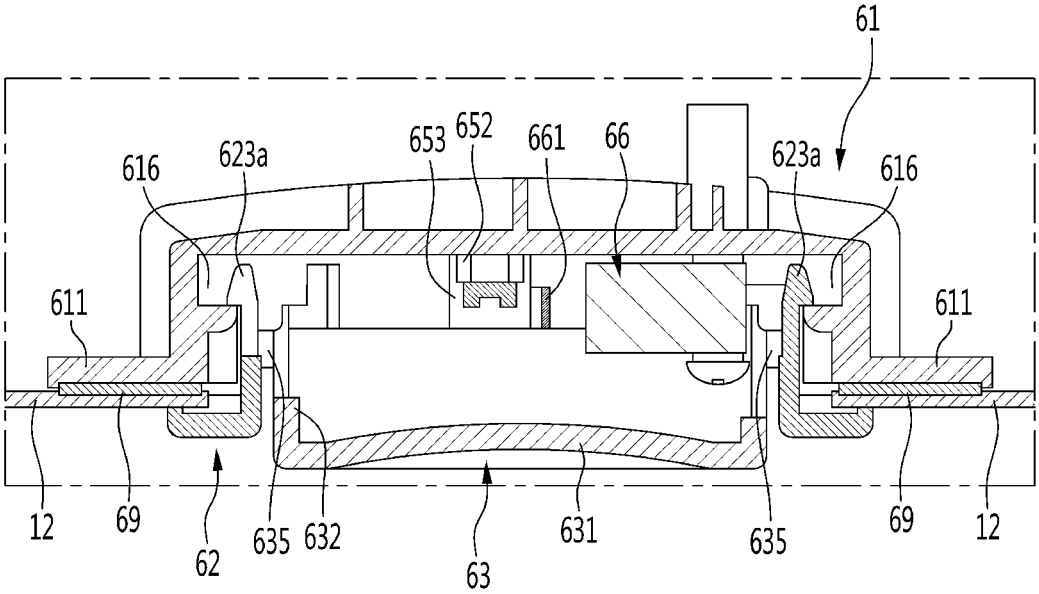
FIG. 36 is a cross-sectional view taken along line 36-36' of FIG. 26.
Figure 37:
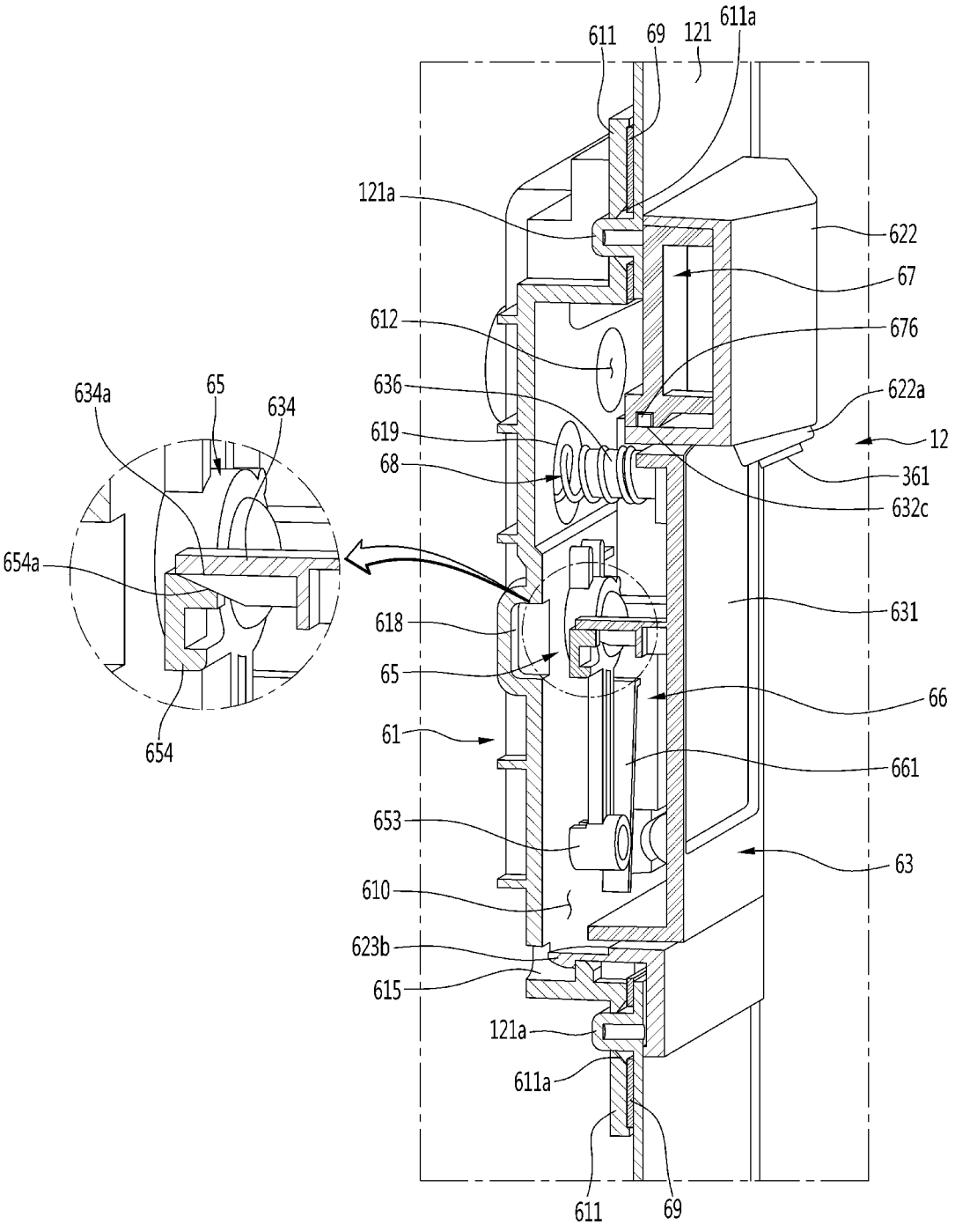
FIG. 37 is a cutaway perspective view taken along line 37-37' of FIG. 26.

Referring to FIGS. 27 and 35, the rotation coupling portion 617 may include a base seating portion or recess 671*a* on which the shaft base 635*a* is seated and a protrusion seating portion or recess 671*d* which is provided outside the base seating portion 671*a* and on which the rotation protrusion 635*b* is seated. The base seating portion 671*a* and the protrusion seating portion 671*d* may communicate with each other and may be stepped in shapes corresponding to each other to support outer surfaces of the shaft base 635*a* and the rotation protrusion 635*b*, respectively.

A base restriction portion or rib 671*c* extending to surround a portion of the shaft base 635*a* may be provided on the base seating portion 671*a*. The base restriction portion 671*c* may be rounded to surround a circumference of the shaft base 635*a* seated on the base seating portion 671*a* and may protrude from each of upper and lower ends of the base seating portion 671*a*. The base restriction portions 671*c* at upper and lower ends may be vertically spaced apart from each other. When the manipulation member 63 is mounted, the shaft base 635*a* may be spaced a predetermined or set distance, by which the shaft base 635*a* is insertable, from the manipulation member 63.

The protrusion seating portion 671*d* may be provided with a protrusion restriction portion 671*b* extending to surround a portion of the rotating protrusion 635*b*. The protrusion restriction portion 671*b* may be rounded to surround a circumference of the rotation protrusion 635*b* seated on the protrusion seating portion 671*d* and may protrude from each of upper and lower ends of the protrusion seating portion 671*d*. The protrusion restriction portions 671*b* at upper and lower ends may be vertically spaced apart from each other. When the manipulation member 63 is mounted, the rotation protrusion 635*b* may be spaced a predetermined or set distance, by which the rotation protrusion 635*b* is insertable, from the manipulation member 63.

A restriction portion inclined surface 671*e* contacting an extending end of the rotation protrusion 635*b* may be provided between the protrusion restriction portions 671*b*. The restriction portion inclined surface 671*e* may be provided at a position facing the protrusion inclined surface 635*c*, and when the manipulation member 63 is mounted, the protrusion inclined surface 635*c* and the restriction portion inclined surface 671*e* may move while contacting each other so that the rotation protrusion 635*b* is press-fitted into the protrusion seating portion 671*d*.

Referring back to FIGS. 34-37, when the manipulation member 63 is inserted into the accommodation space 610, the manipulation member rotation portion 635 may be seated on the rotation coupling portion 617 (FIG. 27). When the dispenser cover 62 is mounted, the edge groove 621*b* defined in the dispenser cover 62 may surround the exposed portion of the manipulation member rotation portion 635 to prevent the manipulation member rotation portion 635 from being separated outward from the rotation coupling portion 617. When the user manipulates the manipulation member 63 when fixed inside the dispenser case 61, the manipulation member 63 may be rotatable by using the manipulation member rotation portion 635 as an axis.

A manipulation member restriction portion or protrusion 633 may be provided on the upper end of the manipulation member 63. The manipulation member restriction portion 633 may be a hook, tab, flange, or lip that protrudes upward from a top surface of the manipulation member edge 632. The manipulation member restriction portion 633 may be hooked with an upper end of the cover opening 621. Even when the upper portion of the manipulation member 63 is supported by the elastic member 68, the upper end of the manipulation member 63 may be maintained in the state shown in FIG. 40 without being separated from the cover opening 621. A rear side of the manipulation member restriction portion 633 may include ridges or ribs 633*a*.

The elastic member mounting portion 636 protruding toward the inside of the dispenser case 61 may be provided on the inner surface of the manipulation member 63, and the elastic member 68 may be mounted on the elastic member mounting portion 636. The elastic member mounting portion 636 may be provided on the top end of the manipulation member 63 or an upper portion adjacent to the upper end of the manipulation member 63. The elastic member mounting portion 636 may be provided at an intermediate or central point or area of the manipulation member 63 with respect to the horizontal or left-right direction.

The elastic member 68 may be supported by the elastic member mounting portion 636 and the elastic member accommodation portion 619, and when the manipulation member 63 is pressed or pushed, the elastic member 68 may be pressed and compressed. When a pressing or pushing of the manipulation member 63 is stopped or released, the manipulation member 63 may return to its original position by a restoring force of the elastic member 68.

The elastic member mounting portion 636 may include a mounting boss 636*a* extending from the inner surface of the manipulation member 63 and a support rib 636*b* protruding from an outer surface of the mounting boss 636*a*. The mounting boss 636*a* may be provided in a cylindrical shape having a diameter at which the mounting boss 636*a* is insertable into an opened end of the elastic member 68. The mounting boss 636*a* may extend toward the elastic member accommodation portion 619. The elastic member mounting portion 636 may be inserted into an opened end of the elastic member 68.

The support rib 636*b* may support an end of the elastic member 68. There may be a in plurality of support ribs 636*b* arranged circumferentially around the elastic member mounting portion 636. The support rib 636*b* may extend from the inner surface of the manipulation member 63 along the elastic member mounting portion 636 and may extend outward from the outer surface of the elastic member mounting portion 636. The support rib 636*b* may be thicker (i.e., extend further outward) at a position farther from an extending end of the elastic member mounting portion 636. When the elastic member mounting portion 636 is inserted into the elastic member 68, an end of the elastic member 68 may be supported by an end of the support rib 636*b*.

The other end of the elastic member 68 may be received in and supported by the elastic member accommodation portion 619 of the dispenser case 61. When the manipulation member 63 is pressed to rotate in a rearward or first direction, the elastic member 68 may be pressed. When the manipulation member 63 is released after being pressed, the manipulation member 63 may rotate in a reverse or second direction by the restoring force of the elastic member 68, and the manipulation member restriction portion 633 may be stopped before contacting the dispenser cover 62.

The manipulation protrusion 634 protruding toward the dispenser case 61 may be provided on the inner surface of the manipulation member 63. The manipulation protrusion 634 may extend rearward and downward from the inner surface of the manipulation member 63 to contact a lever contact portion 654*a* (FIG. 38) of the rotating arm 654 of the rotation lever 65. The manipulation protrusion 634 may extend from a position facing the protrusion accommodation groove 618 toward the protrusion accommodation groove 618.

A protrusion contact portion 634*a* configured to contact the lever contact portion 654*a* may be provided on an end of a lower side of the manipulation protrusion 634. The protrusion contact portion 634*a* may be provided to be inclined or rounded upward as the manipulation protrusion 634 extends. As the upper end of the manipulation member 63 rotates toward the inside of the dispenser case 61, the protrusion contact portion 634*a* may gradually push the lever contact portion 654*a*, and the rotation lever 65 may rotate.

Figure 38:
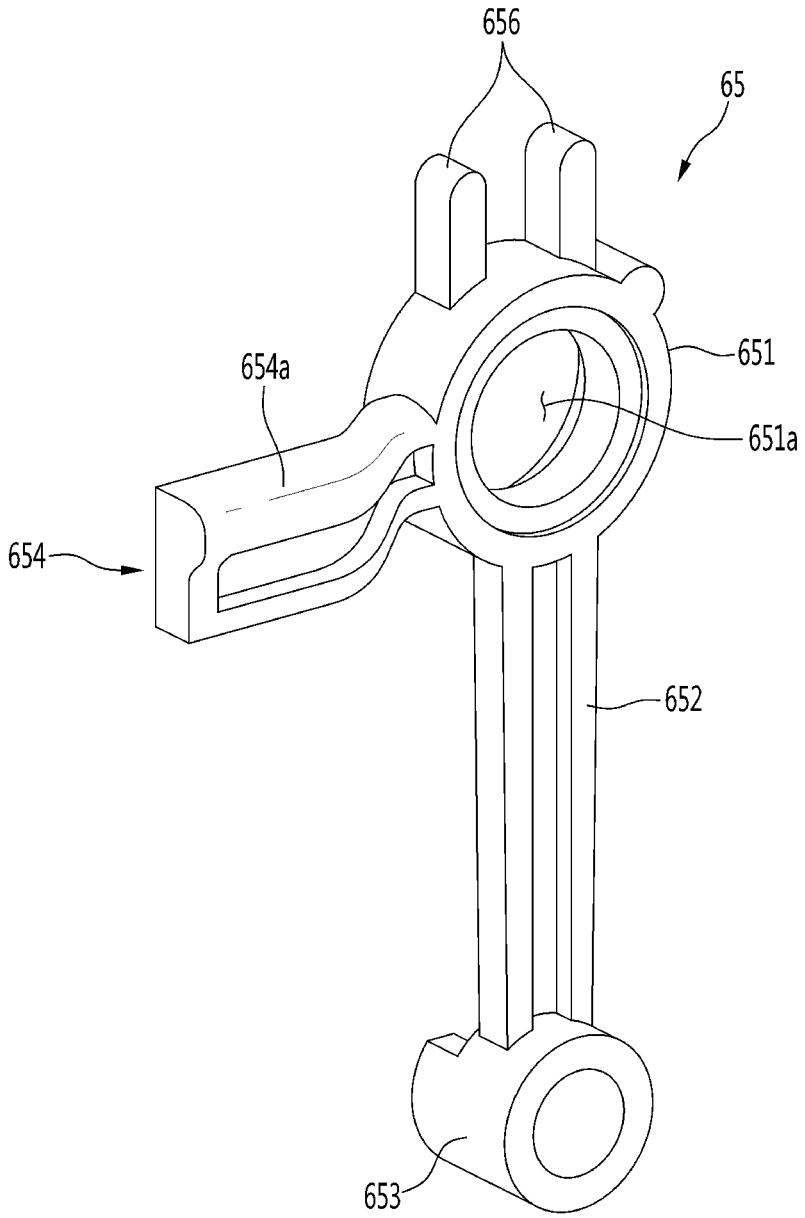
FIG. 38 is a perspective view of a rotation lever that is one component of the dispenser.

Referring to FIG. 38, the rotation lever 65 may include a lever center 51 axially coupled to the dispenser case 61, a push arm 652 extending downward from the lever center 651, and a rotating arm 654 extending from the lever center 651 in a direction crossing the push arm 652. The lever center 651 may be a portion or area that serves as a rotation center of the rotation lever 65 and be rotatably coupled to the rotation boss 618*b* of the dispenser case 61. A center hole 651*a* having a circular shape may be defined in a center of the lever center 651, and an inner surface of the center hole 651*a* may be stepped so that the rotation boss 618*b* may be seated when inserted. The screw 657 may be inserted when the lever center 651 is seated on the rotation boss 618*b* so that the lever center 651 may be rotatably fixed to the rotation boss 618*b*.

The push arm 652 may extend downward from a lower end of the lever center 651. The push arm 652 may extend parallel to the switch 66 (FIG. 34), and an end of the push arm 652 may extend up to a lower portion of the switching part 661 (FIG. 27).

The pushing part 653 may be provided on an extending end of the push arm 652. The pushing part 653 may turn the switch 66 on and off by pressing the switching part 661 according to a rotation of the lever center 651. The pushing part 653 may be provided in a cylindrical shape, and a circumferential surface of the pushing part 653 may contact the switching part 661.

Referring to FIGS. 27 and 38, the push arm 652 may rotate as the rotation lever 65 rotates by the manipulation of the manipulation member 63, and the pushing part 653 may push the switching part 661 to input a signal to the switch 66. When the manipulation member 63 returns to an initial or original position upon a restoring force of the elastic member 68, the rotation lever 65 may also return to an original or initial position. The rotation lever 65 may return to an initial position by the restoring force of the switching part 661, which may have a plate spring shape. Even before a manipulation of the manipulation member 63, the pushing part 653 and the switching part 661 may be maintained to contact each other.

The stopping part 656 may protrude in a direction opposite to the extension direction of the push arm 652 (i.e., upward). The stopping part 656 may rotate as the rotation lever 65 rotates. The stopping part 656 may be provided at a side of the stopper 610*a*, and the stopping part 656 and the stopper 610*a* may interfere with each other to limit a rotation of the rotation lever 65.

The stopper 610*a* may limit a rotation of the rotation lever 65 in a direction away from the switching part 661. When the manipulation member 62 is pressed in a rearward direction, a rotation away from the switching part 661 may be restricted, while a rotation toward the switching part 661 may be allowed and facilitated by a placement of the rotating arm 654 at a side of the lever center 651 opposite to a side at which the switching part 661 is provided. The rotating arm 654 may be pressed downward by a downward movement of the manipulation protrusion 634. A rotation of the rotation lever 65 may be exemplified by the arrows in FIG. 42, and a corresponding pivot or rotational movement of the manipulation member 63 may be exemplified by the arrows in FIG. 43. After manipulation of the manipulation member 63, a restoring force of the switching part 661 may rotate the rotation lever 65 in a reverse direction, and the stopping part 656 and the stopper 610*a* may contact each other to stop a further rotation of the rotation lever 65 via inertia beyond the initial position.

The rotating arm 654 may be provided at a side (e.g., left side in FIGS. 27 and 38) of the lever center 651. The rotating arm 654 may extend from an outer surface of the lever center 651 in a direction perpendicular to the push arm 652 and may contact the manipulation protrusion 634. The rotating arm 654 may extend in a direction away from the switch 66. The rotating arm 654 may extend from a position adjacent to the lever center 651 and be bent or curved inward toward the inside of the refrigerator 1 to facilitate a smooth contact with the manipulation protrusion 634.

The lever contact portion 654*a* may be provided on a top surface of the rotating arm 654. The lever contact portion 654*a* may be a portion contacting the manipulation protrusion 634 and may be inclined or rounded at an edge between top and front surfaces of the rotating arm 654. An upper portion of the rotating arm 654, on which the lever contact portion 654*a* is provided, may be thicker than a remaining portion of the rotating arm 654 and protrude toward the manipulation protrusion 634 to more smoothly contact the protrusion contact portion 634*a*.

Figure 39:
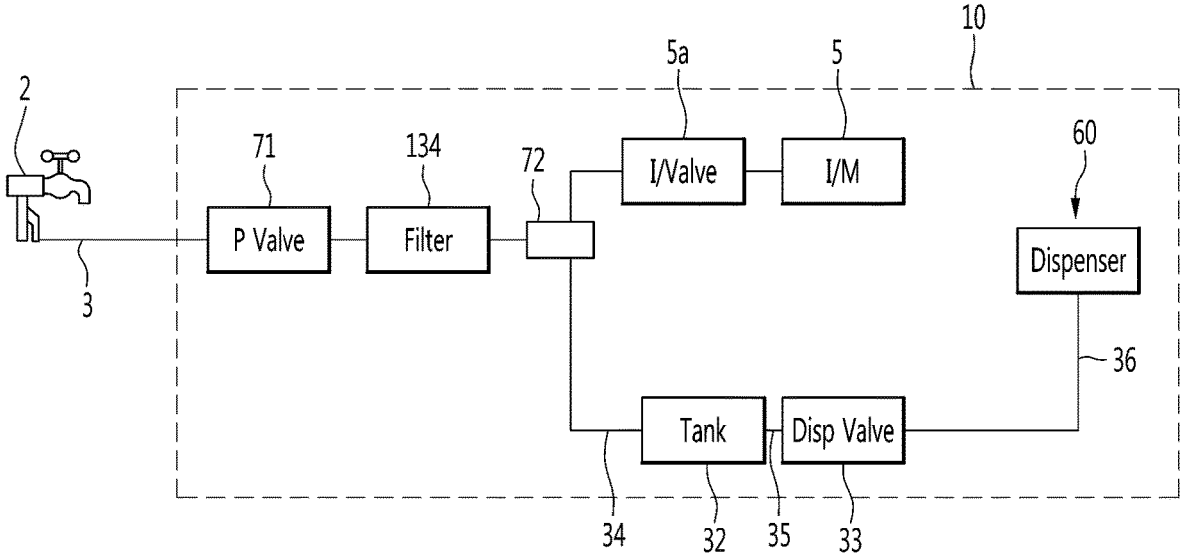
FIG. 39 is a schematic view illustrating a configuration of a water supply passage of the refrigerator.

Referring to FIGS. 2 and 39, water or liquid supplied from the supply source 2 may be supplied into the tank 32 within the cabinet 10 by being connected to the refrigerator 1 via the supply passage 3. Water supplied through the supply passage 3 may first pass through the supply valve 71 and may be guided to the filter 134 by turning the supply valve 71 on and/or opening the supply valve 71. A flow meter may be provided in the supply valve 71 or between the supply valve 71 and the filter 134.

The water supplied from the supply valve 71 to the filter 134 may be purified or filtered by the filter 134 to be drinkable for humans. The filtered water may be supplied to the ice maker 5 ("I/M" in FIG. 39) and the tank 32 through the branch valve 72 provided at a side of the cabinet 10. Alternatively, a branch tube instead of the branch valve 72 may be provided. The ice maker 5 may be optional, and when the ice maker 5 is not provided, the water purified by the filter 134 may flow directly to the tank 32, and the branch valve 72 may be omitted.

An ice maker valve 5*a* ("I/Valve" in FIG. 39) may be provided between the branch valve 72 and the ice maker 5.

When water is required in the ice maker 5 to make ice, the water supplied from the filter 134 may be supplied to the ice maker 5 via the branch valve 72 and the ice maker valve 5*a*, which may be on or opened.

The water supplied from the filter 134 may be supplied to the tank 32 through the supply tube 34. The tank 32 may store liquid before being dispensed via the dispenser 60. A set or predetermined amount of water may be stored in the tank 32. Such an amount may be configured to dispense a predetermined or set amount of dispensing water several times to the dispenser 60. The tank 32 may be provided inside the refrigerating compartment 101 so that the liquid or water stored in the tank 32 may be cooled, and the dispenser 60 may dispense cooled liquid at any time.

The liquid in the tank 32 may be directed to the dispenser valve 33 ("Disp Valve" in FIG. 39) through the connection tube 35. When the user manipulates the dispenser 60, the dispenser valve 33 may be opened or turned on, and water may be provided through the discharge tube 36 connecting the dispenser valve 33 to the dispenser 60.

To manipulate the dispenser 60, the user may open the refrigerating compartment door 21, and when the refrigerating compartment door 21 is opened, the dispenser 60 provided on the inclined surface 121 of the sidewall of the refrigerating compartment 101 may be opened to facilitate access to the dispenser 60. The user may dispense water for drinking or another purpose by pressing the manipulation member 63 of the dispenser 60 by using the cup 6 (FIG. 43) or another container.

Figure 40:
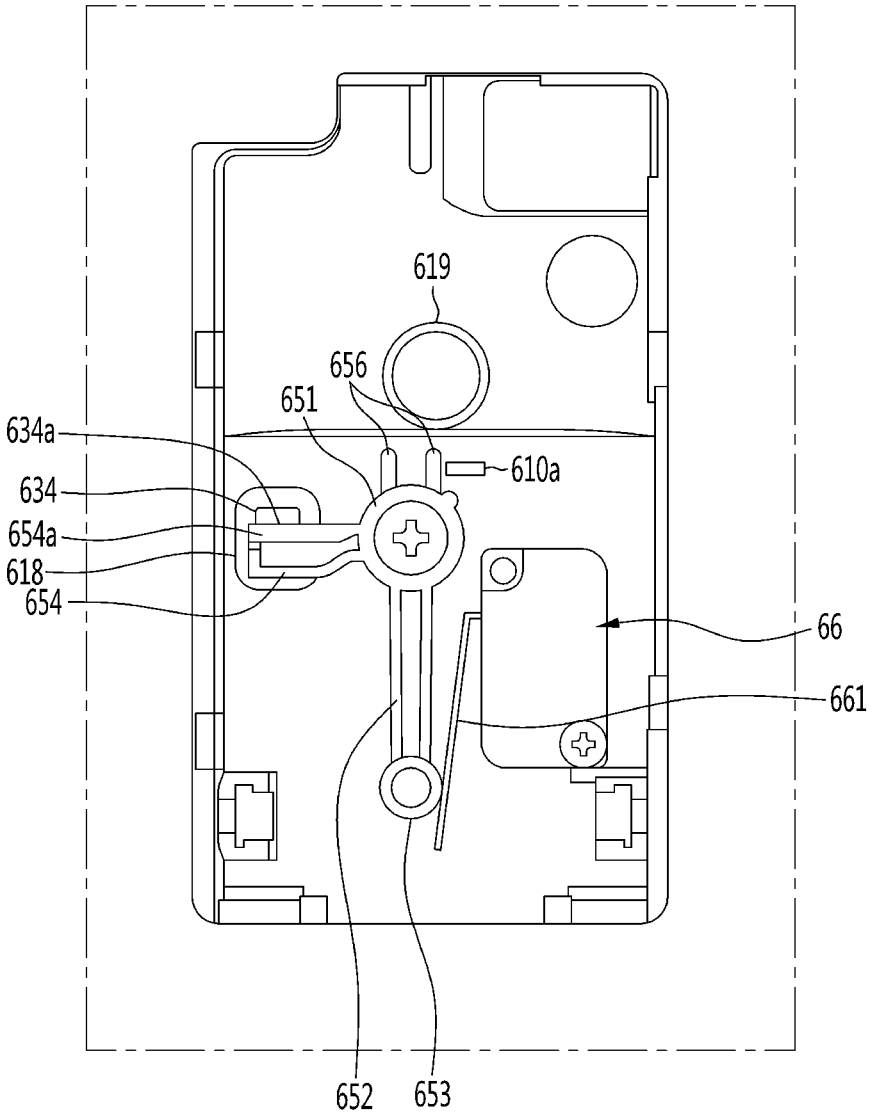
FIG. 40 is a front view illustrating a state of the inside of a housing of the dispenser before the dispenser is manipulated.
Figure 41:
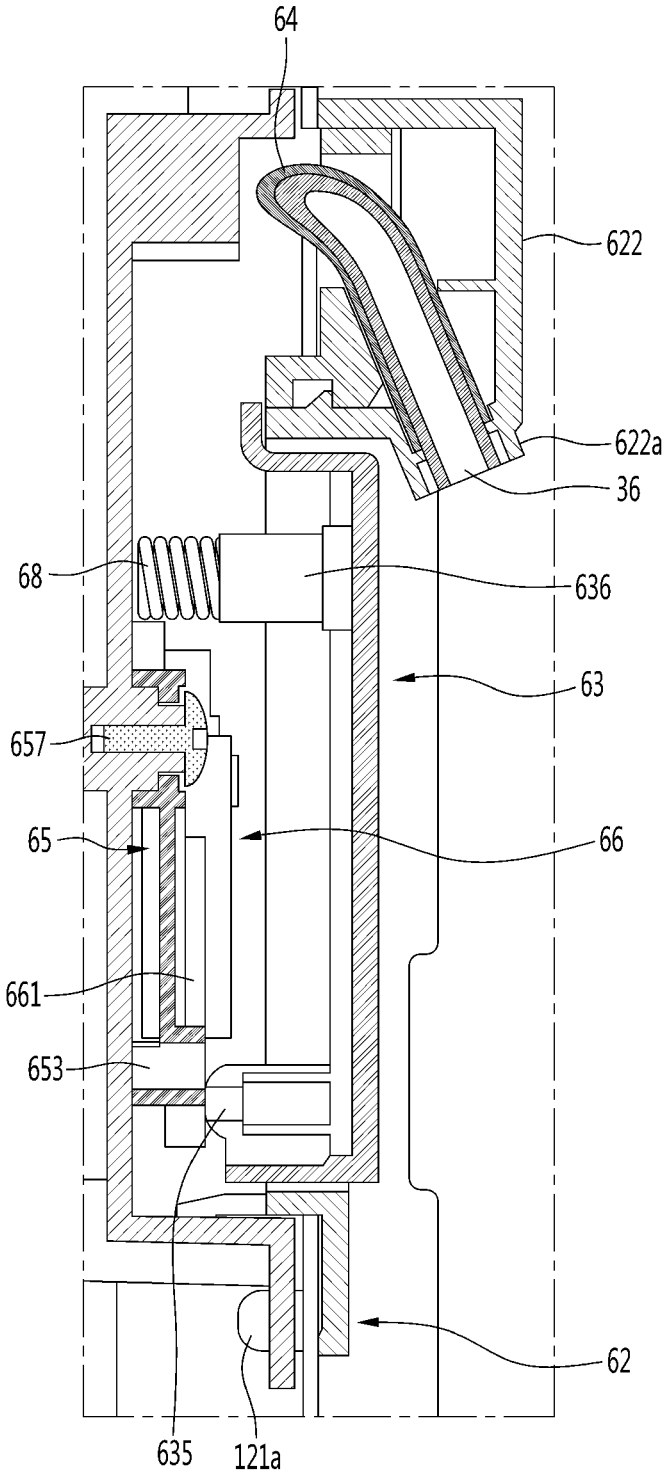
FIG. 41 is a cross-sectional view illustrating a state of a manipulation member before the dispenser is manipulated.

Referring to FIGS. 40-41, in a standby or initial state before the user manipulates the dispenser 60, the manipulation member 63 may be maintained in a non-rotated or standby state. The outer surface of the manipulation member 63, which may be exposed to the inside of the refrigerator 1, may be parallel to the inner case 12 and the dispenser cover 62.

The manipulation member 63 may protrude toward an inside of the refrigerator 1 through the cover opening 621. The manipulation member restriction portion 633 may be in a state contacting the upper end of the cover opening 621, and the elastic member 68 may support the manipulation member 63.

Before the manipulation member 63 is manipulated, the rotation lever 65 may be in a non-rotated state. The pushing part 653 of the push arm 652 may contact the switching part 661 of the switch 66, but may not apply a significant force. The stopping part 656 may contact or be close to contacting the stopper 610*a* so that a reverse direction (clockwise direction in FIG. 40) is restricted. The manipulation protrusion 634 may be maintained when the rotation lever 65 does not rotate, as no external force may be applied to the rotation lever 65 such a state.

To dispense liquid, the may press a cup 6 against the manipulation recess portion 631 of the manipulation member 63. Since an end of the discharge tube 36 may be provided on the cover upper portion 622, the user may naturally tilt the cup 6 against the upper portion of the manipulation member 63, which may be close to the exposed end of the discharge tube 36, and then press the cup 6. The rotation lever 65 may be rotated in a counterclockwise direction (in FIG. 40), and the push part 653 may press on the switching part 661 to send a signal (e.g., a dispensing signal), which may be a signal to turn on or open the dispensing valve 33.

Figure 42:
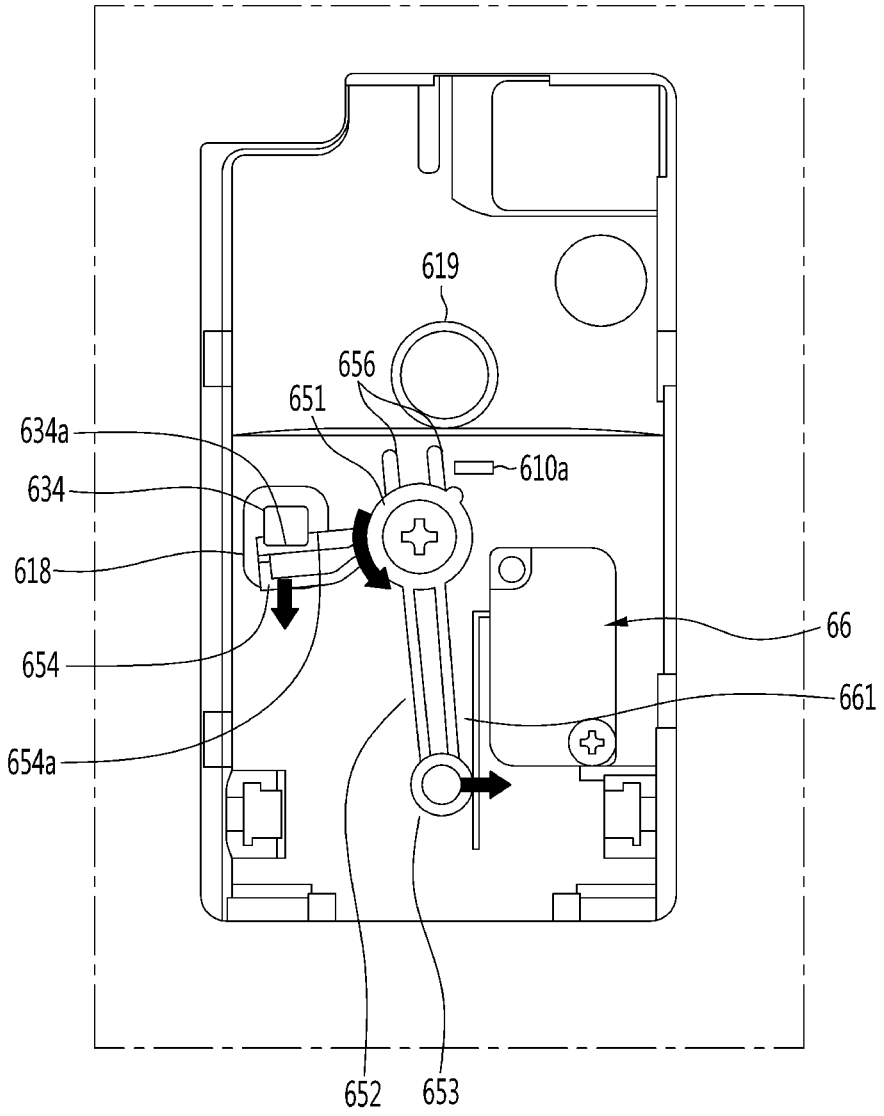
FIG. 42 is a front view illustrating a state of the inside of the housing of the manipulated dispenser.

Referring to FIGS. 42-43, when the user presses the cup 6 against the manipulation recess portion 631, a top of the manipulation member 63 may pivot inward away from the user. With respect to FIG. 43, the manipulation member 63 may rotate counterclockwise about the manipulation member rotation portion 635.

The elastic member 68 may be compressed according to the rotation of the manipulation member 63, and the manipulation protrusion 634 may move downward toward the protrusion accommodation groove 618. As the manipulation protrusion 634 approaches the protrusion accommodation groove 618, the rotating arm 654 of the rotation lever 65 may be pushed downward to rotate the rotation lever 65.

When the manipulation protrusion 634 moves inside the dispenser case 61 by the rotation of the manipulation member 63, the protrusion contact portion 634*a* of the manipulation protrusion 634 may push the lever contact portion 654*a* of the rotating arm 654. As the manipulation protrusion 634 further moves inside the dispenser case 61, the lever contact portion 654*a* may be pushed downward by the inclination or round section of the protrusion contact portion 634*a* and the lever contact portion 654*a*.

As the manipulation protrusion 634 gradually moves toward the dispenser case 61, the rotating arm 654, the rotation lever 65, and the push arm 652 may rotate counterclockwise in FIG. 42. Here, the manipulation protrusion 634 may be inserted into an inside of the protrusion accommodation groove 618.

The pushing part 653 may laterally push the switching part 661, and a signal may be input to the switch 66 by the movement of the switching part 661. The dispenser valve 33 may be opened by the signal input of the switch 66, and water may be dispensed to the cup 6 through the discharge tube 36. The discharge tube 36 may be inclined obliquely toward the center of the cup 6, and the upper end of the manipulation member 63 may be inclined toward the inside of the dispenser case 61. The end of the discharge tube 36 may be more easily directed toward the center of the cup 6, and water may be effectively and conveniently dispensed even when the protruding distance of the protruding end of the dispenser 60 in which the end of the discharge tube 36 is provided is minimized or reduced.

When a desired amount of water is dispensed to the cup 6, the user may remove the cup 6 from the manipulation member 63. When an external force applied to the manipulation member 63 is removed, the elastic member 68 may be restored to an initial state, and the manipulation member 63 may rotate or pivot clockwise in FIG. 43 by the elastic force of the elastic member 68. The rotation lever 65 may rotate in the reverse direction (clockwise in FIG. 42) by the elastic force of the switching part 661.

The manipulation member 63 may be stopped after rotating in the reverse direction until the manipulation member restriction portion 633 contacts the upper end of the cover opening 621, and the rotation lever 65 may be stopped after rotating in the reverse direction until the stopping part 656 contacts the stopper 610*a*. When the manipulation member 63 and the rotation lever 65 completely rotate in the reverse direction, the dispenser 60 may be in the state as illustrated in FIGS. 40 and 41 and be maintained the standby state until the dispenser 60 is manipulated.

The refrigerator according to the embodiment may have the following effects. According to an embodiment, a dispenser may be provided on one wall surface within the refrigerator and also provided between the shelf and another shelf so that the configuration of the sidewall surface within the refrigerator is harmonized.

A dispensing tube may discharge water or liquid in an inclined direction and have a structure that does not excessively protrude to prevent a poor outer appearance and interference with stored food. The dispenser may be provided on the inclined portion defining the front end within the refrigerator to prevent interference when the food is stored in an accommodation or storage space within the refrigerator and also prevent interference with food stored in a door basket when the door is opened and/or closed. A central portion of a dispenser cover may protrude, and both the sides of the central portion may be inclined to prevent interference when the door is opened and closed while easily dispensing the water.

In the dispenser, a lower end of a manipulation member may be axially coupled so that an upper portion of the manipulation member rotates, and the end of the dispensing tube through which the water is dispensed may be provided to be inclined to the outside to provide a structure in which a pushing operation is effectively performed, so that water may flow to a center of the cup, thereby improving the use convenience.

The dispenser may be provided on an opened front end within the refrigerator or an inclined portion to allow the user to be easily accessible and also be provided on the inclined portion that is inclined so that the dispenser is inclined to face the user for convenient use and access. A water tank assembly or tank assembly may be provided on edges of the one sidewall surface, the rear wall surface, and the bottom surface within the refrigerator. The dispenser may be provided on a same one sidewall surface within the refrigerator so that the water tank assembly and the dispenser are connected to each other at a shortest distance, thereby realizing an efficient passage arrangement.

A tube guide guiding a water discharge tube connecting the water tank assembly to the dispenser may be provided between an inner case and a outer case, which may constitute a cabinet, to more conveniently realize a passage connection operation and the service. The tube guide may be provided to be embedded in an insulation material and also be provided so that a support member may be provided on both the sides of the tube guide. The tube guide may be spaced a constant from the outer case and the inner case. There may be no need to provide a complicated passage arrangement, an assembling workability may be improved, and a volume loss within the refrigerator may be prevented. The water within the water discharge tube passing through the tube guide may be prevented from being changed in temperature, and the insulation performance of the cabinet may be constantly maintained. Even though a foaming solution may be injected for injecting the insulation material, the tube guide may be further fixed by the arrangement of the support member without being separated.

The water tank assembly may be provided on the edges of the one sidewall surface, the rear wall surface, and the bottom surface within the refrigerator and be covered by a drawer provided in the lower portion of the refrigerator to prevent the outer appearance of the water tank assembly from being deteriorated due to the exposure of the water tank assembly.

The water tank assembly may be adjacent to the rear wall surface so that the water supply tube passing through the cabinet from the rear side of the cabinet also faces the water tank assembly at the shortest path. Since the water supply tube and the water discharge tube, which may be connected to the water tank assembly, may be accessible through the edge regions of the side surface, the rear surface, and the bottom surface of the inner case, an arrangement and connection of the tubes connected to the water tank assembly may be easily performed.

The water tank assembly may be configured so that the water tank and a dispenser valve are mounted on the tank cover and may have a structure in which the tank cover is coupled to the inner case. A coupling structure with the inner case may be minimized, and an assembling operation within the refrigerator may be easily performed using a modularized water tank assembly. The tubes that are accessible through the inner case may be covered by the tank cover provided on the edge of the inner case, and a structure that is capable of covering the water tank and the dispenser valve may be provided to realize a concise and neat arrangement within the refrigerator.

Embodiments disclosed herein may provide a refrigerator that is capable of preventing an outer appearance thereof from being inhibited in a state in which a dispenser is provided on a sidewall within the refrigerator. Embodiments disclosed herein may also provide a refrigerator in which a dispenser within the refrigerator does not interfere with storage of food and opening/closing of a door. Embodiments disclosed herein also provide a refrigerator in which a dispenser provided in the refrigerator is improved in use convenience.

Embodiments disclosed herein may provide a refrigerator having an arrangement structure that facilitates connection of a passage tube to supply water such as a water tank and a valve, which may be provided within the refrigerator. Embodiments disclosed herein may provide a refrigerator in which a water tank within the refrigerator and a dispenser provided in a sidewall within the refrigerator are connected to each other at the shortest distance, and a stable passage arrangement structure may be provided. Embodiments disclosed herein may also provide a refrigerator in which an arrangement of a passage connecting a water tank within the refrigerator to a dispenser provided in a sidewall within the refrigerator may be easily realized.

Embodiments disclosed herein may be implemented as a refrigerator having a water tank assembly or tank provided inside the refrigerator, a dispenser provided on one surface of both side surfaces within the refrigerator, and a tube guide that guides a water discharge tube connecting the water tank assembly to the dispenser and provided between an inner case and an outer case so as to be exposed to the inside of the refrigerator. The water tank assembly may be provided between a drawer provided within the refrigerator and a rear wall surface within the refrigerator so as to be covered by the drawer.

The dispenser may be provided between a plurality of shelves provided within the refrigerator and be provided at the same intervals from the shelves. The dispenser may minimize or reduce a protruding distance of the dispenser by allowing an end of a discharge tube, through which water is discharged, to be inclined.

The dispenser may be provided on an inclined portion of a front end of the inner case defining a circumference or outer surface within the refrigerator and further protrude backward from a door dike protruding from a rear surface of the door to prevent the dispenser from interfering when the door is opened and closed. The dispenser may be provided between door baskets or door shelves so as to be prevented from interfering with the door baskets when the door is opened and closed.

The dispenser may protrude up to an outer surface of the door basket to minimize or reduce an interference between the dispenser and stored food. A central portion at which a dispensing tube of the dispenser is provided may protrude and be inclined so as to be lower toward both sides to prevent an interference when the door is opened and/or closed while securing the disposition of the dispensing tube.

A lower end of a manipulation member may be axially coupled to the dispenser provided on the sidewall within the refrigerator, and an end of the dispensing tube may be provided to be inclined above the manipulation member to minimize a protruding distance of the dispenser so that the dispensed water flows to a central portion of a cup. A rotation axis of the manipulation member may be spaced backward to secure a rotation distance of an upper end of the manipulation member.

The dispenser may be provided on the inclined portion so as to be inclined to face a user, thereby facilitating user access. The dispenser may be provided on one surface within the refrigerator, and the water tank assembly may be provided on the one surface and edges of rear and bottom surfaces so that tubes connected to the water tank assembly are easily accessible through the side and rear surfaces and easily connected to the water tank assembly.

The water tank and a dispenser valve may be coupled to a tank cover, and the tank cover may be mounted inside the refrigerator in a modular state in which the tank cover is coupled to the water tank and the dispenser valve. The tubes passing through the inner case and the structure for guiding the tubes may be covered by the tank cover.

The dispenser may be provided on one surface within the refrigerator, and the water tank assembly may be provided within the refrigerator, which may be adjacent to the one surface. The water discharge tube connecting the dispenser to the water tank assembly may be guided through a tube guide connecting the dispenser to the one surface on which the water tank assembly is provided, and an arrangement and connection of the water discharge tube may be easily performed. The tube guide may be provided to be embedded in an insulation material inside a cabinet. A support member supported on the outer case and the inner case may be provided at both sides of the tube guide to allow the tube guide to be maintained at a certain distance from the outer case and the inner case.

Embodiments disclosed herein may be implemented as a refrigerator comprising a cabinet including an outer case configured to define an outer appearance thereof, an inner case configured to define a storage space, and an insulation material configured to be filled between the outer case and the inner case, a door configured to open and close the storage space, a water tank assembly provided inside the storage space, a rear guide which is provided on a rear wall of the cabinet and through which a water supply tube configured to supply water from an external water supply source to the water tank assembly is accessible, a dispenser mounted on one side surface of left and right surfaces within the storage space, the dispenser being configured to dispense water by user's manipulation, and a tube guide embedded by the insulation material between the inner case and the outer case. The tube guide may be configured to define a passage configured to guide a water discharge tube configured to connect the water tank assembly to the dispenser inside the cabinet.

The water tank assembly may be provided on an edge defined by rear and bottom surfaces of the storage space and a side surface, on which the dispenser is provided, of the storage space. The water tank assembly may be provided to contact one sidewall, on which the dispenser is provided, of left and right sidewalls of the storage space.

The refrigerator may further include a drawer provided to be insertable and withdrawable. The water tank assembly may be provided between the drawer and the rear wall surface of the storage space.

The tube guide may include an inner case-side coupling portion provided on an opened one end of the tube guide to communicate with one side surface of the inner case, on which the water tank assembly is provided, and a dispenser-side coupling portion provided on the other opened end of the tube guide to communicate with the dispenser. An inner case-side coupling portion may include an opening insertion portion passing through the inner case defining the side surface of the storage space to protrude into the storage space, and an opening support portion protruding along a circumference of the opening insertion portion, the opening support portion being in close contact with an outer surface of the inner case.

The dispenser may include a dispenser case mounted on an outer surface of the inner case to communicate with a dispenser opening that is opened in the inner case. The dispenser-side coupling portion may be inserted into the dispenser case.

A coupling protrusion protruding outward may be provided on an end of the dispenser-side coupling portion, a guide insertion portion into which the dispenser-side coupling portion is inserted may be provided in the dispenser case, and a coupling groove coupled to the coupling protrusion may be defined in the guide insertion portion. A plurality of tube protrusions that protrude along a circumference of the tube guide to extend in an extension direction of the tube guide may be provided on the tube guide.

A support member configured to contact each of the inner case and the outer case so that the tube guide is maintained to be spaced a predetermined distance from each of the inner case and the outer case inside the cabinet may be provided on each of both sides of the tube guide. A support member mounting portion protruding outward and having a flat shape to provide a mounting surface of the support member may be provided on the tube guide. The support member mounting portion may be provided at each of positions that respectively face the outer case and the inner case.

The water tank assembly may include a water tank in which water or liquid supplied to the dispenser is stored, a dispenser valve connected to the water tank to decide supply of the water to the dispenser, and a tank cover configured to cover the water tank and the dispenser valve. The tank cover may have an opened rear surface to define a space in which the water tank and the dispenser valve are accommodated therein, and the opened rear surface of the tank cover may be covered by a rear surface of the inner case. The tank cover may be mounted on the inner case in a state in which the water tank and the dispenser are mounted on the tank cover.

The refrigerator may further include an upper end restriction portion protruding to a rear surface of the inner case to contact an upper end of the tank cover so as to restrict vertical movement of the water tank, and a lower end restriction portion protruding to a bottom surface of the inner case to contact a front end of a bottom surface of the tank cover so as to restrict forward and backward movement of the water tank. A cooling air collection hole through which air within the storage space returns to an evaporator may be defined in the protruding top surface of the lower end restriction portion.

The refrigerator may further include a side opening defined in a side surface of the inner case, the side opening being opened so that an end of the tube guide is inserted, and a rear opening defined in a rear surface of the inner case, the rear opening being opened so that the water supply tube is inserted. The tank cover may be configured to cover all the side opening and the rear opening.

The rear surface of the inner case may include an upper end groove protruding along an upper end of the rear guide to restrict the upper end of the rear guide and a lower end groove protruding along a lower end of the rear guide to restrict the lower end of the rear guide.

The rear guide may include a front part or frame that is in close contact with a rear surface of the inner case, a rear part or frame that is in close contact with a front surface of a back cover configured to define a rear surface of the cabinet, and a guide hole or passage configured to connect or provided between the front part to the rear part. The guide hole may be configured to communicate with the rear opening so that the water supply tube passes through the guide hole.

The storage space may include a freezing compartment provided at a lower side and a refrigerating compartment provided above the freezing compartment. The water tank assembly and the dispenser may be mounted on one side of the inner case defining the refrigerating compartment.

A plurality of shelves may be provided vertically in the refrigerating compartment. The dispenser may be provided between the plurality of shelves and provided at the same interval from the upper shelf and the lower shelf.

A plurality of accommodation members may be provided in the refrigerating compartment. The dispenser may be provided between an opened front end of the refrigerating compartment and a front end of each of the accommodation member.

A door dike protruding to the inside of the storage space along a circumference or surface of the door to support both ends of the door basket may be provided on a rear surface of the door. The dispenser may be mounted between a rear end of the door dike and a front end of an accommodation member within the storage space when the door is closed.

A circumferential surface or inner surface of the inner case may include an inclined portion configured to define a surface facing an outer surface of the door dike, the inclined portion being provided to be inclined, and a straight portion extending from a rear end of the inclined portion in a direction perpendicular to an opened front surface of the storage space. The inclined portion may protrude inward from a front end of the storage space toward a rear side. The dispenser may be mounted on the inclined portion.

The dispenser may be provided to be inclined with respect to an outer surface of the cabinet. A rear end of the dispenser may further protrude than a front end of the dispenser.

The dispenser may include a dispenser case mounted on an outer surface of the inner case, the dispenser being provided at a position corresponding to a dispenser opening through which the inner case passes, a manipulation member rotatably mounted on the dispenser case, the manipulation member being manipulated by a user, and a dispenser cover mounted on the dispenser case to cover an external space of the manipulation member. The inner case may be fixed between a circumferential surface or first surface of the dispenser case and a circumferential surface or first surface of the dispenser cover.

A case fixing protrusion protruding outward may be provided on the inner case. A case fixing hole that is opened so that the case fixing protrusion is inserted may be defined in the dispenser case. The dispenser case may extend outward up to an area that covers the fixing protrusion.

The dispenser cover may include a cover opening in which the manipulation member is accommodated and a cover upper portion protruding upward from the cover opening to guide a water discharge tube from which water is dispensed. The cover upper portion may protrude further than the manipulation member.

The cover upper portion may have a protruding central portion, and the protruding portion may have a height or thickness decreasing toward both sides thereof. A water discharge guide portion into which the water discharge tube, through which the water is dispensed, is inserted and which is inclined away from the inner case as extending downward may be provided in the cover upper portion.

A sleeve made of a metal material may be inserted into the water discharge guide portion. The water discharge tube may pass through the sleeve, and an end of the water discharge tube may further protrude than the water discharge guide portion and an end of the sleeve.

A water discharge tube guide through which the water discharge tube passes may be mounted on the cover upper portion, and a through-hole passing through rear and bottom surfaces of the water discharge tube guide and inclined to correspond to the water discharge guide portion so that the water discharge tube is inserted may be defined in the water discharge tube guide. A manipulation member rotation portion rotatably coupled to the dispenser case to serve as a rotation axis of the manipulation member may be provided on both sides of the extension portion. An extension portion extending backward may be provided on a lower end of the manipulation member.

Embodiments disclosed herein may be implemented as a refrigerator comprising a cabinet including an outer case, an inner case having a storage space therein, and an insulation material provided between the outer case and the inner case, a door configured to open or close the storage space, the door being provided at a front of the cabinet, a tank provided inside the storage space and configured to store liquid, a supply tube coupled to an external supply source and the tank to supply liquid from the external supply source to the tank, a passage penetrating a rear wall of the cabinet and in which the supply tube may be provided, the rear wall being at a rear of the cabinet opposite to the front, a dispenser configured to dispense liquid, the dispenser being provided at the inner case to be accessible from the storage space when the door may be opened, a discharge tube coupled to the dispenser and the tank to supply liquid from the tank to the dispenser, and an outer tube embedded in the insulation material. The discharge tube may be provided in the outer tube.

A tank cover may be configured to cover the tank. The inner case may have a first wall and a second wall. The first and second walls may extend between the rear and the front of the cabinet. The dispenser may be provided at the first wall. The tank cover may contact the first wall.

The inner case may have a first wall and a second wall. The first and second walls may extend between the rear and the front of the cabinet. The dispenser may be provided at the first wall. The tank may be provided adjacent to the first wall. The outer tube may include a first end and a second end and may extend between the first wall and the outer case. The first end may be configured to couple to the first wall at a position adjacent to the tank and where the discharge tube penetrates the first wall to enter the outer tube. The second end may be configured to couple to the first wall at a position adjacent to the dispenser and where the discharge tube penetrates the first wall to enter the dispenser.

The first and second walls may include inner surfaces facing the storage space and outer surfaces facing the outer case. The dispenser may include a dispenser case provided at the outer surface of the first wall. A dispenser opening may be formed through the first wall at a position adjacent to the dispenser case to allow passage of the discharge tube. The second end of the outer tube may be inserted into the dispenser case. The outer tube may include a plurality of protrusions that protrude along an outer surface of the outer tube and extend in an extension direction of the outer tube.

A first support may be provided on an outer surface of the outer tube. The first support may be configured to contact the inner case. A second support may be provided on the outer surface of the outer tube. The second support may be configured to contact the outer case. The first and second supports may maintain the outer tube a first predetermined distance away from the inner case and a second predetermined distance away from the outer case.

A dispenser valve may be connected to the tank to control a supply of liquid from the tank to the dispenser. A tank cover may be configured to cover the tank and the dispenser valve.

The tank cover may include a cavity in which the tank and the valve may be provided and a rear opening. The rear opening may be provided adjacent to a rear wall of the inner case to be covered by the inner case. The tank cover may be coupled to the inner case. The inner case may be formed with an upper protrusion configured to restrict an upward movement of the tank cover. A lower protrusion may be formed on at least one of the inner case or a bottom surface of the cabinet to restrict a forward movement of the tank cover.

A side opening may be formed in a side wall of the inner case through which the outer tube may be configured to pass. A rear opening may be formed in a rear wall of the inner case through which the supply tube may be configured to pass. The tank cover may be configured to cover the side opening and the rear opening.

A back cover may define the rear of the cabinet and face a rear surface of the rear wall of the inner case. The back cover may have a back cover opening. A passage frame may be provided between the back cover and the rear wall. The passage frame may include a front plate provided at the rear surface of the rear wall, a front opening configured to align with the rear opening of the rear wall and defining the front of the passage, a rear plate provided at a front surface of the back cover that faces the rear surface of the rear wall, a rear opening configured to align with the back cover opening and defining a rear of the passage, and a guide frame provided between the front and rear plates and defining a remaining portion of the passage.

A shelf may be provided at the rear of the door. A door dike may protrude from the rear of the door to the storage space when the door may be closed. The door dike may be configured to support sides of the shelves. The dispenser may be provided at a position behind a rear end of the door dike when the door may be closed.

A side of the inner case may include an inclined wall that may be inclined outward in a front-rear direction. The dispenser may be provided at the inclined wall.

The inner case may include an inner surface defining the storage space, an outer surface facing the outer case, and a dispenser opening through which the discharge tube passes. The dispenser may include a dispenser case provided at the outer surface of the inner case at a position that covers the dispenser opening, a manipulation frame hinged to the dispenser case and configured to pivot upon being pressed or pushed, and a dispenser cover provided at the inner surface of the inner case at a position aligning with the dispenser opening. The dispenser cover may have a cover opening through which the manipulation frame may be partially exposed or partially inserted.

The dispenser cover may comprise an upper section protruding inward toward the storage space. The upper section may protrude farther inward than a front surface of the manipulation frame. The discharge tube may pass through a rear and a bottom of the upper section. A protruding distance of the upper section may increase in a direction toward a center. An end of the discharge tube may be provided below the center and exposed through the cover opening.

The dispenser cover may include a guide tube in which the discharge tube passes. The guide tube may be inclined inward toward the storage space in a downward direction. A sleeve made of a metal material may be inserted into the discharge guide. A portion of the discharge tube may pass through the sleeve. The end of the discharge tube may extend beyond an end of the sleeve.

A lower end of the manipulation frame may protrude outward toward the outer case. The lower end of the manipulation frame may be hinged to a lower end of the dispenser case.

A dispenser valve may control a discharge of liquid from the tank to the dispenser. A switch may be provided in the dispenser case. The switch may include a switch elastic member. When the switch elastic member may be compressed, the switch may be configured to send a signal to the dispenser valve to dispense liquid. A rotation lever may have a first arm and a second arm. A manipulation protrusion may extend from a rear of the manipulation frame toward the dispenser case. When the manipulation frame is pushed in a direction toward the dispenser case, the manipulation protrusion may be inserted into the dispenser case to push down on the first arm, the rotation lever may rotate, and the second arm may compress the switch elastic member to send the signal.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

In the description of this embodiment, detailed descriptions of related well-known structures or functions will be omitted when it is determined to be apparent to those skilled in the art. Directions described throughout the specification will be defined as follows. A direction toward a bottom surface on which the refrigerator is installed may be defined as a downward direction, a direction opposite to the bottom surface may be defined as an upward direction, a direction toward a door side of the refrigerator may be defined as a forward direction, a direction opposite to the door may be defined as a backward or rear direction, a direction toward the inside of the refrigerator may be defined as an inward direction, and a direction toward the outside of the refrigerator may be defined as an outward direction.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A refrigerator, comprising:

a cabinet including:

an outer case configured to define an exterior appearance of the cabinet, and an inner case defining a side wall of a refrigerating compartment, wherein the side wall includes a first surface, and a second surface that is inclined outward in a front-rear direction relative to the first surface;

an insulation material provided between the outer case and the inner case;

a door configured to open or close the refrigerating compartment;

door baskets provided on a rear of the door and vertically apart from each other in a vertical direction;

a door dike that protrudes from a rear surface of the door to support sides of at least one of the door baskets;

a tank provided within the refrigerating compartment and configured to store liquid;

a dispenser configured to receive and dispense liquid from the tank and provided on the second surface of the sidewall; and a discharge tube configured to supply liquid from the tank to the dispenser, wherein the dispenser includes;

a dispenser cover mounted on the second surface of the side wall and having a cover opening; and a manipulation frame positioned in the cover opening, wherein the discharge tube includes a dispensing section that is provided within an upper section of the dispenser cover such that the dispensing section protrudes at a downward incline from the second surface of the side wall, and wherein when the door is closed, the dispenser is positioned between a pair of the door baskets, and a protruding height of the upper section of the dispenser cover from the second surface is less than distances from the second surface to the pair of the door baskets.

2. The refrigerator according to claim 1, wherein the second surface extends from a front end of the refrigerating compartment, and the first surface extends from a rear end of the second surface.

3. The refrigerator according to claim 1, further comprising a pair of shelves that are provided in the refrigerating compartment and are spaced apart from each other in the vertical direction, wherein the dispenser is positioned between the pair of shelves.

4. The refrigerator according to claim 1, wherein the dispenser is positioned between a front end of the refrigerating compartment and a front end of the shelf or drawer.

5. The refrigerator according to claim 1, wherein the second surface is formed at a position corresponding to at least one of the door baskets; and both sides of the at least one of the door baskets are inclined inward in the front-rear direction.

6. The refrigerator according to claim 1, wherein the dispenser is inclined along a horizontal direction with respect to the outer side surface of the cabinet, and a rear end of the dispenser protrudes more than a front end of the dispenser.

7. The refrigerator according to claim 1, further comprising:

a shelf or drawer provided in the refrigerating compartment, wherein, when the door is closed, the dispenser is positioned between a rear end of the door dike and a front end of the shelf or drawer.

8. The refrigerator according to claim 1, wherein the upper section of the dispenser cover includes a central region that protrudes and sides that are recessed from the central region to have relatively smaller heights than the central region.

9. The refrigerator according to claim 8, wherein the dispensing section of the discharge tube is provided in the central region of the upper section of the dispenser cover.

10. The refrigerator according to claim 1, further comprising a discharge guide passage through which the discharge tube passes, the discharge guide passage extending inward from a lower surface of the upper section of the dispenser cover, wherein the discharge guide passage is inclined such that a lower section of the discharge guide passage is spaced farther away from the inner case than an upper section of the discharge guide passage.

11. The refrigerator according to claim 10, further comprising a sleeve made of metal and provided in the discharge guide passage, wherein the discharge tube passes through the sleeve, and the dispensing section of the discharge tube protrudes farther than an end of the discharge guide passage.

12. The refrigerator according to claim 1, wherein the upper section of the dispenser cover is located at an upper end of the cover opening and protrudes farther than the manipulation frame.

13. The refrigerator according to claim 12, wherein the manipulation frame is configured to cover the cover opening.

14. The refrigerator according to claim 12, wherein the manipulation frame includes manipulation frame rotating extensions that are formed on both sides of a lower end of the manipulation frame and are configured to be a rotation axis of the manipulation frame.

15. The refrigerator according to claim 14, wherein when the manipulation frame is operated, an upper end of the manipulation frame is rotated away from the dispensing section of the discharge tube.

16. The refrigerator according to claim 1, wherein the dispenser includes:

a rotation lever that rotates in conjunction with operation of the manipulation frame; and a switch that is turned on and off by a rotation of the rotation lever, and the rotation lever includes a lever center configured to server as a rotation center of the lever, and the rotation lever is configured to be rotated in a direction crossing the operating frame.

17. The refrigerator according to claim 16, further compromising:

a manipulation protrusion that protrudes from a rear surface of the manipulation frame; and a rotating arm extending from the lever center of the rotation lever, wherein the rotating arm rotates the rotation lever in a forward direction based on contacting the manipulation protrusion when the manipulation frame rotates.

18. The refrigerator according to claim 17, further comprising a push arm extending from the lever center of the rotation lever, wherein the push arm extends past the switch and contacts the switch when the rotation lever rotates in a forward direction.

19. The refrigerator according to claim 18, further comprising a stopping protrusion extending from the lever center of the rotation lever, wherein the stopping protrusion is configured to contact a stopper protruding from inside of the dispenser to limit a reverse rotation of the rotation lever.

20. The refrigerator according to claim 19, wherein the rotating arm, the push arm, and the stopping protrusion extend outward from the lever center of the rotational lever.

21. The refrigerator according to claim 1, further comprising a supply tube configured to connect the tank to an external supply source.

* * * * *